US012612915B2

(12) United States Patent
Dyck

(10) Patent No.: US 12,612,915 B2
(45) Date of Patent: Apr. 28, 2026

(54) INTAKES AND GAS SEPARATORS FOR DOWNHOLE PUMPS, AND RELATED APPARATUSES AND METHODS

(71) Applicant: David Dyck, Chestermere (CA)

(72) Inventor: David Dyck, Chestermere (CA)

( * ) Notice: Subject to any disclaimer, the term of this patent is extended or adjusted under 35 U.S.C. 154(b) by 0 days.

(21) Appl. No.: 18/664,082

(22) Filed: May 14, 2024

(65) Prior Publication Data

US 2024/0426302 A1 Dec. 26, 2024

Related U.S. Application Data

(63) Continuation of application No. 17/962,323, filed as application No. PCT/CA2022/050335 on Mar. 8, 2022.

(51) Int. Cl.

| | |
|---|---|
| ***F04D 9/00*** | (2006.01) |
| ***E21B 43/38*** | (2006.01) |
| ***F04D 3/02*** | (2006.01) |
| ***F04D 29/54*** | (2006.01) |
| ***F04D 29/66*** | (2006.01) |

(52) U.S. Cl.

CPC ..... *F04D 9/001* (2013.01); *E21B 43/38* (2013.01); *F04D 3/02* (2013.01); *F04D 29/548* (2013.01); *F04D 29/669* (2013.01)

(58) Field of Classification Search

CPC ..... F04D 3/02; F04D 9/001; F04D 29/548; F04D 29/669; E21B 43/38

See application file for complete search history.

(56) References Cited

U.S. PATENT DOCUMENTS

| | | | |
|---|---|---|---|
| 1,655,817 | A | 1/1928 | Marsh |
| 2,066,505 | A | 1/1937 | Arthur |
| 2,147,491 | A | 2/1939 | Le Bus |
| 2,346,602 | A | 4/1944 | O'Bannon |
| 2,721,570 | A | 10/1955 | Caparone |
| 2,728,457 | A | 12/1955 | Clarke |
| 2,748,719 | A | 6/1956 | Wells |
| 2,891,569 | A | 6/1959 | Goodner |
| 3,216,751 | A | 11/1965 | Der Mott |
| 3,477,467 | A | 11/1969 | Sewell |
| 3,514,074 | A | 5/1970 | Self |
| 4,003,548 | A | 1/1977 | Stradella |
| 4,241,787 | A | 12/1980 | Price |
| 4,258,750 | A | 3/1981 | Schnall |
| 4,274,433 | A | 6/1981 | Schnall |
| 4,276,904 | A | 7/1981 | Jackson |
| 4,279,274 | A | 7/1981 | Seger |
| 4,336,918 | A | 6/1982 | Karbo |
| 4,425,965 | A | 1/1984 | Bayh |
| 4,436,151 | A | 3/1984 | Callihan |
| 4,450,912 | A | 5/1984 | Callihan |

(Continued)

FOREIGN PATENT DOCUMENTS

| | | |
|---|---|---|
| AU | 642438 B2 | 10/1993 |
| EP | 0862101 A1 | 9/1998 |

(Continued)

*Primary Examiner* — Audrey B. Walter

(74) *Attorney, Agent, or Firm* — Robert A. Nissen

(57) ABSTRACT

Intake and gas separators for a downhole rotary pump define a fluid flowpath and comprise two or more intake stages arranged in parallel, and two or more of the intake stages each have one or more impellers and one or more inlet holes.

44 Claims, 32 Drawing Sheets

(56) References Cited

U.S. PATENT DOCUMENTS

| | | | |
|---|---|---|---|
| 4,473,210 | A | 9/1984 | Brighton |
| 4,510,993 | A | 4/1985 | Luetzelschwab |
| 4,541,454 | A | 9/1985 | Sturman |
| 4,617,991 | A | 10/1986 | Luetzelschwab |
| 4,669,541 | A | 6/1987 | Bissonnette |
| 4,725,038 | A | 2/1988 | Heneker et al. |
| 4,782,847 | A | 11/1988 | Luetzelschwab |
| 4,842,059 | A | 6/1989 | Tomek |
| 4,844,112 | A | 7/1989 | Pick |
| 4,872,808 | A | 10/1989 | Wilson |
| 4,987,920 | A | 1/1991 | Donner |
| 5,072,749 | A | 12/1991 | Ligh |
| 5,160,240 | A | 11/1992 | Wilson |
| 5,215,286 | A | 6/1993 | Kolenc |
| 5,234,026 | A | 8/1993 | Patterson |
| 5,389,128 | A | 2/1995 | Lopes |
| 5,641,271 | A | 6/1997 | Forrester |
| 5,653,286 | A | 8/1997 | McCoy |
| 5,732,929 | A | 3/1998 | Luppino |
| 5,837,152 | A | 11/1998 | Komistek |
| 5,890,508 | A | 4/1999 | Powell |
| 6,039,121 | A | 3/2000 | Kisman |
| 6,244,563 | B1 | 6/2001 | Ejiri |
| 6,277,286 | B1 | 8/2001 | Søntvedt |
| 6,484,801 | B2 | 11/2002 | Brewer |
| 6,547,005 | B2 | 4/2003 | Haheim |
| 6,679,323 | B2 | 1/2004 | Vargervik |
| 6,701,957 | B2 | 3/2004 | McCarty |
| 6,755,978 | B2 | 6/2004 | Oddie |
| 6,782,920 | B2 | 8/2004 | Steinke |
| 6,868,907 | B2 | 3/2005 | Homstvedt |
| 7,013,918 | B2 | 3/2006 | McCarty |
| 7,131,497 | B2 | 11/2006 | Helms |
| 7,174,959 | B2 | 2/2007 | Pratt |
| 7,188,671 | B2 | 3/2007 | Al-Zahrani |
| 7,699,353 | B2 | 4/2010 | Smith |
| 8,146,653 | B2 | 4/2012 | Naderi |
| 8,556,580 | B2 | 10/2013 | Stair |
| 8,640,732 | B1 | 2/2014 | Beswick |
| 9,200,642 | B2 | 12/2015 | Nowitzki |
| 9,260,937 | B2 | 2/2016 | Chauveteau |
| 9,638,207 | B2 | 5/2017 | Jayaram |
| 9,869,164 | B2 | 1/2018 | Tolman |
| 9,903,185 | B2 | 2/2018 | Ursi |
| 10,053,956 | B2 | 8/2018 | Husveg |
| 10,260,330 | B2 | 4/2019 | Reeves |
| 10,378,323 | B2 | 8/2019 | Jouenne |
| 10,400,569 | B2 | 9/2019 | Osborne |
| 10,443,321 | B2 | 10/2019 | Cravatte |
| 10,443,369 | B2 | 10/2019 | Obrejanu |
| 10,583,373 | B2 | 3/2020 | Braaten |
| 10,738,794 | B2 | 8/2020 | Rao |
| 10,753,504 | B2 | 8/2020 | Kumar |
| 10,989,234 | B2 | 4/2021 | Jouenne |
| 11,008,847 | B2 | 5/2021 | Dyck |
| 11,391,140 | B2 | 7/2022 | Nordsveen |
| 11,414,956 | B1 | 8/2022 | Burris |
| 11,441,694 | B2 | 9/2022 | Kumar |
| 11,492,888 | B2 | 11/2022 | Marshall |
| 11,629,733 | B2 | 4/2023 | Eslinger |
| 11,834,915 | B2 | 12/2023 | Massey |
| 2013/0240200 | A1 | 9/2013 | Frazier |
| 2014/0076560 | A1 | 3/2014 | Kenyon |
| 2015/0101794 | A1 | 4/2015 | Canas |
| 2015/0159466 | A1 | 6/2015 | Themig |
| 2016/0326836 | A1 | 11/2016 | Gonzalez |
| 2017/0151510 | A1 | 6/2017 | Cobb |
| 2020/0291762 | A1* | 9/2020 | Ellithorp ..... E21B 43/122 |
| 2022/0056781 | A1 | 2/2022 | Tiwari |
| 2022/0195835 | A1 | 6/2022 | Acosta Villarreal |
| 2022/0349272 | A1 | 11/2022 | Patil |
| 2022/0381109 | A1 | 12/2022 | Hurtado |
| 2023/0108948 | A1* | 4/2023 | Brown ..... F04D 29/445 166/369 |
| 2023/0111850 | A1* | 4/2023 | Sheth ..... E21B 43/38 417/53 |

FOREIGN PATENT DOCUMENTS

| | | | |
|---|---|---|---|
| EP | 3396218 | A1 | 10/2018 |
| RU | 2514469 | C1 | 4/2014 |
| WO | 2003062597 | A1 | 7/2003 |
| WO | 2012001671 | A2 | 1/2012 |
| WO | 2014178723 | A1 | 11/2014 |
| WO | 2015092334 | A2 | 6/2015 |
| WO | 2017105250 | A1 | 6/2017 |

* cited by examiner

INTAKES AND GAS SEPARATORS FOR DOWNHOLE PUMPS, AND RELATED APPARATUSES AND METHODS

TECHNICAL FIELD

This document relates to intakes and gas separators for downhole pumps, and related apparatuses and methods. The present disclosure relates generally to separation of gas and liquid phases of downhole fluids at the intake of a downhole rotary pump and more particularly to an intake and gas separator system to maximize pump efficiency and drawdown and production rates, especially in gassy wellbores, and high deviation or horizontal wellbores with unstable flow regimes.

BACKGROUND

The following paragraphs are not an admission that anything discussed in them is prior art or part of the knowledge of persons skilled in the art.

Hydrocarbons, such as oil and gas, are produced or obtained from subterranean reservoir formations that may be located onshore or offshore through wells.

Pump systems, for example, electrical submersible pump (ESP) systems and progressive cavity pump (PCP), may be used when reservoir pressure alone is insufficient to produce hydrocarbons from a well. Presence of free gas in a fluid being pumped and the resulting multiphase flow behavior of the fluid has a detrimental effect on pump performance and motor cooling. The presence of gas in a pump reduces the pressure created within each pump stage, which reduces output of the pump. In extreme situations, high concentrations of gas within a pump result in a condition commonly referred to as "gas lock", where gas is so prevalent within enough stages of the pump, that flow ceases in the intended direction. Reducing the concentration of gas, reducing the size of the bubbles, and increasing the pressure in the fluid that enters the main pump stages improves pump performance and may improve the operating temperature and stability of the motor. Traditionally these objectives are achieved with a combination of equipment commonly referred to as: gas avoiders, which are low side intakes for pumps installed at high inclinations, active gas separators, which use centrifugal forces (like a cyclone) to separate liquid from gas, reverse-flow gas separators, which use gravity to separate liquid from gas, and gas handlers, which homogenize the flow, reduce the size of bubbles, and provide an increased pressure at the first main stage of the ESP. Existing gas avoider and separator systems that typically have a short intake and a single (or sometimes tandem) active gas separation stage are not well optimized for intermittent (e.g. sluggy) flow conditions at the pump intake, which is typical of horizontal wells. Additionally, it is possible to more effectively separate gas in terms of increasing total gas removal capacity, increasing total flow rate capacity, improved power efficiency, with reduced length, improved reliability, and lower cost compared to existing gas separators. One of the main areas of weakness of existing gas separator designs is that the intakes are not designed to efficiently ingest enough total fluid in order to process out a majority of gas in the fluid and still provide a high total flow rate capacity of liquid to the main stages of the pump in order to maximize drawdown and production rates. A more effective, efficient and reliable pump intake and gas separation system is proposed.

Traditional gas separators may use a single impeller (typically of an auger style) or fluid moving stages (each stage is comprised of an impeller and diffuser) to push fluid into a separation chamber. In the separation chamber a rotational flow within the downhole fluid has sufficient centrifugal forces to separate the gas from the liquid. The rotation of the fluid may be induced by an impeller (which may be auger-shaped, or may include straight vanes called paddles, helical vanes, forward, and/or backward swept vanes; or the rotation of the fluid may be induced by a stationary structure which creates a helical flowpath. In the prior art the gas collects within the annular gas separation chamber toward the centerline (which will may be termed the "inside"). There is a generally cylindrical component at the bottom of a crossover which allows the flow of gas through the inside path, and the flow of liquid through the outside path. This cylindrically shaped structure divides the flow of primarily liquid at the radial outward position from the flow of primarily gas at the radial inward position. Downstream of this cylindrically shaped structure is a crossover flowpath. The crossover flowpath allows for the gas to be exhausted from where it is collected inside the cylindrically shape structure and into the wellbore at a position that is axially above the inlet holes. Various designs have been used in the crossover: where the flowpaths may be machined holes, or the crossover may be structured like a diffuser where the gas crossover flowpath is through hollow vanes. The liquid flowpath is typically axial and restricted in cross sectional area which provides inefficient conversion of the spinning fluid velocity into pressure, although in some designs where the crossover flowpath is through hollow vanes provide a larger flow area for liquid and the curved helical structure of the vanes provides efficient recovery of the spinning energy of the liquid. The smallest cross sectional flow area in the gas exhaust flowpath of existing gas separators is in this crossover flowpath. However, it is also typical that the smallest cross sectional flow area in the gas exhaust flowpath is very large and results in no effective restriction to gas exiting the gas separator, and as a consequence the pressure within the gas separation chamber is not substantially greater than the pressure in the wellbore outside the gas separator; which is a problem for two reasons. First, typical gas separator designs provide insufficient pressure generation from the intended intake and do not achieve consistent flow in the intended direction; instead, fluids are actually ingested intermittently though the gas exhaust ports, particularly in real life well conditions where multiphase and slug flow conditions are encountered. Secondly, the liquid flowpath is inherently restricted through the crossover and flange connection into the main pump stages, which typically means that the fluid being pumped typically reaches the lowest static pressure in this crossover which results in gas breakout (or steam flashing in thermal wells) before the fluid arrives at the first pump stage.

SUMMARY

Cost and length are important considerations for any downhole pump and it is desirable to reduce both; the present disclosure improves upon both the cost and the length of existing gas separators. The construction technique of the present disclosure permits gas separation stages to be assembled within the same housing as the main stages of an ESP, which saves the length and cost penalties associated with a coupler. The design of gas separation stages of the present disclosure permit gas separation stages to be short and economically assembled in a similar manner to other stages of an ESP. The length-to-housing diameter (L:D) ratio of one or more stages may be less than 4. (L is the height of the stage shown, while D is defined by the outer diameter of the external housing enclosing the stage)

A compact axial length gas separator stage is disclosed for a downhole rotary pump comprising: a housing within which a fluid flowpath is defined; and a diffuser defining a gas crossover flowpath between a gas entry point and a gas outlet.

An intake stage is disclosed for a downhole rotary pump comprising: an intake housing defining a fluid flowpath and an inlet hole to the fluid flowpath; and an impeller; in which the inlet hole is configured to expose at least a portion of an impeller vane of the impeller to an exterior of the downhole rotary pump. Multiple intake stages may be arranged in series.

An intake is disclosed for a downhole rotary pump comprising: an intake housing defining a fluid flowpath and inlet holes to the fluid flowpath; an impeller; and a shaft extending through the intake; in which the inlet holes have a ratio, of the cumulative open flow area through the inlet holes to the flow area inside the intake housing, greater than 1, for example greater than 2.

A multi-stage intake is disclosed of a downhole rotary pump defining a fluid flowpath and comprising two or more intake stages arranged in parallel, with two or more of the intake stages having one or more impellers. An intake system for a downhole rotary pump, according to one or more embodiments of the present disclosure, utilizes rotating elements and stationary elements to collect fluid from the wellbore, to separate and exhaust gas from the fluid that is collected, to minimize and reduce the size of gas bubbles within the fluid, and to boost the pressure of the fluid being provided to the main stages of the pump. The elements disposed or positioned inside of a housing, with a rotating shaft to passing through the center of the elements.

While the main use case may be in an ESP with a downhole electric motor positioned below the pump, it should be interpreted to be applicable to any downhole rotary pump (i.e., this intake system may be used with centrifugal or axial or positive displacement rotary downhole pumps that are driven either from surface via sucker rods, continuous rods, or driven from a downhole motor that may be electric or hydraulic, or other). ESP is implied to mean a centrifugal type pump which rotates in the range of 500 to 20,000 RPM driven by a downhole electric motor. PCPs are positive displacement pumps, sometimes known as "screw pumps", they operate in the range of 10 to 500 RPM and are typically driven from a motor or engine on surface using drive rods. This intake system may also be used in conjunction with vane pumps or twin-screw pumps in downhole applications.

The intake and gas separation system of the present disclosure improves the efficiency and reliability of pumping a gas laden fluid, for example, one or more downhole fluids associated with a hydrocarbon recovery or production operation. It is designed to ingest and process larger total volumes of fluid in order to provide higher levels of drawdown and production, while efficiently exhausting a portion of the gas, and conditioning the fluid for entry to the first main stage of the pump.

There are several principles and behaviors of fluids in wellbores and of ESP systems which form the basis of the present disclosure. First, gravity separation and segregated flow of the liquid and gas phases of fluids occurs in near-horizontal wellbores, which has been exploited by prior art gas avoiders to minimize gas coning into the pump inlet ports; this behavior is exploited in this disclosure using instead an extended length intake and exposed impellers. Second, the density (momentum) and viscosity of gas is lower than liquid which allows gas to effectively traverse flowpaths that liquid would not effectively flow through due to the nature of the flowpath which may be tortuous, narrow, opposing the direction of the flow, or opposing the direction of the movement of rotating elements; this behavior has not been effectively exploited in prior art gas separators. Third, existing ESP elements (impellers and diffusers) tend to accumulate gas in certain location; this behavior has not been exploited in prior art gas separators or pump stages to exhaust gas, and this tendency to accumulate gas at certain locations can be enhanced with small geometric tweaks while achieving effective gas separation from much more compact (shorter) stage designs. Fourth, the tendency for ESP impellers to gas lock is well established, but has not been used to autonomously avoid the intake of gas by arranging multiple impellers in parallel. Arranging multiple intake stages 104 in parallel over a rotating shaft which uses rotating elements to control the contribution from each stage has not been used previously.

Illustrative embodiments of the present invention are described in detail herein. In the interest of clarity, not all features of an actual implementation may be described. It will of course be appreciated that in the development of any such actual embodiment, numerous implementation-specific changes will be made to achieve the specific implementation goals, and will vary from one implementation to another. Moreover, it will be appreciated that such a development effort might be complex and time consuming, but would nevertheless be a routine undertaking for those of ordinary skill in the art having the benefit of the present disclosure.

The present disclosure is illustrated in a manner that is consistent with the assembly technique of typical ESPs—a stages are stacked within a housing where the housing forms the primary structural member including pressure loads. It may be understood that certain embodiments of the present invention may be assembled without a housing, wherein each stage may be coupled to the next and each stage may carry the structural and pressure loads directly without the need for a housing.

In various embodiments, there may be included any one or more of the following features: An axial length of the compact axial length gas separator stage is four or less times an outer diameter of the housing. The diffuser has one or more hollow vanes within which the gas crossover flowpath is at least partially defined. The gas entry point into the gas crossover flowpath is positioned at a location where gas tends to accumulate in the diffuser. The diffuser defines a helical flowpath in the fluid flowpath; the helical flowpath includes relatively high-density flux points and relatively low-density flux points, where relatively high- and low-density parts, respectively, of a multiphase fluid pass through or accumulate during use; and the gas entry point is positioned at one or more of the relatively low-density flux points. The diffuser has one or more solid vanes. The one or more hollow vanes consists of one hollow vane. The gas entry point is directly into the one or more hollow vanes. The gas entry point is located toward or at, one or more of: a top edge of the one or more hollow vanes; a rear vane wall of the one or more hollow vanes; a radially inside edge of the one or more hollow vanes; and an axial inside surface that is radially inward of the one or more hollow vanes. The gas entry point is defined by a gap between the radially inside edge and the axial inside surface. The axial inside surface has a cylindrical, conical, or toroidal profile. The one or more hollow vanes define an internal helical gas plenum that defines the gas crossover flowpath. An axial outer surface of the diffuser defines an annular space that is radially outward of the one or more hollow vanes and inside the housing. The axial inside surface of the diffuser defines an inner plenum that forms part of the gas crossover flowpath, and the diffuser is structured to receive gas into the inner plenum in a direction that is one or more of: uphole; or radially inward. An impeller. The gas entry point is defined between the impeller and the diffuser. The impeller comprises impeller vanes, that are configured to sweep across the gas crossover flowpath at the gas entry point. The impeller vanes that are configured to sweep across the gas crossover flowpath are configured to prevent unwanted exhausting of liquid through the gas crossover flowpath. The impeller vanes that are configured to sweep across the gas crossover flowpath are configured to ingest liquid from the gas crossover flowpath during operating conditions when there happens to be liquid in the gas crossover flowpath and the pressure within the compact axial length gas separator stage is relatively lower than during normal operating conditions. The gas entry point is defined within the impeller. The gas entry point is positioned at locations where gas tends to accumulate in the impeller. The impeller defines a helical flowpath in the fluid flowpath; the helical flowpath includes relatively high-density flux points and relatively low-density flux points, where relatively high- and low-density parts, respectively, of a multiphase fluid pass through or accumulate during use; and the gas entry point is positioned at one or more of the relatively low-density flux points. The gas entry point is located toward or at, one or more of: a top edge of the one or more impeller vanes; a rear vane wall of the one or more impeller vanes; a radially inside edge of the one or more impeller vanes; or an axial inside surface that is radially inward of the one or more impeller vanes. The impeller comprises: a first impeller part structured to drive fluids received from upstream through the gas separator into the diffuser; and a second impeller part coaxial with and nested within the first impeller part and structured to sweep a gas entry point of the gas crossover fluid pathway. An outer annular space is defined between the diffuser and the housing. The outer annular space is structured to have sufficient volume to allow residence time for gas bubbles to coalesce before being exhausted out of the gas outlet. The outer annular space is structured to allow for misalignment between hollow vanes of the diffuser and holes in the housing of the compact axial length gas separator stage. The smallest cross-sectional area in the gas crossover flowpath that restricts flow through the gas crossover flowpath is at the gas entry point. A minimum width of the gas crossover flowpath at the gas entry point is less than 0.03 times an outside diameter of the housing. The minimum width of the gas crossover flowpath at the gas entry point is between 0.0003 and 0.03 times the outside diameter of the housing. The minimum width of the gas crossover flowpath at the gas entry point is between 0.00003 and 0.01 times the outside diameter of the housing. A minimum width of the gas crossover flowpath at the gas entry point is less than 0.16". The minimum width of the gas crossover flowpath at the gas entry point is between 0.16" and 0.0016". The minimum width of the gas crossover flowpath at the gas entry point is between 0.05" and 0.0016". The gas entry point is structured to receive gas into the gas entry point in a direction that is one or more of: uphole, downhole, or radially inward, or, in some cases, radially outward or through a helically shaped leading edge (or face) or the trailing edge (or face) of the diffuser vanes. A vortex chamber upstream of the diffuser. A downhole rotary pump comprising two or more of the compact axial length gas separator stages. Three or more of the compact axial length gas separator stages. A downstream stage of the compact axial length gas separator stages is designed for lower total volumetric flow rates than an upstream stage of the compact axial length gas separator stages. A downstream stage of the compact axial length gas separator stages has a greater restriction to gas flow in the gas crossover flowpath than an upstream stage of the compact axial length gas separator stages. A net positive pressure is generated as fluid passes each stage of the of the compact axial length gas separator stages. The housings of two or more compact axial length gas separator stages form an integral housing. The integral housing includes a pump housing of downstream pump stages of the downhole rotary pump. Operating the downhole rotary pump by rotating an impeller to drive fluid through the fluid flowpath and separate gas, from the fluid, into the gas crossover pathway. The inlet hole is oriented to expose, along a radial line of sight, the at least a portion of the impeller vane. The inlet hole forms an inlet conduit that is angled to direct fluid to at least partially align with uphole direction of fluid flow in the fluid flowpath. The inlet hole is elongate in an axial direction. A diffuser downstream of the impeller. Plural inlet holes. The plural inlet holes are angularly spaced from one another about a circumference of the intake housing. The plural inlet holes have a ratio, of the cumulative open flow area through the inlet holes to the flow area inside the intake housing, of greater than 1. The plural inlet holes have a cumulative axial length, defined along an axial path along the intake housing, of greater than 11.8". The impeller vane is angled or cupped radially inward at a radial end of the impeller vane to minimize radial velocity of the liquid and help push the liquid toward a center axis of the intake housing. The inlet holes have a ratio, of the cumulative open flow area through the inlet holes to the flow area inside the intake housing, greater than 2. An inlet section defined by the inlet holes is elongate in an axial direction. The inlet section has a cumulative axial length of greater than 11.8". One or more of the inlet holes are configured to expose, along a radial line of sight, at least a portion of an impeller vane of the impeller to an exterior of the downhole rotary pump. A plurality of intake stages, with two or more intake stages having at least inlet holes and an impeller. Plural of the inlet holes are angularly spaced from one another about a circumference of the intake housing. An intake comprising two or more of the intake stages. The intake comprises three or more of the intake stages. The intake housings of two or more intake stages form an integral housing. The intake housings of each intake stage form an integral intake housing and housings of a plurality of downstream gas separator or pump stages, of the downhole rotary pump, form an integral pump housing. Diffusers are between impellers of adjacent intake stages. An outer diameter of the downhole rotary pump at the inlet hole of a subsequent intake stage is increased relative to the preceding intake stage. One or more gas separator stages downstream of the intake stages. Intake stages arranged in parallel. Each intake stage comprises: an intake housing defining the fluid flowpath and an inlet hole to the fluid flowpath; and an intake impeller configured to draw fluid through the inlet hole and supply the fluid into the fluid flowpath. Each intake stage defines: an axial flowpath for axial flow of fluid from an upstream end to a downstream end of the intake stage; and a crossover flowpath to ingest fluid from the inlet hole and provide the fluid to the impeller, which is radially inward of the crossover flowpath. Each intake stage comprises two or more impellers. For one or more intake stages the crossover flowpath comprises a gathering space chamber configured to receive fluid from the inlet hole and provide the fluid to two impellers arranged in parallel within the intake stage. For one or more intake stages: the intake stage comprises an outer housing and an inner housing; an annular plenum (may be referred to as an annular space) is defined between the inner housing and outer housing; the inlet hole comprises an inner inlet hole and an outer inlet hole: the inner housing defines the inner inlet hole; and the outer housing defines the outer inlet hole to permit entry of fluid into the annular plenum. The annular plenum has sufficient volume to allow residence time for gas bubbles to coalesce and rise out of the fluid by buoyancy. The outer inlet holes are axially above the inner inlet holes to allow gas bubbles to coalesce and rise out of the fluid by buoyancy. The outer inlet holes have a ratio, of the cumulative open flow area through the outer inlet holes to the flow area within the annular plenum, of greater than 1. For two or more intake stages, a radial thickness of the impeller between an inner impeller diameter and an outer impeller diameter is between 15 and 75% of a radial distance between an outer wall of a central rotating shaft and an inner diameter of the outer housing. Each intake stage has a ratio of an axial length to outer diameter of an outer housing of the intake stage of 3.0:1 or less. One or more intake stages have a ratio of an axial length to outer diameter of an outer housing of the intake stage of 3.0:1 or less. For one or more intake stages, an inlet section comprising the inlet holes has an axial length, defined along an axial path along the intake housing, of between 20% and 70% of an axial length of the intake stage. One or more intake stages have a ratio of an axial length to outer diameter of an outer housing of the intake stage of 4.0 or less, 3.0:1 or less, 2.0 or less, and in some cases other values, such as greater than 2.0. One or more intake stages may have an axial length to outer diameter ratio of 3.0:1 or less. One or more intake stage comprises: an outer housing with an outer inlet hole; an inner housing radially inward of the outer housing defining the fluid flowpath; the inner housing defining an inner inlet hole; the space between the inner housing and outer housing defining an annular plenum; and an impeller within the inner housing and configured with a radially outward intake impeller portion. For one or more intake stages: the intake stage defines an axial flowpath for axial flow of fluid from an upstream intake stage to flow uphole through a radially inward portion, of the impeller, configured to pass fluid axially past the impeller; and an outer intake portion of the impeller is configured to draw fluid through the inner inlet hole and provide the fluid to the axial flowpath. The inner inlet hole is configured to direct fluid in a radially inward direction into the intake impeller. The multi-stage intake is structured to direct incoming fluid in a downhole direction in the annular plenum; radially inward through the inner inlet hole; and in an uphole direction through the outer intake portion of the impeller. A cylindrical, toroidal, or conical surface separates the radially inward portion of the impeller from the outer intake portion of the impeller. Vane design is different on the radially inward portion of the impeller from the vane design on the outer intake portion of the impeller, for example such that the vane design on the outer intake portion is structured to create more pressure with a lower flow rate. The vanes are continuous between the radially inward portion of the impeller and the outer intake portion of the impeller and there is no surface dividing the two. For one or more intake stages, the outer intake portion of the intake impeller is configured to draw fluid axially downhole, turn the fluid radially inward and axially uphole, mixing with the fluid from the upstream stages, and together the mixed fluids pass though the radially inward portion of the intake impeller in an uphole direction. The inner inlet hole is oriented in a generally axial direction and the outer intake portion of the intake impeller is arranged generally in a downhole direction and with a similar diameter as the annular plenum. A vane helix direction of the outer intake portion of the impeller is opposite to a vane helix direction of the radially inward portion of the impeller. The outer intake portion of the intake impeller is primarily radial and is configured to move the fluid in a downhole direction and a radially outward direction. The outer intake portion of the intake impeller is configured to direct fluid in a downhole and radial outward direction. A cross-sectional area of the outer inlet holes is sufficient to allow for gas bubbles to coalesce and rise out of the fluid by buoyancy and a volume of the annular plenum below the outer inlet holes provides a sufficient reserve volume of liquid rich fluid to avoid gas locking during slug flow events in the wellbore. A volume within the outer inlet holes and the annular plenum is sufficient to allow for gas bubbles to coalesce and rise out of the fluid by buoyancy. The outer inlet holes are axially above the inner inlet holes, to allow gas bubbles to coalesce and rise out of the fluid by buoyancy. One or more intake stages comprise a plurality of outer inlet holes angularly spaced from one another about a circumference of a housing. For one or more intake stages, the outer inlet hole is elongate in an axial direction. The outer inlet hole forms an inlet conduit that is angled to direct fluid to align with a downhole direction of fluid flow within the annular plenum and promote uphole motion of gas bubbles out of the annular plenum. For one or more intake stages, an inlet section defined by the outer inlet hole has a cumulative length between 20% and 70% of the cumulative stage axial length. For two or more intake stages, the inlet section has an axial length with a ratio, of the axial length of the inlet section to the outer diameter of the housing at the inlet hole, of greater than 4. One or more intake stage has an axial length to outer diameter ratio of 4.0:1 or less, 3.0:1 or less, or 2.0:1 or less. A diffuser with vanes is disposed in proximity to the impeller providing radial support to the shaft, and axial support to the impeller. A diffuser: defines a gas crossover flowpath between a gas entry point and a gas outlet; has one or more hollow vanes within which the gas crossover flowpath is at least partially defined; and is structured to exhaust gas from an entry point, through the gas crossover flowpath, and into the annular plenum defined between the inner housing and outer housing. A compact axial length gas separator stage is disposed in a downstream direction. A downhole pump has a plurality of multi-stage intakes in parallel wherein the annular plenum of one or more intake stage has sufficient cross-sectional area and sufficient volume, and the number of intake stages used is sufficient, to allow efficient gravity-based separation of gas while also providing a high total intake flow rate to the downstream gas separator or pump stages. An assembly of the intake stages has a ratio, of the cumulative open flow area through the outer inlet holes of all stages in the assembly, to the flow area inside the intake housing, of greater than 4; and a reserve-fluid volume that is created in use by a length of annular plenum defined between the bottom of the outer inlet holes and the top of the inner inlet holes of greater than 12 inches; and 3 or more stages arranged in parallel; such that efficient gravity-based separation of gas is allowed in use while also providing a reserve volume of fluid to improve tolerance to transient gas slug flow in the wellbore, and a high total intake flow rate to the downstream gas separator or pump stages. Operating the downhole rotary pump by driving each intake stage to intake fluid in parallel into the fluid flowpath. The impeller of each intake stage autonomously regulates the inflow rate from each stage; and intake stages with higher density fluid at the impeller provide a higher volumetric flow rate and contribution to the total inflow than intake stages which a lower density fluid. Operating the downhole rotary pump wherein the impeller of each stage creates sufficient pressure to overcome friction pressure losses within the fluid flowpath allowing nearly or approximately equal contribution from all intake stages regardless of their position toward the bottom or the top of the downhole rotary pump.

The foregoing summary is not intended to summarize each potential embodiment or every aspect of the subject matter of the present disclosure. These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Figure 1A:
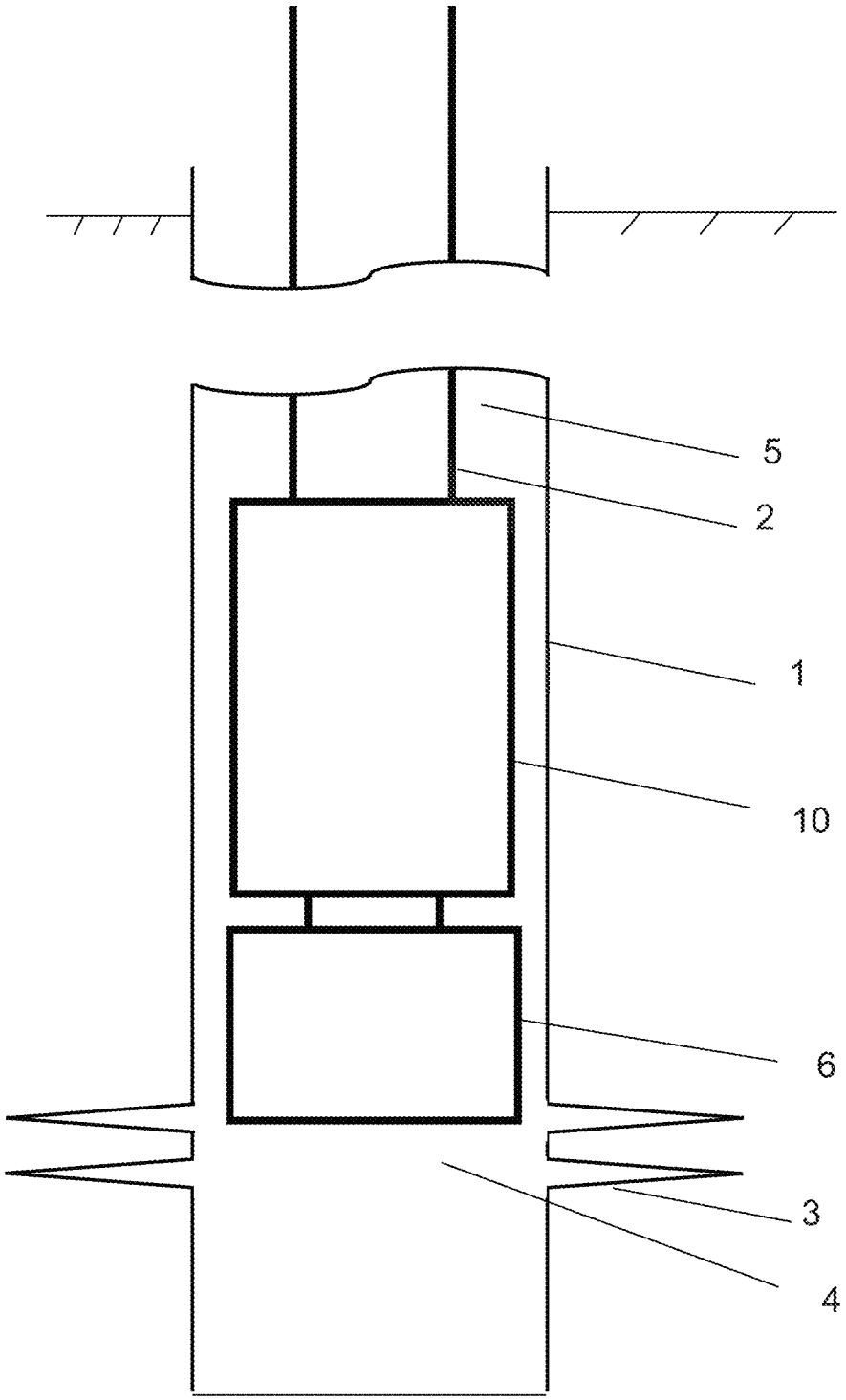
FIG. 1A is a side elevation view of a rotary pump disposed on the end of a production tubing string in a wellbore that penetrates an underground formation, the pump incorporating an intake and gas separation device.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Features and their benefits are only discussed in detail for the first figure for which they are shown. In general, the complexity of embodiments increases sequentially through the FIGS. and for the sake of clarity and brevity. In order to understand the configuration and benefits of features shown in certain figures, it may be necessary to read the entire description to that point and applying the understanding of features, configurations, and benefits from previous FIGS. into the reading of subsequent figures.

The terms "couple" or "couples," as used herein are intended to mean either an indirect or direct connection. Thus, if a first device couples to a second device, that connection may be through a direct connection such as a shaft, flange or weld connection, or through an indirect electrical connection or a shaft coupling via other devices and connections.

The term "fluid" is used to refer to generally liquids or gasses or mixtures thereof.

The term "liquid" refers to a fluid which is primarily, or primarily intended, to be composed of liquid and typically includes the presence of some gas which may be dissolved or entrained in the liquid as bubbles.

The term "gas" refers to a fluid which is primarily, or primarily intended, to be composed of gas and typically includes the presence of some liquid which may be carried with the gas as mist, droplets, a film, or even as slugs or waves. Gas may be wet, and for thermal operations may be primarily composed of water vapor (steam) or solvent vapor.

The term "uphole", "upper", or "top" is used to refer to the downstream location relative to fluid flow within the pump, corresponding to the direction that fluids are pumped up and out of the wellbore. Correspondingly "downhole", "bottom", or "lower" refers to the upstream location relative to fluid flow within the pump, regardless of the horizontal or vertical orientation of the device or wellbore.

The term "leading edge" refers to the front edge of the impeller in the designed direction of rotation. Typically for impellers and diffusers the leading edge is visible when viewing the part from the top, but not always—for example with a radial impeller design. In the embodiments shown the direction of rotation when viewed from the top down is clockwise. When viewing an impeller in the upright position the leading edge is on the right. The leading edge of the diffuser is reversed; in the embodiments shown, the leading edge of the diffusers, which are stationary, are on the left.

The term trailing edge refers to the back edge of the impeller or diffuser in the designed direction of rotation. Typically for impellers and diffusers the trailing edge is visible when viewing the part from the bottom, but not always. In the embodiments shown the direction of rotation when viewed from the top down is clockwise. When viewing an impeller in the upright position the trailing edge is on the left. The trailing edge of the diffuser may be reversed—in the embodiments shown, the trailing edge of the diffusers, which are stationary, are on the right.

The term "radial inward" refers to a radial position that is relatively closer to the axis than another part or position. Throughout this disclosure, the position of features is discussed relative to the flowpath of fluid where radial inward refers to a position within the wetted flowpath that is close to the axis. "Inside" and "inner" may be used interchangeably with "radial inward" unless context dictates otherwise.

The term "radial outward" refers to a radial position that is relatively far from the axis than another part or position. Throughout this disclosure, the position of features is discussed relative to the flowpath of fluid where radial outward refers to a position within the wetted flowpath that is far from the axis. "Outside" and "outer" may be used interchangeably with "radial outward" unless context dictates otherwise.

The term "impeller" may be used broadly to refer to rotating vaned components in this disclosure. Impellers are typically coupled to the shaft via keys or splines, which transmits rotation and torque from the motor to each impeller, although the detail of such keyway or spline is not shown in the present drawings. Impellers and the downthrust loads they generate are typically supported axially by the diffuser below it. Impeller flowpath designs may range from axial-flow designs where the diameter and cross section are constant, helicoaxial flow design where the diameter increases between the fluid entry flowpath and the fluid exit flowpath, radial flow design where the flowpath turns in a radial outward direction, and compression stages where the cross section decreases between the fluid entry flowpath and the fluid exit flowpath. Impeller vane designs may be straight, forward swept, or backward swept, and the profiles of the vanes may be straight, curved at the tip, gradually curved, or angled—the curves or angles in the vane profile may be in either an uphole or downhole direction. Certain embodiments of such configuration options are shown as illustrative embodiments throughout this disclosure, but do not cover the full range of options in order to keep the number of figures to a reasonable amount.

The term "diffuser" may be used broadly to refer to non-rotating vaned components in this disclosure. Although not intended to be limiting, when paired with axial-flow impellers the diffusers may primarily straighten the flow, and when paired with helicoaxial or radial flow impellers the diffusers may serve to straighten the flow and redirect the flow from a radially outward position to a radially inward at the entrance of the next impeller. The cross-sectional flow area in a diffuser may be increased between the fluid entry flowpath and the fluid exit flowpath which helps convert dynamic pressure to static pressure. Diffuser vanes may be forward swept or backward swept, and the profiles of the vanes may be curved at the tip, gradually curved, or inclined in either an uphole or downhole direction. Certain embodiments of these configuration options are shown as illustrative embodiments throughout this disclosure, but do not cover the full range of options in order to keep the number of figures to a reasonable amount. Diffuser designs may include inserts for impeller seals, impeller supports, shaft seals and shaft supports such as bearings (bushings), and the illustrative embodiments throughout this disclosure have been simplified to not show these components as separate pieces, even though they would be present in a typical functional assembly. Diffusers may be scaled and supported within the housing in a resilient manner, typically O-rings—throughout this disclosure the groove for an O-ring is typically shown but the O-rings themselves are not shown for the sake of simplicity, even in the assembly cross section views. Additionally, thrust bushings, seals and other features functioning to support the adjacent impellers may be used but are not shown.

Impellers and diffusers may be manufactured by a suitable technique in mass production such as by casting, but may also be manufactured with other techniques including machining or 3D printing.

The present disclosure relates generally to the separation of gas and liquid phases of downhole fluids at the intake of a downhole rotary pump and more particularly to an intake and gas separator system to maximize pump efficiency and potential drawdown, especially in gassy wellbores, and high deviation or horizontal wellbores with unstable flow regimes.

Gas separators may be used to reduce the amount of gas present in the fluid that is provided to the pump to improve pump efficiency and reliability; while gas is exhausted to the annulus and the gas flows to surface through a separate annular flowpath (between the casing and the production tubing). Gas separation is typically achieved by using the density difference between gas and liquids in the fluid flowstream.

In gravity-based separators, bubbles rise in an upward direction while liquid preferentially flows in a downward direction forming a primary mechanism by which gas separates. Gravity—based separators may be separated into two classes, which may be selected between depending on the inclination at which they are used. For non-horizontal inclination applications (e.g., vertical) they may reverse the flow direction of the flow which limits the amount of gas that can flow in a downhole direction through a flowpath—these may be known as reverse-flow separators, dip tubes, liquid concentrating intakes and others. For near-horizontal applications (e.g., typically greater than 70 degrees inclination), they may operate based on the principle of gravity-based segregation of phases in the wellbore outside of the intake—they may be known as gas avoiders (low side intakes), and are discussed further in FIG. 1C. Because the pressures gradients, forces, and velocities in a gravity-based separation process must be relatively low, downhole gravity-based separation devices may be located at the suction end of a downhole pump—they rely on the pressure of the wellbore as a motive force for fluids to pass through the gravity-based separation device while the separated gas is freely able via the buoyancy force of bubbles to rise back into the wellbore—because of this location they may be viewed as passive devices.

A multi-stage gravity-based gas separator is proposed in U.S. Pat. No. 11,131,180 with multiple stages arranged in parallel. In order to obtain contribution from the lower stages of the separator, a limited-entry port disposed on the inner housing may be located toward the bottom of each separation stage where the size of said port increases in lower stages (to offset the friction pressure drop for fluid flowing up the inner housing). One limitation of this approach is that these restrictions are at the suction end of the pump where these restrictions may result in gas breakout (or steam flashing in thermal operations), or other flow assurance challenges such as wax, asphaltene, or scale deposition. Another limitation of this approach is that limited entry ports will allow higher volume flow rates of an undesirable fluid (gas), compared to the desired fluid (liquid); therefore, stages which are not functioning effectively and are allowing gas entry may "overcontribute" leading to degraded overall performance. The present disclosure which uses an impeller toward the bottom of each gravity-based gas separation stage improves upon both of these limitations. Firstly, the impeller causes a pressure increase in the system (vs. a pressure drop in the prior art) and provides the pressure necessary to overcome the frictional pressure loss for liquid flow up the inside tubular which allows for approximately equal (approximately includes nominal deviations from equal) or greater contribution from the lower stages, and may allow for higher reliability avoiding flow assurance challenges, or increase the potential drawdown in the well to increase production. Second, impellers create more pressure when full of liquid compared to gas; therefore, any stages which are exposing the impeller to gas will contribute relatively less volume flow rate as compared to other stages of which the impellers are full of liquid. Impellers have an "autonomous" behavior that is favorable for causing entry of liquid at higher volumetric flow rates than gas when exposed to the same backpressure which may be a significant improvement relative to prior art passive restriction devices.

Gravity-based gas separation technology, in U.S. Pat. No. 10,408,035 has been used in ESPs. However, most downhole applications limit the diameter of device that may be installed which creates a relatively low limit on the volume flow rates for which efficient gas separation can be achieved with a single separation stage, and may also result in significant frictional pressure loss within the device which may be problematic at the suction end of the pump. The present disclosure which may use multiple gravity-based gas separation stages arranged in parallel with an impeller disposed between the inner flowpath and the gravity separation chamber may improve the gas separation efficiency and flow rate capacity of such device while also providing a pressure boost through the impeller to compensate for the frictional pressure losses, and frictional losses may be reduced because the velocity through each stage is lower.

As an alternative to gravity-based separators, vortex separators (which may also be known as active separators, rotary separators, or centrifugal separators) cause the fluid to spin at a high velocity to create a high centripetal acceleration (typically on the order of 10 to 1000 g's—units of gravitational acceleration) which causes gas to accumulate toward the axis of the device, regardless of the device's orientation like a centrifuge. Vortex gas separators typically require power input from a rotating shaft. Traditional vortex gas separators create a spinning or rotational flow of the downhole fluid within a relatively long vortex chamber to separate the phases of the downhole fluid—pushing liquid to the outside and collecting gas toward the inside and exhausting the gas through a crossover flowpath assembly.

Relative to gravity-based separators, a vortex separator of the same diameter, may allow higher gas separation efficiency, higher total fluid processing rates, and reduced length. A large cumulative length of separation chamber(s) may be advantageous in that it provides a "reserve volume" of liquid that may be drawn into the pump to avoid a gas lock event despite the occasional passage of "100% gas slugs" through the wellbore and past the pump intake device; such large slugs of gas may be more common for long highly deviated and horizontal wells; this may be effective with both vortex and gravity-based gas separators. In order to function effectively, vortex gas separators may be provided a substantially larger volume flow rate of fluid than the pump, since a substantial fraction of the fluid processed by the gas separator may be exhausted out of the gas separator.

In the present disclosure, an excess volume of fluid (which may be required for effective function of a gas separator) is provided through a high flow rate capacity intake system that may also function to preferentially intake liquids instead of gas from the wellbore. According to one or more embodiments of the present disclosure, a compact axial length gas separator stage of a pump system is provided, which may be more economical because less length is required, or improved gas separation efficiency may be achieved in the same relative space in the downhole pump. According to one or more embodiments of the present disclosure, the function of a gas separator of a pump system may be improved through the use of multiple stages in series to achieve more efficient and stable separation of gas out of the liquid which is provided to the main stages of the downhole rotary pump; multiple gas separator stages may be relatively more practical and economical when they are compact. According to one or more embodiments of the present disclosure, the function of a pump system may be improved by incorporating a high flow rate capacity intake system. For example, a high flow rate capacity intake system may be achieved by arranging impellers that are radially exposed to the wellbore through inlet holes. Multistage intake systems may be arranged in series or in parallel. For example, a high flow rate capacity intake system may be achieved by arranging multiple inlet holes over an extended length which may have impellers arranged in series between the axially spaced inlet holes; diffusers may accompany the impellers. According to one or more embodiments of the present disclosure, the function of a pump system may be improved by incorporating a multistage intake system to preferentially intake liquids instead of gas from the wellbore. For example, a high flow rate capacity intake system that autonomously avoid intake of gas may be achieved by arranging multiple intake stages in parallel or in series with each stage having an intake impeller. Intake stages arranged in parallel may have a crossover flowpath or may not require a crossover flowpath.

A multi-stage gas separator is proposed in U.S. Pat. No. 7,461,692 with multiple stages arranged in series within a housing wherein each stage of the gas separator is of a conventional and lengthy design. The length of each gas separation stage may be too long to practically (economically and technically) assemble a significant number of stages within a real-life downhole ESP assembly; the ratio of the length of each stage to the outer diameter of the housing (L:D Ratio) is greater than 5.0:1. A similar design proposed in U.S. Pat. Publication No. 2014/0216720 has an L:D Ratio greater than 4.2:1.

A high flow rate capacity gas separator is proposed in U.S. Pat. No. 11,131,155 and uses stationary helical vanes (termed an auger) to induce rotational flow in a vortex chamber while using a high flow fluid moving device to achieve a higher flow rate through the gas separator. The high flow fluid moving device is a series of impellers and diffusers similar to those used in an ESP or an ESP Gas Handler. The L:D ratio greater than 4.0:1. A highly effective commercial design is the Halliburton Summit Hydro-Helical Gas Separator that closely reflects the patented disclosure except that the L:D ratio in the real life version exceeds 7.7:1. Another similar design with fluid moving impeller and diffuser stages to move high fluid rates into the vortex chamber is proposed in U.S. Pat. Publication No. 2004/0045708; the primary difference being that this disclosure achieves rotating flow in the vortex chamber via rotating paddles (an impeller), with an L:D ratio greater than 7.9:1.

These designs are an improvement to increase the flow rate relative to prior art which typically incorporates only a single axial-flow impeller to provide fluid to the vortex chamber in disclosures such as U.S. Pat. No. 4,481,020. U.S. Pat. Publication No. 2020/0141223, U.S. Pat. Publication No. 2019/0162063, U.S. Pat. Publication No. 2019/0017518, U.S. Pat. Publication No. 2013/0039782, U.S. Pat. Publication No. 2009/0065202, U.S. Pat. Publication No. 2009/0272538, U.S. Pat. Nos. 4,981,175, 5,207,810, 6,260,619, 5,482,117, and 5,525,146, and U.S. Pat. Publication No. 2003/0196802.

A two-stage gas separator is proposed in U.S. Pat. No. 4,901,413 with stages arranged in series wherein each stage of the gas separator is of a conventional and lengthy design. A single housing is not employed and multiple couplers are required within the stages. The length of each gas separation stage is too long to practically (economically and technically) assemble a significant number of stages within a real-life downhole pump assembly; the L:D Ratio of each stage is greater than 4.8:1.

A multi-stage gas separator is proposed in U.S. Pat. No. 6,066,193 with stages arranged in series wherein each stage of the gas separator is of a conventional and lengthy design, and subsequent stages are tapered smaller to receive a lower volumetric flow rate of fluid. A single housing is not employed and couplers are required between the stages. The length of each gas separation stage may be too long to practically (economically and technically) assemble a significant number of stages within a real-life downhole pump assembly; the L:D Ratio of each stage is greater than 6.0:1.

A contemplated multi-stage intake compressor is proposed in Pat. Publication No. PCT/US2013/060649 with multiple tapered compression stages that may be used before a conventional vortex chamber gas separator: the L:D Ratio of each gas separation stage assembly is greater than 10:1.

A long vortex chamber with fluid moving elements below a conventional gas separator is proposed in U.S. Pat. No. 6,155,345, multiple vortex flow inducing elements are used: the L:D Ratio of a stage is greater than 9.3:1.

A multi-stage gas separator disposed below a shrouded motor is proposed in U.S. Pat. No. 5,173,022. Each gas separation stage is generally of a conventional design, and is crudely drawn with a length break in the vortex chamber implying that a long vortex section is required (to the extent that drawing the full length would interfere with the scale of the drawing). The design includes impractical flanged connections between each stage. Another impractical aspect of this design is that it requires the motor shaft to extend below the motor which demands an additional motor seal (which is costly and a reliability hazard).

A vortex gas separator directs liquid away from the entry to the gas crossover flowpath similar to a conventional gas separator using rotating paddles (termed flow divider or impeller) positioned in the vortex chamber in U.S. Pat. No. 2002/0178924. The impeller/paddles have an outer "rim", and in most embodiments the liquid primarily flows through an outer annulus that is not swept by vanes of the impeller. One embodiment has a large diameter vortex chamber where the entire body, including the outer rim are rotating, which presents a significant rotational momentum, balancing, and vibration hazard to operation of the gas separator. Multiple stages are not proposed; the L:D Ratio of the embodiments shown are greater than 4.1:1.

A gas separator that does not utilize centrifugal separation of liquid and gas phases claims the ability to segregate gas toward the outside diameter of a separation chamber, as is proposed in U.S. Pat. No. 4,231,767. Gas is kept segregated by means of a screen which the author claims will preferentially pass liquid through it. No crossover flowpath is required in this configuration.

Multiphase fluids may be best moved (for example pumped and compressed) by axial flow through the impeller (shaped as a propeller or auger), or combined axial and radial flow impeller shapes which are termed helicoaxial. These axial and helicoaxial impeller designs cannot build as much pressure per-stage, but typically benefit from the capacity to move large fluid volumetric flow rates at relatively low velocities relative to a primarily centrifugal (radially outward directed flowpath) impeller design. In the ESP industry, axial and primarily-axial flow devices are typically termed "Gas Handlers", "pre-charge stages", or "compression stages" due to their ability to move multiphase fluids, and are placed toward the bottom of an ESP pump section; their main functions are typically to homogenize the flow (reduce the size of bubbles and mix the gas more uniformly into the liquid) and to provide a higher pressure at the first main stage of the pump. Various impeller designs which borrow combinations of features from centrifugal pumps and gas turbine compressors are used in these designs. Inward scooped vanes on an axial-flow impeller are incorporated in U.S. Pat. Publication No. 2005/0186065 with multiple stages contemplated to provide fluid to a gas separator or the main stages of an ESP. An impeller with two sections in U.S. Pat. Publication No. 2015/0044027 has a first section of the impeller with axial flow through helical vanes and a second section of the same impeller with helicoaxial-flow (outward and in an uphole direction) through forward-swept vanes. An axial flow impeller with pure axial flow through helical vanes is proposed by U.S. Pat. Publication No. 2016/0177684. An impeller design where the helicoaxial-flowpath is "inverted" and actually expands inwardly toward the top to further reduce the potential for gas locking is proposed by U.S. Pat. Publication No. 2021/0301636.

Referring to FIG. 1A, a wellbore 1 may receive fluids through openings between wellbore and reservoir 3 (for example perforations or other lower completions assembly devices as is known in the art). Fluid flowing in wellbore toward a downhole pump 4 may flow past a downhole rotary motor 6 (which may be electric, hydraulic or other). While a downhole motor 6 is shown, rotation and power may also be provided to the pump of the present disclosure via sucker or continuous rods from a surface drive head. Fluids may be taken in from the wellbore to the downhole rotary pump 10, which may include intake and gas separation mechanisms of the present disclosure. Gas that bypasses the pump intake and any gas that may be exhausted from a gas separator assembly may flow to surface within the wellbore 1, typically in an annulus 5 formed between the wellbore 1 and the production tubing 2. Liquids within the pump have their pressure boosted sufficiently to overcome the hydrostatic head, friction pressure, and surface backpressure and flow up the production tubing 2 to a surface gathering or collection system for further processing and sale.

Figure 1B:
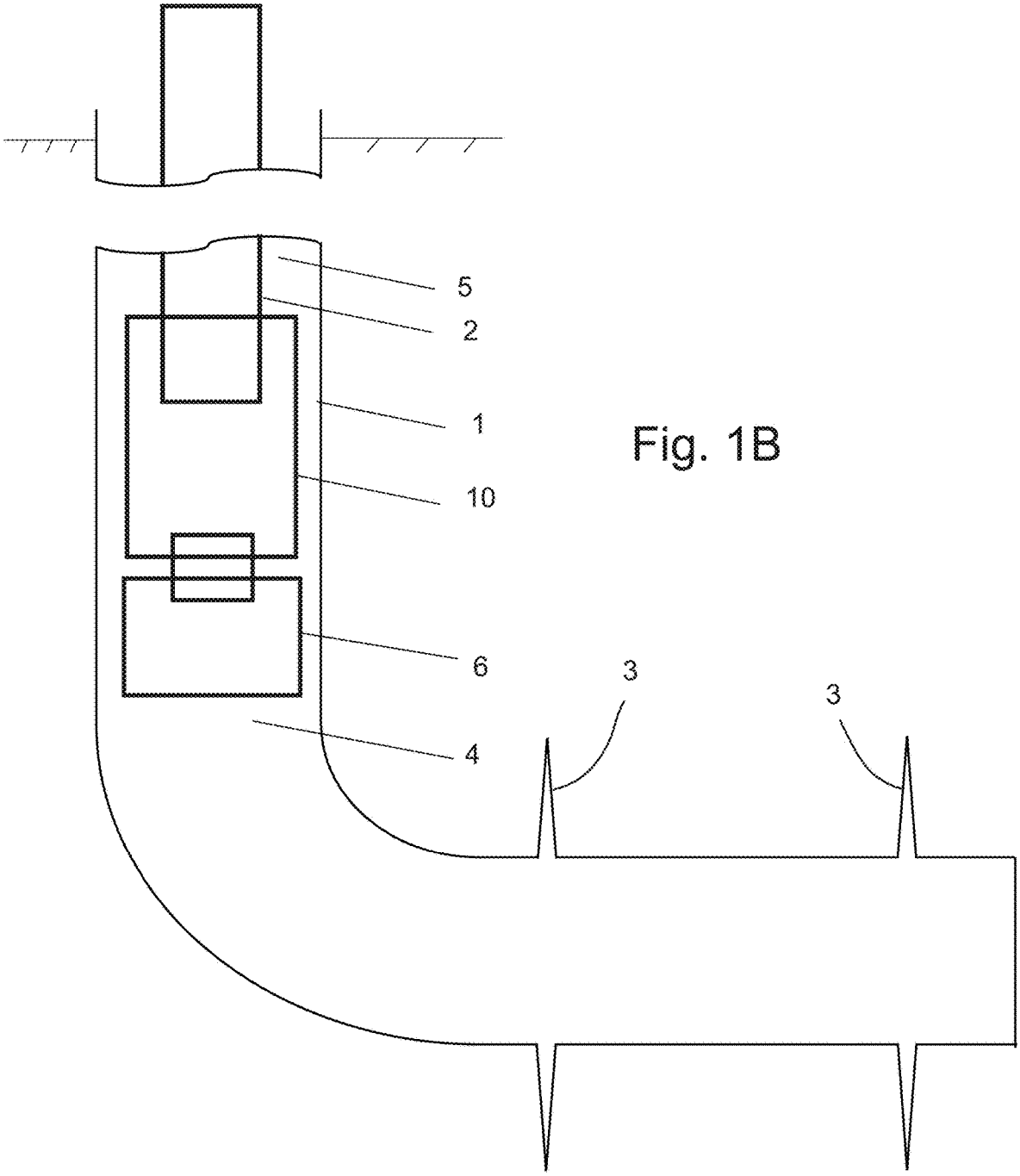
FIG. 1B is a side elevation view of a rotary pump disposed on the end of a production tubing string in a wellbore that penetrates an underground formation substantially horizontally, the pump being substantially vertical incorporating an intake and gas separation device.

Referring to FIG. 1B, a wellbore 1 may be vertical, deviated, or substantially horizontal. The rotary pump, including intake apparatus and any gas separation stages 10 may be located substantially above the perforations in a substantially vertical portion of the wellbore. Long and especially horizontal wellbores are known for producing unstable flow regimes in the fluid flowing in wellbore toward pump 4 which can challenge the effectiveness of existing intake and gas separation systems.

Figure 1C:
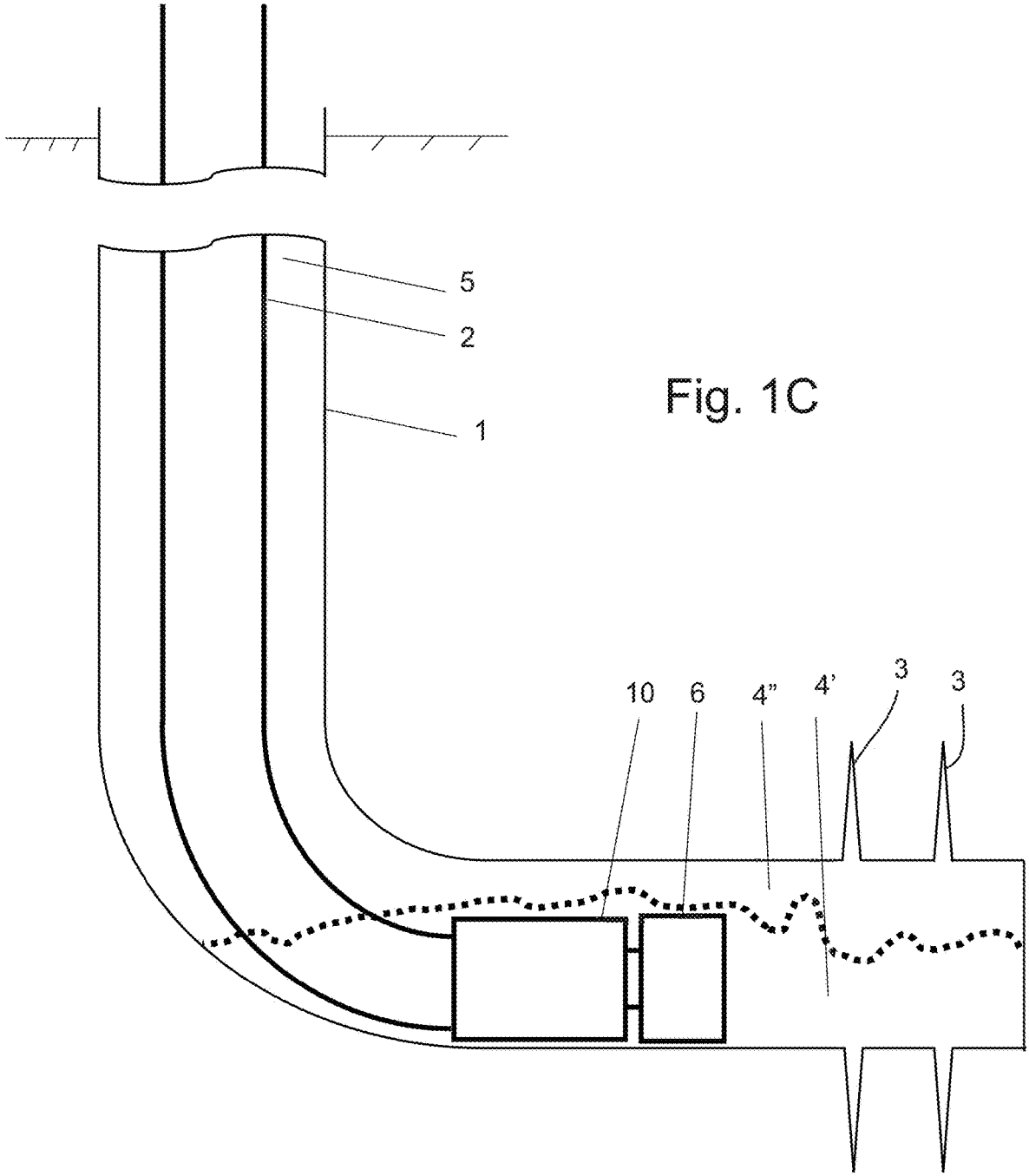
FIG. 1C is a side elevation view of a rotary pump disposed on the end of a production tubing string in a wellbore that penetrates an underground formation substantially horizontally, the pump being substantially horizontal incorporating an intake and gas separation device.

Referring to FIG. 1C, a wellbore 1 may be substantially horizontal, or otherwise highly deviated. In some cases, the rotary pump 10, including intake apparatus and any gas separation stages, may be located in a substantially horizontal portion of the wellbore. In this position the flow regime in the wellbore upstream of the pump may be substantially segregated. The primarily liquid phase of fluid in stratified or slugging flow in wellbore toward pump 4 may tend to accumulate on the low side of the wellbore 1. The primarily gas phase of fluid flow in wellbore toward pump 4" may tend to accumulate on the high side of the wellbore. While the pump 10 will naturally rest on the lowside of the wellbore 1 where it is ideally submerged in liquid, unstable flow and coning of gas which has a higher relative mobility (lower viscosity and density) may result in free gas entering the intake of the pump. Many horizontal gas avoiders have been proposed attempting to locate or preferentially open inlet holes that are oriented toward the low side of the pump. Examples include Pat. Publication Nos.: US20150204169A1, U.S. Pat. No. 5,588,486A, US20030079882A1, US2007051509A1, 20100065280A1, US20100096140A1, CN201953369U. Such assemblies may be unreliable, expensive to manufacture, and most significantly tend to restrict the flow of fluid entering the pump intake assembly. Such restriction at the intake may be especially problematic because it occurs at the lowest pressure location the entire wellbore and pump system and therefore results in gas breakout (or steam flashing in thermal operations), or other flow assurance challenges such as wax, asphaltene, or scale deposition. These prior art intakes with a shaft extending through them may appear to have large holes (typically in both the inner moveable housing and the outer housing), however, when configured in real life application in a wellbore there is always a restricted geometry somewhere in the fluid flowpath—this restriction may be formed between the outer housing holes and the wall of the wellbore, or through one set of holes, or in the alignment between the sets of holes, or in the annular space between the inner housing and outer housing. The intakes of the present disclosure may help avoid intake of gas into the pump because a large total flow area, such as with a ratio greater than 1 or 2 or 3 times the flow area inside the housing, may help to avoid gas breakout and flow assurance problems. The extended length of the inlet holes may draw down the fluid level in the wellbore more uniformly which helps to minimize gas coning because of the gas' higher relative mobility into the inlet holes. Impellers that are radially exposed to the wellbore through the inlet holes may also provide a beneficial autonomous behavior because stages exposed to liquid will pull the liquid at higher rates into the device compared to stages exposed to gas, compared to prior art designs where gas will preferentially flow into any holes where gas is present because of the lower viscosity and density of the gas.

Figure 2A:
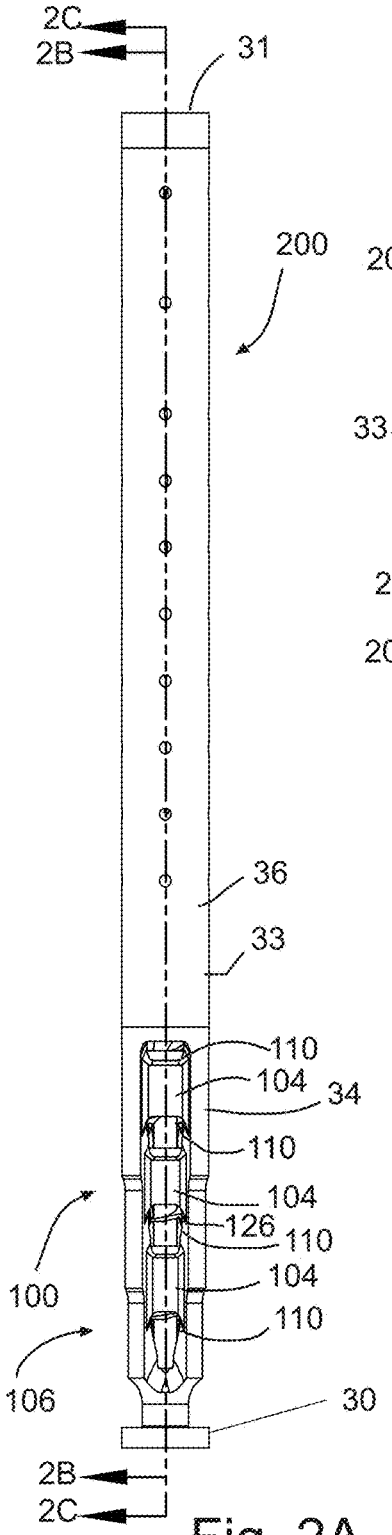
FIG. 2A is a side elevation view of an embodiment of an intake device with a multistage intake and multistage gas separator.
Figure 2B:
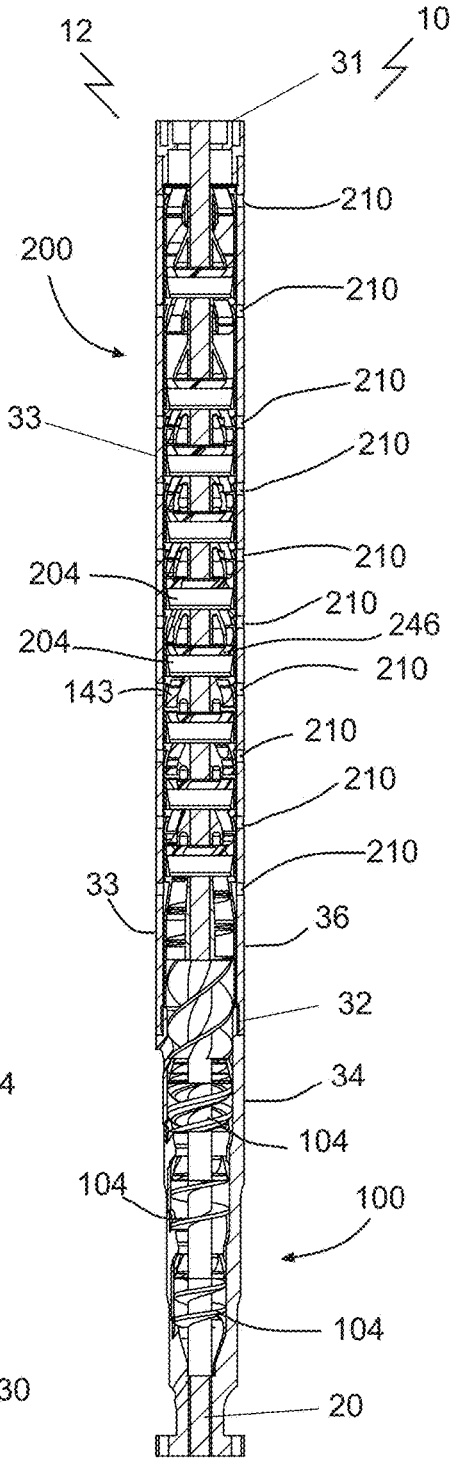
FIG. 2B is a view taken along the 2B-2B section lines in FIG. 2A wherein impellers are not cut by the cross section.
Figure 2C:
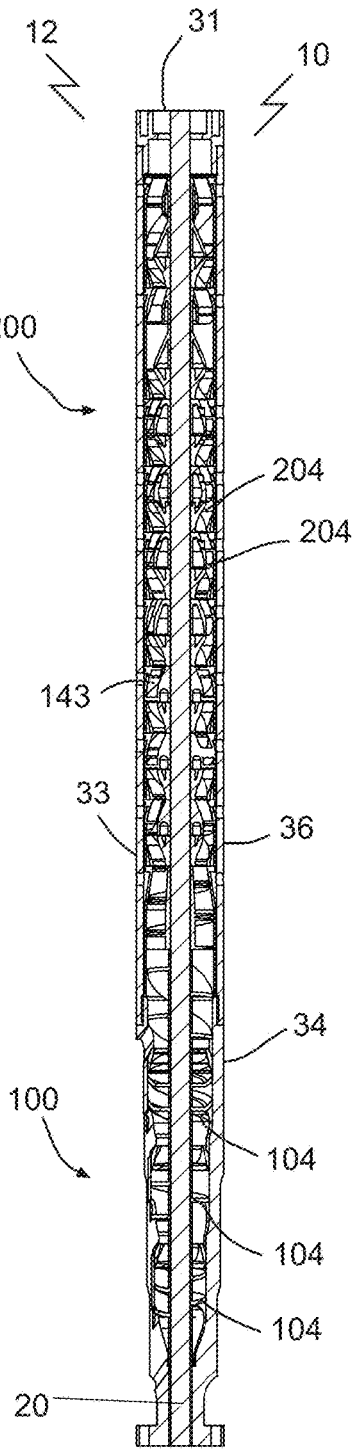
FIG. 2C is a view taken along the 2C-2C section lines in FIG. 2A wherein all components are cut by the cross section.

Referring to FIGS. 2A, 2B, and 2C an intake and gas separator device 12 of a downhole rotary pump 10 is shown.

The device 12, which may make up part of the pump 10 in use, may be formed with an intake 100 and a gas separator 200. Each intake 100 may comprise one or more intake stages 104. Each gas separator 200 may comprise one or more gas separator stages 204, such as with the compact axial length stages shown. Multiple configurations may be possible, and the configuration shown is not intended to be limiting. The device may have a coupler 30 to the motor (not shown) at a lower end of the device 12, although the device 12 may also be driven from a power source above. The power source in use may drive a rotary shaft 20, which may have a constant diameter and may be keyed to drive rotating components, referred to as impellers 120, 220, within the device 12. The intake and gas separator device 12 may comprise a housing 33. In this configuration a coupler 31, to main pump stages (not shown) in use above the device 12, is shown, although it may be practical and cheaper to forego this coupler 31, extend the length of the housing 33, and continue stacking the main stages of the rotary pump 10 directly above the gas separator stages 204. Gas separator stages 204 may be intermixed within the main stages (not shown) of the rotary pump 10. With the intake, fluid may be drawn into inlet holes 110, which may be disposed over an extended length of the pump housing 33. The inlet holes 110 may have a large total open flow area, for example greater than the flow area inside the housing 34, such as having a flow area to housing flow area ratio of 1, 2, 3, or higher. The flow area inside the intake housing 34 may be defined as the minimum cross-sectional area, along a fluid flowpath 143 defined within the intake housing 34, between the inner diameter of the intake housing 34 and the outer diameter of the shaft 20. The diameter of the intake section may increase toward a larger diameter in the uphole direction where the increasing diameter may correspond with the increasing flow rate inside and toward the top of the intake. A coupler 32 between the intake 100 and gas separator 200 may be provided. A coupler 32 may be practical and useful in an increasing diameter intake design or an intake with a flanged bottom coupler 30 because in such designs, the intake may be made of heavy wall tube or solid bar and the main housing 33 body made of material sourced with a thinner wall. Gas exhaust holes 210 may penetrate the main housing 33 corresponding with the axial position of gas separator stages 204.

Figures 3A, 3B, 3C:
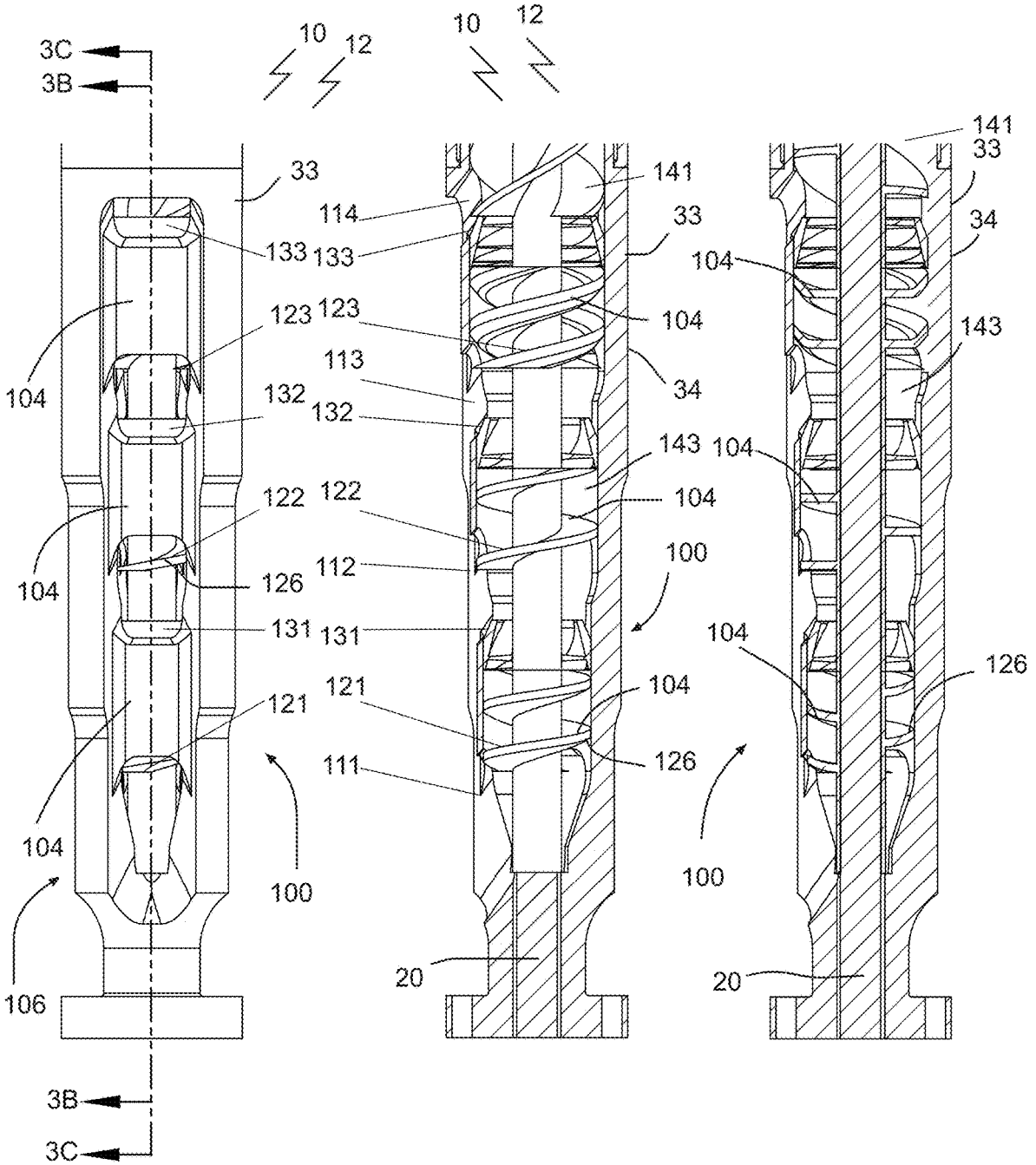
FIG. 3A is a side elevation view of an embodiment of a multistage intake device wherein the fluid pathway from the intake stages is radially exposed to inlet holes of subsequent stages.
FIG. 3B is a view taken along the 3B-3B section lines in FIG. 3A wherein impellers are not cut by the cross section.
FIG. 3C is a view taken along the 3C-3C section lines in FIG. 3A wherein all components are cut by the cross section.
Figures 3D, 3E, 3F:
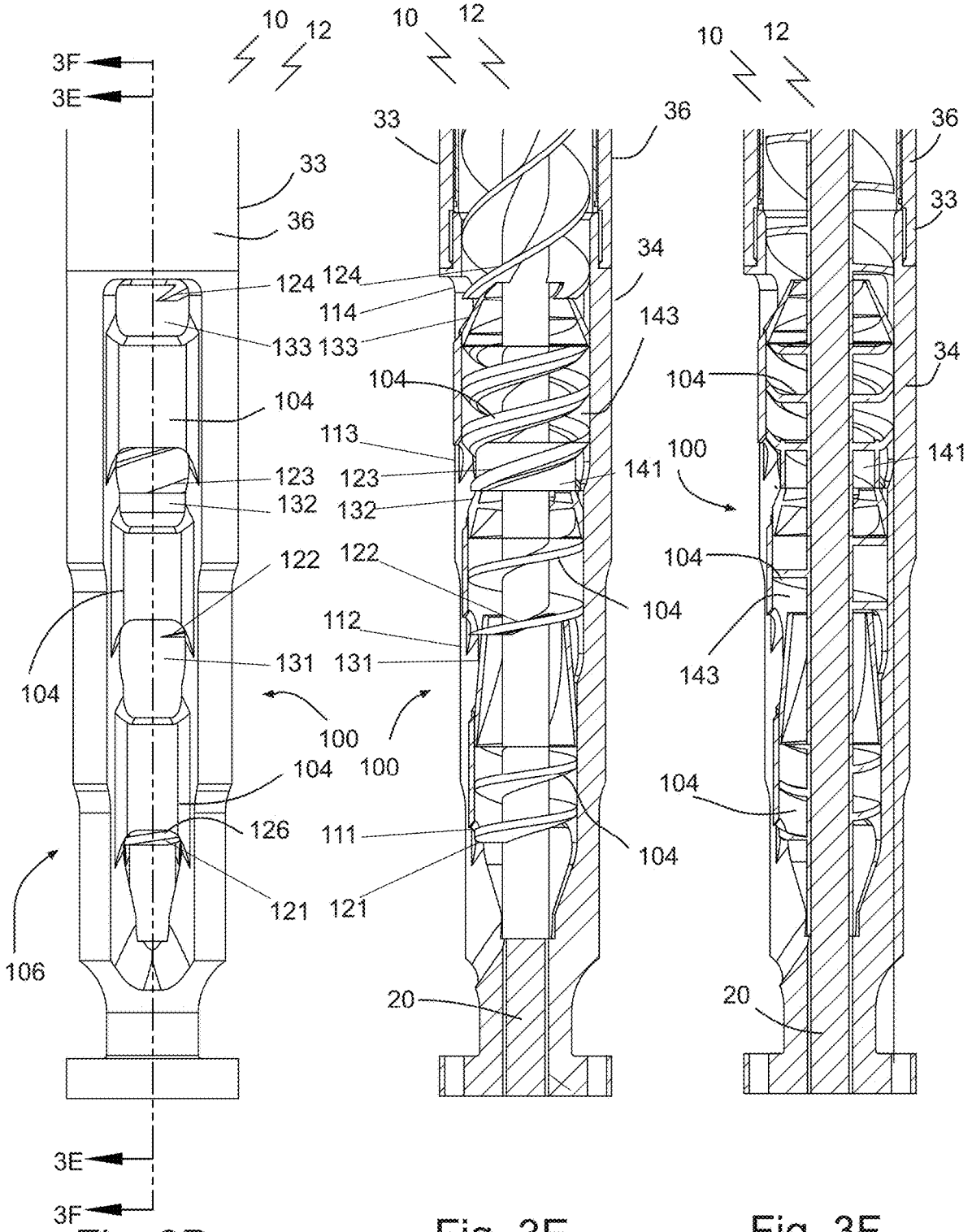
FIG. 3D is a side elevation view of an embodiment of a multistage intake device wherein the fluid pathway from the intake stages is radially exposed to inlet holes of subsequent stages.
FIG. 3E is a view taken along the 3E-3E section lines in FIG. 3D wherein the impellers are not cut by the cross section.
FIG. 3F is a view taken along the 3F-3F section lines in FIG. 3D wherein all components are cut by the cross section.

Referring to FIGS. 3A, 3B, and 3C, an intake device 100 is shown of the same configuration as FIGS. 2A, 2B, and 2C. The intake device 100 may comprise a plurality of intake stages 104. The rotary pump 10 may comprise an intake device 100 with the intake device 100 comprising two or more of the intake stages 104. The intake stage 104 for a downhole rotary pump 10 may comprise an intake housing 34 defining a fluid flowpath 141 and an inlet hole 110 to the fluid flowpath 141. The intake housings of each intake stage 104 may be independent or may form an integral housing 34 as shown. Similarly, housings 38 of a plurality of downstream gas separator 200 or pump stages, of the downhole rotary pump 10, may be independent or may form an integral pump housing, or may be contained within an integral pump housing 36. The intake device 100 may comprise two, three or more intake stages 104. Inlet holes 111 of the first stage may permit fluid to enter the device, and may actively draw in fluid by the intake impeller 121 of the first stage, before passing through the diffuser 131 of the first stage. The inlet holes 111 of the first stage may be relatively long. The diameter of the device at the first inlet stage may be relatively the smallest on both the ID and OD in the first stage corresponding with the flow rate being the lowest through the first stage. The flow rate outside the device in the wellbore may be the highest at the first stage and providing a smaller OD on the intake housing 34 at the first stage of the intake may be beneficial because it reduces the velocity of the flow in the wellbore.

Referring to FIGS. 3A-3F, each or some of the intake stages 104 for the downhole rotary pump 10 may comprise an impeller 120 with suitable characteristics, such as impellers 121, 122, 123, and 124 of the first, second, third and fourth stages, respectively. An intake impeller 120, such as impeller 121 of the first stage, may be radially exposed to the wellbore 1 through the first stage inlet holes 111 which helps to draw in more fluid with minimal pressure drop. For example, the inlet hole 110 of the intake stage 104 may be configured to expose at least a portion, such as a base end as shown, of an impeller vane 126 of the impeller 120 to an exterior of the downhole rotary pump 10. The inlet hole 110, such as holes 111, may be oriented to expose, along a radial line of sight, at least a portion of the impeller vane 126. Impellers may be more effective at moving liquid because liquid has a higher density than gas, and thus each intake impeller may autonomously preferentially intake liquid more effectively than gas, thus functioning as a gas avoider. In this embodiment four intake impellers 121, 122, 123, and 124 are arranged in series and the autonomous behavior of each impeller may be beneficial because the impellers which are exposed to lower density gas-rich fluids at any particular time during transient flow events when slugs of liquid or gas are passing the pump will contribute less volumetric flow rate compared to those impellers which are exposed to higher density liquid-rich fluids.

Referring to FIGS. 3A-3C, the inlet holes 110 may have suitable characteristics. The inlet hole 110 may form an inlet conduit which may be angled to direct fluid to at least partially align with an uphole direction of fluid flow in the fluid flowpath 141, for example by using conduit base wall surfaces 110A that are sloped with increasing height toward a center axis of the intake. The rotary pump 10 may comprise plural inlet holes 110. Gas avoidance may be achieved with multiple inlet holes over a length and with a large total open flow area into the inlet holes. In the embodiment shown the total flow area through the inlet holes may be approximately 58 sqin (sqin=square inches), and the flow area between the shaft 20 OD and the housing 34 ID may be approximately 15 sqin giving a ratio of the flow area through the inlet holes to the flow area inside the housing 34 of approximately 4.

Referring to FIGS. 3A-3F, the rotary pump 10 may comprise a diffuser 131 downstream of the impeller 120. The diffusers, such as diffusers 131, 132, and 133 of the first, second, and third stages in the example, may be located between impellers 120 of adjacent intake stages 104. Rotating the impeller 120 may allow the intake fluid through the fluid inlet holes 110 into the fluid flowpath 141. From the first intake impeller 121, fluid passes through the first diffuser 131 which may act to straighten the flow and deflect it inward. This redirection of flow may be important in this configuration because the liquid flow after passing an impeller may have a substantially outward velocity vector, and the fluid from the first stage after passing through the diffuser 131 of the first stage may be radially exposed to the inlet holes 112 of the second stage 121. This flow from the first stage may have been accelerated which drops its static pressure, serving as an eductor, and may help entrain more fluid in through the second stage inlet holes 112. Referring to FIGS. 3A-C, similar to the first stage, the second stage impeller 122 may be exposed to the inlet holes 112 of the second stage providing autonomous preference for intake of liquid and minimize intake pressure drop. The same principles may continue through the third and fourth stage inlet holes, 113 and 114, respectively, intake impellers, and diffusers. Notable variations in subsequent stages may include differences in the inlet hole size which have a smaller size toward the top—this may be done in order to minimize the potential for undesired liquid ejection out of the inlet holes. An outer diameter of the downhole rotary pump 10 at the inlet hole 110 of a subsequent intake stage 104 may be increased relative to the preceding intake stage. Intake impeller designs may vary in their diameter (typically increasing in subsequent stages), the number of vanes (typically increasing in subsequent stages), the lead (typically increasing in subsequent stages), and vane profile to handle correspondingly higher flowrates in subsequent stages. The diffusers may be radially exposed to the exterior of the device.

Referring to FIGS. 3A-F, the impeller vane 126 may be angled or cupped, for example radially inward at a radial end of the impeller vane 126. Cupping may minimize radial velocity of the liquid and help push the liquid toward a center axis of the intake housing 34. Examples of different vane 126 profiles are visible in FIG. 3C with the first stage intake impeller 121 having a single vane 126 with an uphole cupped profile. In the example of FIG. 3C the second stage intake impeller 122 has a single vane 126 with a higher lead and diameter and a flat profile, while the third stage intake impeller 123 has two vanes 126 with a profile that curves uphole aggressively toward the tip, and the fourth stage intake impeller 124 has three vanes 126 with the largest diameter and lead and with a downhole cupped profile. A downhole cupped profile may be used. A downhole cupped profile may be advantageous for an impeller disposed below or in a gas separation stage because a downhole cup profile may serve to preferentially urge the liquid phase toward the outside. If the inner diameter of a multistage intake with stages arranged in series such as FIG. 2A increases in diameter as shown moving in an uphole direction, the diffusers may be supported axially on a shoulder where the diameter changes (not shown).

Referring to FIGS. 3G, 3H, 3I, 4A, 4B, and 4C, an inlet section 106 of the intake stage 104 may be structured for efficient intake of fluids. The inlet section 106, for example the inlet holes 110 may be elongated, for example longer in a maximum axial direction than a maximum circumferential dimension. The inlet holes 110 may have a ratio of the cumulative open flow area through the inlet holes 110 to the flow area inside the intake housing, greater than 1, in some cases greater than 2. Increasing the ratio of the cumulative open flow area may be achieved through elongating the inlet holes 110 in an axial direction. Alternatively, the ratio of the cumulative open flow area may be achieved through the use of multiple rows of inlet holes (not shown). The inlet section 106 may be defined by inlet holes 110 which may be elongate in an axial direction. The inlet section 106 may have a cumulative axial length of greater than 11.8". Some benefits of an elongate inlet may include—to minimize entrainment of gas from the wellbore, and to reduce the pressure drop within the intake.

Figures 3G, 3H, 3I:
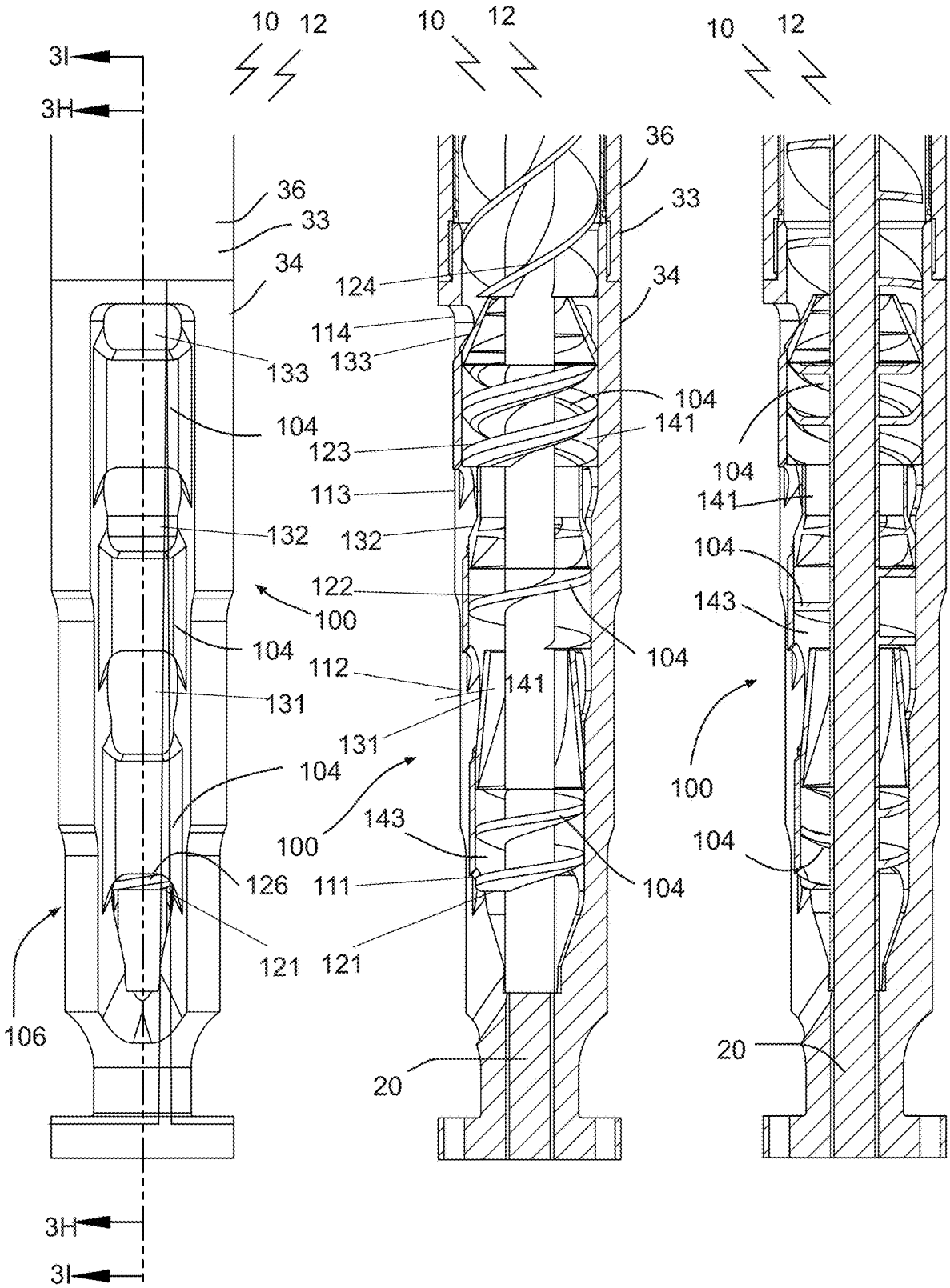
FIG. 3G is a side elevation view of an embodiment of a multistage intake device wherein the fluid pathway is not radially exposed to inlet holes of the second, third, and fourth stages and the impellers of such stages are also not radially exposed to inlet holes.
FIG. 3H is a view taken along the 3H-3H section lines in FIG. 3G wherein impellers are not cut by the cross section.
FIG. 3I is a view taken along the 3I-3I section lines in FIG. 3G wherein all components are cut by the cross section.

Referring to FIGS. 3G, 3H, and 3I, a similar intake device 100 (as in FIGS. 3A-C) is shown except with some impellers radially exposed and some not. In the example shown the impellers 120 above the first stage may not be radially exposed to the wellbore 1 through the inlet holes 110. Without the impellers 120 being radially exposed to the wellbore 1 through the inlet holes 110, this embodiment may not benefit from the autonomous liquid-ingesting preference of an exposed impeller 120. The other benefits as described for FIGS. 3A, 3B, and 3C may still be achieved with this embodiment.

Figures 4A, 4B, 4C:
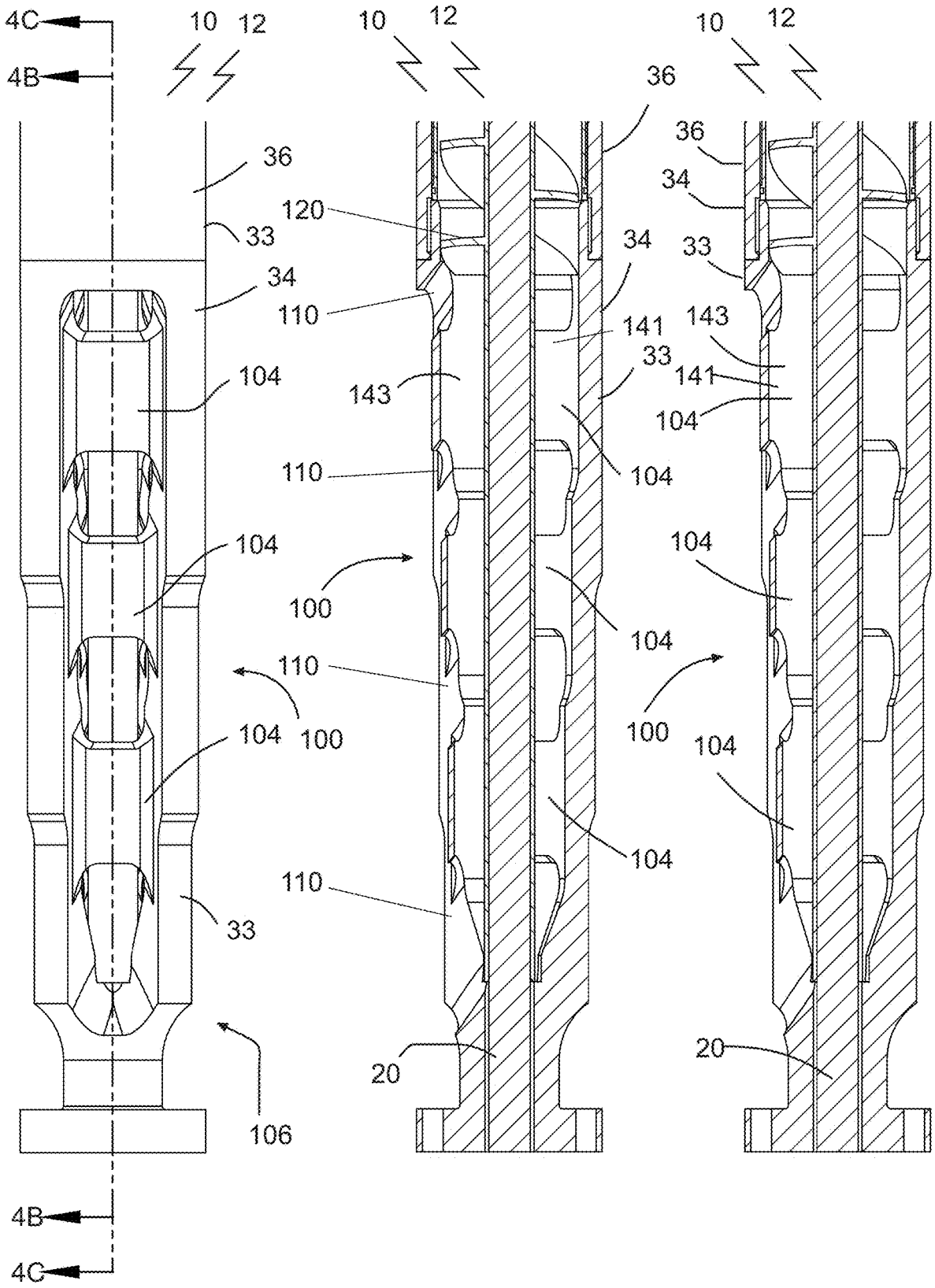
FIG. 4A is a side elevation view of an embodiment of a multi stage intake device with an elongated inlet section and a single impeller.
FIG. 4B is a view taken along the 4B-4B section lines in FIG. 4A wherein impellers are not cut by the cross section.
FIG. 4C is a view taken along the 4C-4C section lines in FIG. 4A wherein all components are cut by the cross section.

Referring to FIGS. 4A, 4B, and 4C, these illustrate an embodiment of an extended length intake without impellers 120 disposed between any of the inlet holes 110. The first intake impeller 120 may be located above the inlet holes 110. Compared to a conventional intake hole design, this design may offer an improvement in the ability to avoid entraining gas in the intake flow because of the long length and large inlet holes 110 with a total open flow area greater than the flow area inside the intake housing 34, and this design may offer minimal intake pressure loss by means of large and well guided inlet holes 110.

Figures 5A, 5B, 5C:
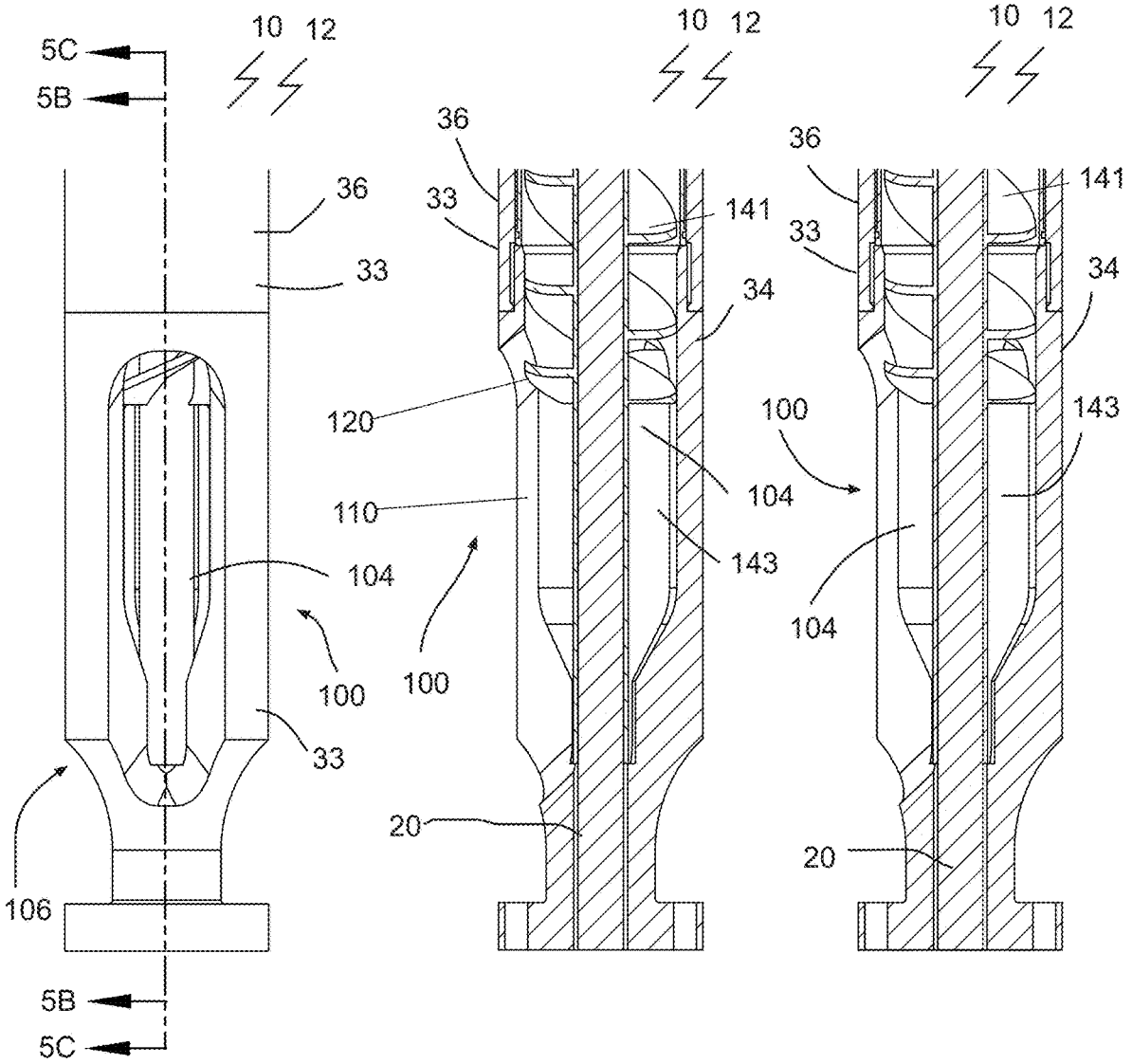
FIG. 5A is a side elevation view of an embodiment of a single stage intake device with an elongated inlet section and an impeller radially exposed to the wellbore.
FIG. 5B is a view taken along the 5B-5B section lines in FIG. 5A wherein impellers are not cut by the cross section.
FIG. 5C is a view taken along the 5C-5C section lines in FIG. 5A wherein all components are cut by the cross section.

Referring to FIGS. 5A, 5B, and 5C, a further simplified embodiment of an extended length intake without multiple stages 104 of inlet holes 110 nor a telescoping body is shown. Similar benefits and function as the embodiment shown in FIGS. 4A, 4B, and 4C.

Figures 6A, 6B, 6C:
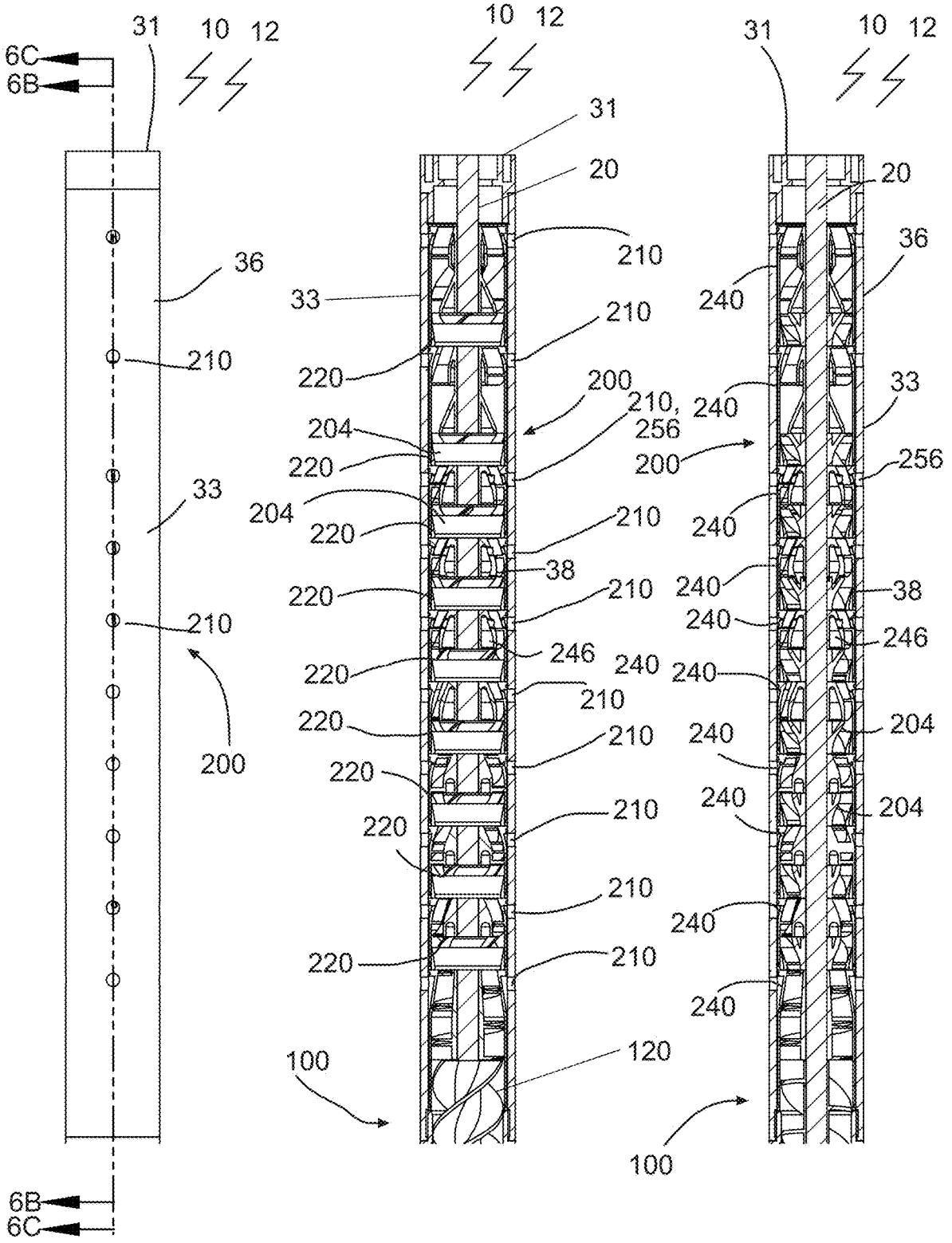
FIG. 6A is a side elevation view of an embodiment of a multistage gas separator.
FIG. 6B is a view taken along the 6B-6B section lines in FIG. 6A wherein impellers are not cut by the cross section.
FIG. 6C is a view taken along the 6C-6C section lines in FIG. 6A wherein all components are cut by the cross section.

Referring to FIGS. 6A, 6B, 6C, a multistage gas separator 200 is shown. The example comprises plural compact axial length separator stages 204. For illustrative purposes each stage 204 may be unique and the benefits of various stage design features and embodiments will be expounded further in other figures. Each stage 204 may comprise a diffuser 240. In some cases, each stage 204 comprises an impeller 220. Each stage 204 may comprise a housing 36. The separator 200 housing within which a fluid flowpath is defined. Each diffuser 240 may define a gas crossover flowpath between a gas entry point and a gas outlet, to exhaust some gas from fluids passing through the diffuser. In the example shown gas is exhausted through a plurality of hollow vanes 256 and through gas exhaust holes 210 in the main housing 33 body. However, gas exhaust is not a critical element as some purely fluid-moving diffuser stages (without gas crossovers or gas exhaust holes) may be interspersed with the gas separating stages 204 without detracting from the essence of the present invention. A diffuser may also be assembled in a manner such that a main housing 33 is not required and the diffuser 240 of each stage 204 may couple directly to the adjacent diffuser 240. Below the gas separator 200 there may be an intake device 100, preferably one that avoids ingesting gas and provides a sufficient volume flow rate of fluid that a substantial volume of gas can be exhausted through the gas separator device 200 while providing enough fluid for the main stages of the pump 10; intake embodiments of other figures in the present disclosure may avoid ingesting gas and provides a sufficient volume flow rate of fluid. At least one intake impeller 120 is disposed below the first diffuser 240. Each impeller 220 stage may be sized for smaller flow rates from the impeller 220 of the gas separator stage 204 below it corresponding with the amount of gas that is expected to be exhausted by that stage which translates into a lower total volumetric flow rate through each subsequent gas separator stage 204; however, there may be a practical limit to that approach and multiple impellers 220 of the same design may be used in subsequent stages for practical design and inventory management reasons. A downstream stage of the compact axial length gas separator stages 204 may be designed for lower total volumetric flow rates than an upstream stage of the compact axial length gas separator stages 204. A downstream stage of the compact axial length gas separator stages 204 may have a greater restriction to gas flow in the gas crossover flowpath than an upstream stage of the compact axial length gas separator stages 204. As an illustrative example, these figures show that the lowest 3 impellers 220 may have a larger cross sectional flowpath and a more axially oriented flowpath with less direction change in the outward radial direction compared with the impellers 220 above. Furthermore, the impellers 220 of higher stages may have more vanes 222 and a lower lead (or higher backsweep) corresponding with the reduced flow rates in subsequent gas separation stages 204. Gas exhaust passageways may be restricted in order to allow for net positive pressure generation throughout subsequent stages. A net positive pressure may be generated as fluid passes each stage of the of the compact axial length gas separator stages 204. The restrictions in gas exhaust passageways may be restricted with smaller cross-sectional areas in subsequent stages 204 corresponding with increasing positive pressure generation through subsequent stages 204. Each gas separator stage 204 may be compact in axial length—for reference, the L:D ratios (L is the height of the stage 204 shown, D is defined by the outer diameter of the main housing, in this case housing 36) of stages illustrated in this embodiment range from 2.08 at the first stage, 0.76 for the middle stages, and 1.27 for the uppermost two stages. In some cases, an axial length of the compact axial length gas separator stage 204 is four or less times an outer diameter of the housing, for example three times or two times or less. This embodiment is illustrated with a coupler between the housing 33 to the main pump stages 31; however, this coupler is not a technical necessity and a longer main housing 33 body may be used which would allow the main pump stages to be stacked directly on top of gas separator stages 204 within the same housing 33. One or more gas separator stages 204 may be used depending on the performance requirement and severity of the application. More gas separator stages 204 would provide a higher level of gas separation and more reliable gas separation, but the short gas separator stages 204 of the present disclosure can be built into the same housing 33 as the ESP and it becomes it economical to include in almost any application, even those that conventionally would not justify the cost or length penalties of a conventional gas separator. The intake and/or separator may form part of a downhole rotary pump, for example comprising two or more compact axial length gas separator stages 206, and/or two or more intakes. An outer housing 33 may be present, within which are stacked the housings of each compact axial length gas separator stage 204. The outer housing 33 and a pump housing of downstream pump stages of the downhole rotary pump may form an integral housing. In use the downhole rotary pump may be operated by rotating an impeller to drive fluid through the fluid flowpath and separate gas, from the fluid, into the gas crossover pathway.

Figure 7A:
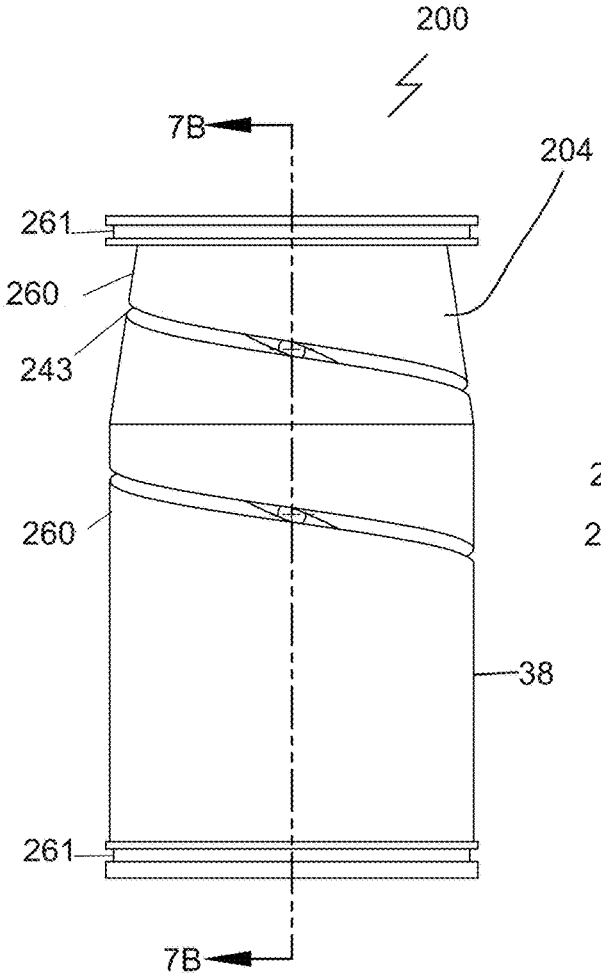
FIG. 7A is a side elevation view of an embodiment of a multistage gas separator diffuser stage wherein the diffuser has hollow vanes and the direction of gas entry to the gas crossover flowpath is radial and inward.
Figure 7B:
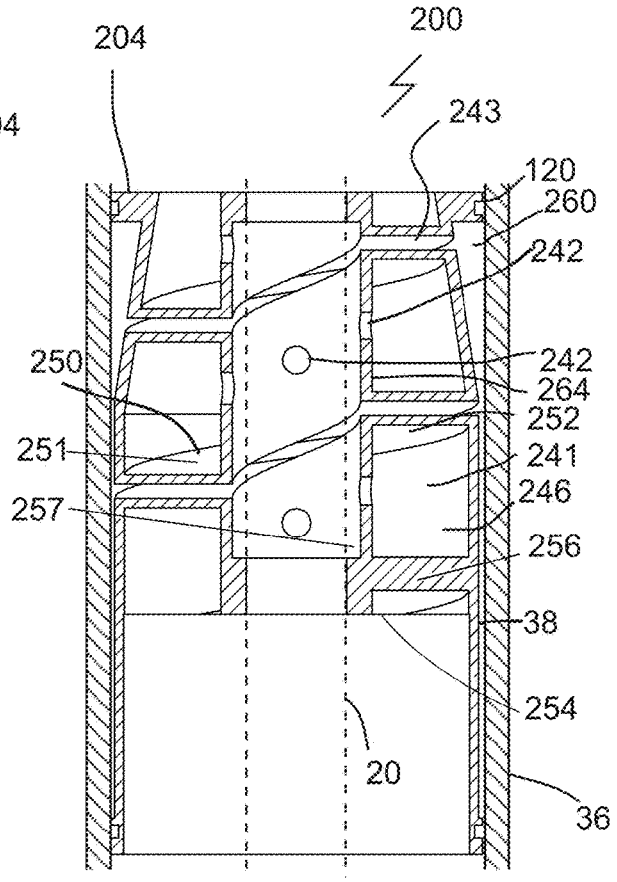
FIG. 7B is a view taken along the 7B-7B section lines in FIG. 7A, with the position of an outer housing of the separator shown, and dashed lines used to denote the location of the central shaft.

Referring to FIG. 7A, 7B, a diffuser of gas separator stage 204 is shown. The diffuser may have an L:D ratio of 2.08. The diffuser may have one or more hollow vanes 256 within which the gas crossover flowpath is at least partially defined. This diffuser design may not straighten the flow but has one hollow vane 256 with a consistent lead. The helix guides the flow through approximately two revolutions through a fluid flowpath 241 between the hollow vane's leading edge 251 and trailing edge 252. An impeller of the same stage (or an intake impeller) is disposed inside the lower cavity of the diffuser, below the diffuser vane bottom edge 254. An axial outer surface, such as an exterior of diffuser/impeller stage housing 38, may define, for example with outer separator housing 33, a plenum or space, such as an annular plenum 260. Plenum 260 may be radially outward of the one or more hollow vanes 256. The housing 38 may be structured to receive gas into the inner annular plenum 260 in a direction that is in a radially outward direction, for example via gas exhaust exit points 243. The outer annular space or plenum 260 may be defined between the diffuser and the housing. The outer annular space may be structured to have sufficient volume to allow residence time for gas bubbles to coalesce before being exhausted out of a gas outlet hole 210 (FIG. 6A). For example, the outer annular space may have a volume that is greater than the cumulative volume within the upstream crossover flowpath (which may be the volume of a hollow vane plus an inner annular space, if present). Additionally, the holes 210 in the housing 33 may have a cross-sectional area that is greater than twice the smallest cross-sectional area in the gas crossover flowpath that restricts flow through the gas crossover flowpath, which may cause the velocity of the gas being exhausted into the wellbore to be relatively low. It may be desirable for the gas exhaust to be in the form of large bubbles with a low velocity in order to minimize the formation of foam in the wellbore. The outer annular space may be structured to allow for misalignment between hollow vanes 256 of the diffuser and holes 210 in the housing 33. In the example shown one or more of the hollow vanes 256 define an internal helical gas plenum that defines the gas crossover flowpath, and in this case the exit point 243. A recessed OD on the diffuser housing 38 may provide an outer annular space or "plenum 260" between the housing 33 and the diffuser; the exit point of exhausted gas from the hollow vane 243 (which in this embodiment is a helical slot through the hollow vane of the diffuser) allows exhausted gas to flow to the holes in the housing 33 which need not be rotationally or axially aligned with the diffuser's exit point of exhausted gas from the hollow vane 243. This outer annular space/plenum 260 may have sufficient volume to allow residence time for gas bubbles to coalesce before being exhausted into the annulus to minimize foaming in the annulus. Foaming in the annulus may be undesirable because a gas avoiding and gas separating downhole pump requires efficient slippage of the gas past any liquid in the wellbore adjacent to and above the pump. Foam significantly increases the viscosity of the gas and reduce its mobility and to slip past any liquid level in the wellbore beside and above the pump. The gas exhaust crossover flowpath junction 242 in this embodiment is radially inward to a recessed ID on diffuser 257 which provides an inner annular space between diffuser (inner surface 264 and shaft 20 large enough to permit gas exhaust flow from the gas exhaust crossover flowpath junction holes 242 and subsequently out through exit point of exhausted gas from the hollow vane 243. A benefit of orienting the direction of gas entry at the crossover flowpath junction in a radially inward direction is that it is a direction that is averse to the flow of liquids; liquids have a significantly higher density than gas and therefore a higher momentum in a direction contrary to the gas exhaust entry port; gas has a lower density and therefore has a higher propensity to "make the turn" and enter the gas exhaust flowpath. The gas exhaust entry points (the crossover flowpath junction) are shown as circular holes for simplicity, but may be any manner of penetration and may be located anywhere on the surface shown as to enhance the gas separation effectiveness. O-ring grooves 261 are provided on the diffuser for multiple purposes; to support the diffuser in a resilient manner within a housing 33 that may not be precisely the same inner diameter through its length; to dampen vibration: and to isolate the plenum 260 from the pressure inside the gas separator device and prevent undesirable leakage of liquids out of the exhaust holes from other pathways. The O-rings themselves are not shown in any of the attached figures for the sake of simplicity. Typically shaft support bushings, impeller thrust bushings, impeller seal skirts, and other features as are known in the art are also included in diffuser designs; for the sake of clarity these details are not shown throughout this disclosure.

Figure 8A:
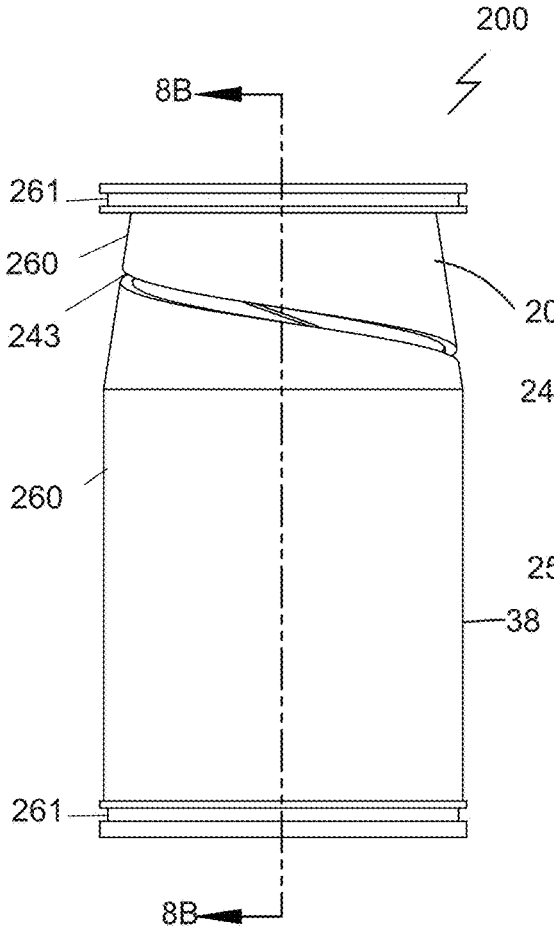
FIG. 8A is a side elevation view of an embodiment of a multistage gas separator diffuser stage wherein the diffuser has hollow vanes and the direction of gas entry to the gas crossover flowpath is radial and outward.
Figure 8B:
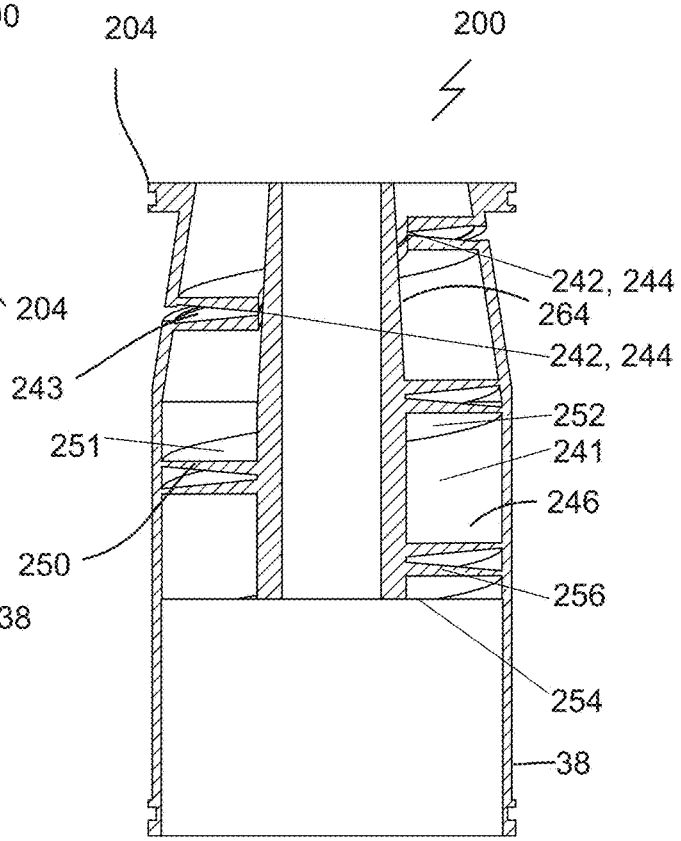
FIG. 8B is a view taken along the 8B-8B section lines in FIG. 8A.

Referring to FIG. 8A, 8B, a diffuser of gas separator stage 204 is shown with various characteristics. The diffuser may have a L:D ratio of 2.08. The gas entry point (crossover flowpath junction 242) may be directly into the one or more hollow vanes as shown. The gas entry point may be located toward or at, one or more of a radially inside edge of the one or more hollow vanes; and an axial inside surface, such as diffuser inner surface 264 that is radially inward of the one or more hollow vanes 250. The axial inside surface may have a suitable shape, for example may have one or more of a cylindrical, conical, or toroidal profile. This diffuser shown has a similar design in many aspects to FIGS. 7A, 7B with the notable differences being that the gas exhaust crossover flowpath junction 242 in this embodiment is radially outward and directly into the hollow vane 256. The smallest cross-sectional area in the gas crossover flowpath that restricts flow through the gas crossover flowpath may be at the gas entry point. The hollow vane in this embodiment is keystone shaped and the smallest cross-sectional area in the gas exhaust flowpath 244 may be at the junction 242 between the gas and liquid flowpaths. A benefit of locating the smallest cross-sectional area in the gas exhaust flowpath 244 at the junction is that liquids having a higher density and viscosity will have a lower propensity to enter the gas exhaust flowpath than gasses. This may be an improvement upon conventional gas separator designs which may have a substantial volume that may collect within the gas exhaust flowpath that is upstream of a restriction, and such volume may inadvertently become filled with liquid due to intermittent flow conditions and results in the liquid being undesirably exhausted and even worse, the liquid gets exhausted slowly which prevents exhaust of gas because it is blocked by liquid. Restrictions in conventional gas separator designs may either be within the crossover flowpath (machined ports or hollow vanes) or at the exit of the gas exhaust flowpath into the wellbore (which also carries a risk of foaming in the annulus). A minimum width of the gas crossover flowpath at the gas entry point such as junction 242 may be less than 0.03 times an outside diameter of the housing 38, for example between 0.0003 and 0.03 times, or in some cases, between 0.00003 and 0.01 times, the outside diameter of the housing 38. A minimum width of the gas crossover flowpath at the gas entry point may be less than 0.16", for example between 0.16" and 0.0016". The minimum width of the gas crossover flowpath at the gas entry point may be between 0.05" and 0.0016". The diffuser designs of FIGS. 7A, 7B, 8A, 8B do not substantially straighten the flow and may be better optimized for placement lower in a gas separator where it is desirable to allow very high flow rates and provide very little resistance to fluid flow before arriving at the next impeller. The fluid flowpath between diffuser vanes 241 has a cross sectional area that is shown to decrease in this illustrative embodiment where the outer surface tapers inward toward the top (at a higher angle than the inner surface tapers inward) to guide fluid into an impeller with a helicoaxial design of the subsequent stage, this cross-sectional decrease is not a necessary feature.

Figure 9A:
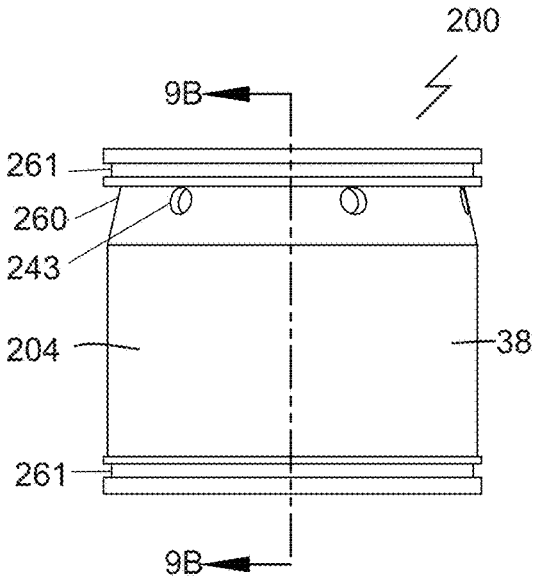
FIG. 9A is a side elevation view of an embodiment of a gas separator diffuser stage wherein gas enters the hollow vanes at the inside of the top edge and trailing edge of a helical vane of the diffuser.
Figure 9B:
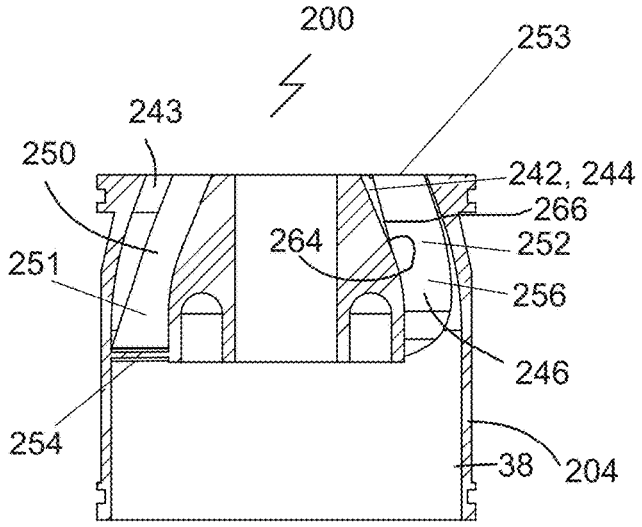
FIG. 9B is a view taken along the 9B-9B section lines in FIG. 9A.
Figure 9C:
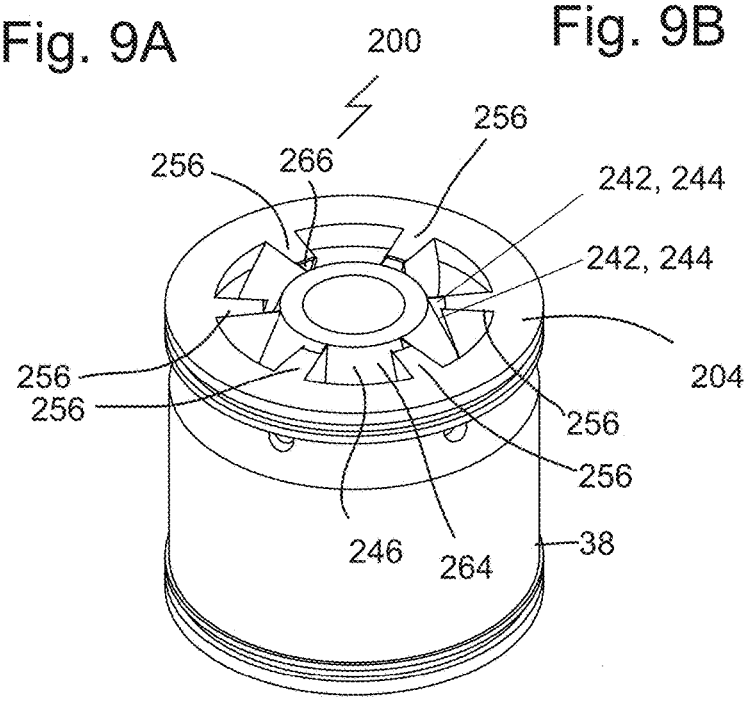
FIG. 9C is a perspective view of the gas separator diffuser stage of FIG. 9A.
Figure 9D:
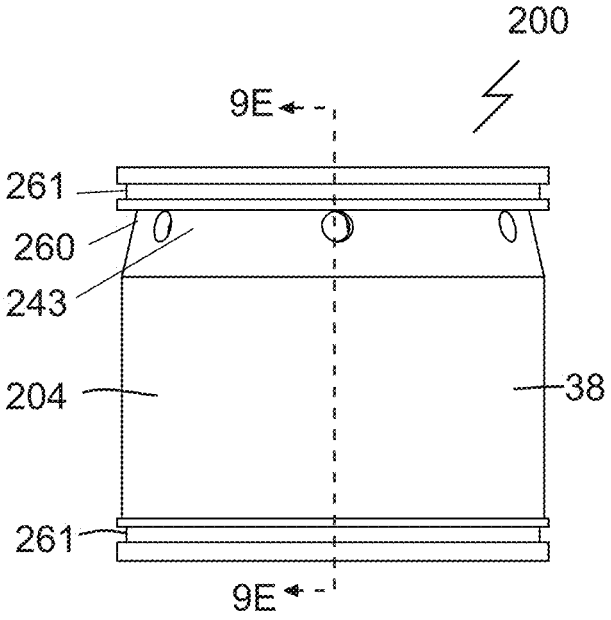
FIG. 9D is a side elevation view of the gas separator diffusor stage of FIG. 9A.
Figure 9E:
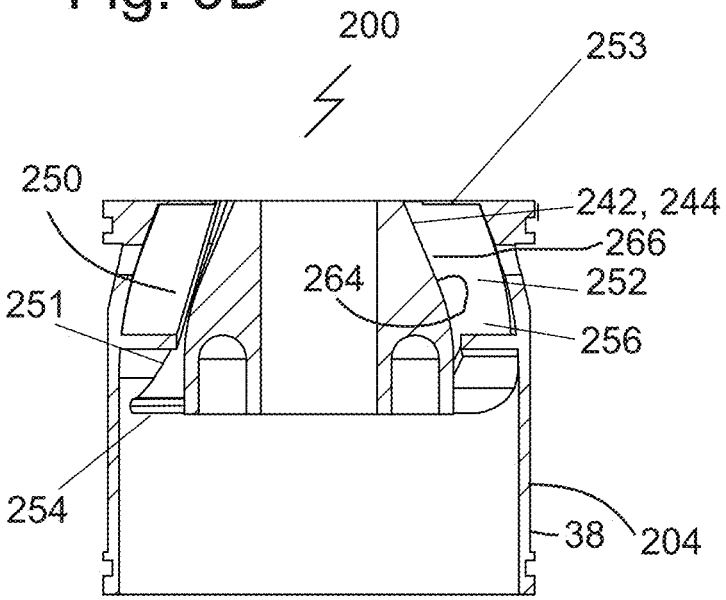
FIG. 9E is a view taken along the 9E-9E section lines in FIG. 9D.

Referring to FIGS. 9A, 9B, and 9C, a diffuser of gas separator stage 204 is shown with a L:D ratio of 0.76. Six hollow vanes 256 may be present, each hollow vane forming a gas crossover flowpath. The hollow vanes vent to the plenum 260 through circular holes 243 that form the gas exhaust exit point from the hollow vane. The gas entry point into the gas crossover flowpath may be positioned at a location where gas tends to accumulate in the diffuser. For example, a helical flowpath may include relatively high-density flux points and relatively low-density flux points, where relatively high- and low-density parts, respectively, of a multiphase fluid pass through or accumulate during use, and the gas entry point may be positioned at one or more of the relatively low-density flux points. The gas entry point 242 may be located toward or at one or more of a top edge 253 of the vane 250, a radially inside edge 266. The gas entry point may be structured to receive gas into the gas entry point in a direction that is one or more of in an uphole direction or radially inward. The gas entry point 242 may be defined by a gap between the radially inside edge 266 and the axial inside surface, such as diffuser inner surface 264. The gas exhaust crossover flowpath junction 242 may be formed by a slot disposed where gas tends to accumulate in a diffuser. Various locations where gas may accumulate in a diffuser may include toward the inside and toward the trailing edge (which may also be referred to as a trailing face) of the vanes 252 and toward a top of the vanes 253. The gas exhaust flowpath smallest cross-sectional area 244 may be at the junction between the gas and liquid flowpaths. Curved vanes substantially straightening the flow and expanding flowpath cross sectional area within the diffuser efficiently create positive pressure between impeller stages similar to a fluid moving stage design; positive pressure creates the pressure differential required to reliably exhaust gas through the gas crossover flowpath.

Figure 10A:
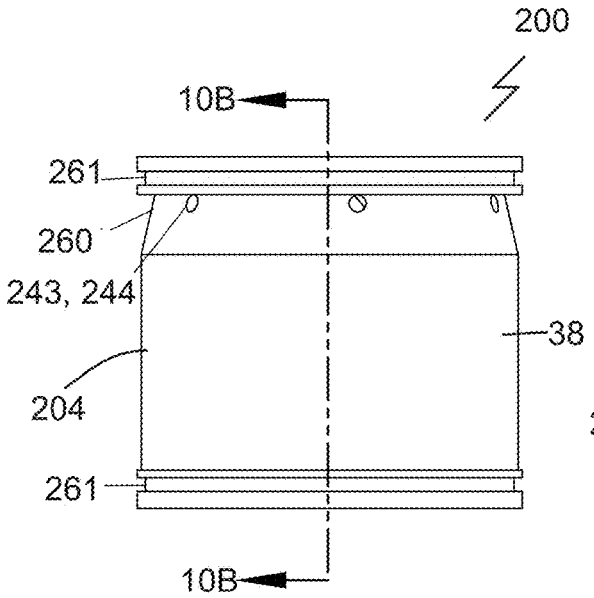
FIG. 10A is a side elevation view of an embodiment of a gas separator diffuser stage with restricted gas exhaust holes, wherein gas enters the hollow vanes at the top of the trailing edge of a helical vane of the diffuser, and the diffuser blades are still spiralled at the top. This may allow the fluid to continue spinning, better keeping gas towards the inside for entry to the subsequent impeller.
Figure 10B:
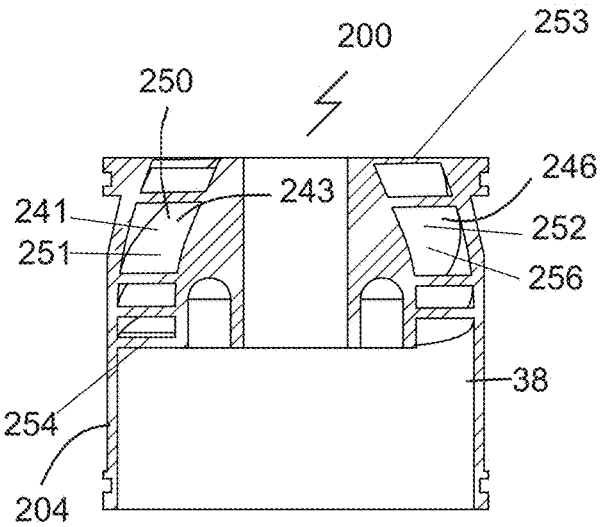
FIG. 10B is a view taken along the 10B-10B section lines in FIG. 10A.
Figure 10C:
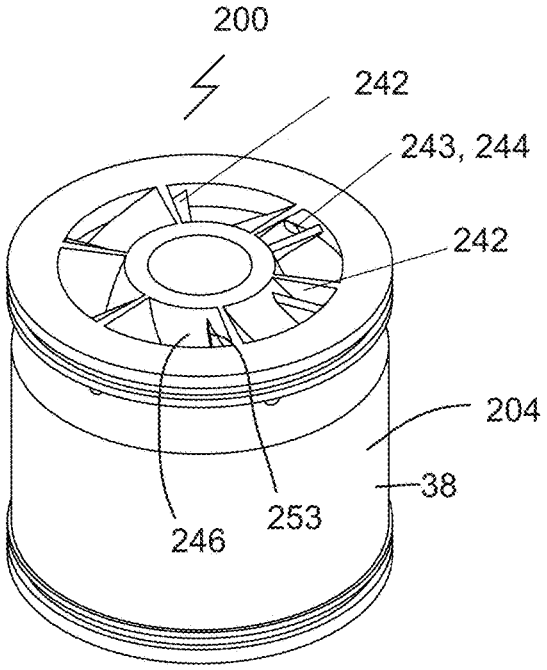
FIG. 10C is a perspective view of the gas separator diffuser stage of FIG. 10A.

Referring to FIGS. 10A, 10B, and 10C, another embodiment of a diffuser is shown. The gas exhaust flowpath smallest cross-sectional area 244 may be at a small hole at the gas exhaust exit point from hollow vane 243. The gas entry point (gas exhaust crossover flowpath junction 242) may be located toward or at one or more of a top edge 253 of the vanes 253 for example toward the top of the trailing edge 252 of the vanes 252. Such is a location where gas tends to accumulate in a diffuser and also is orientated substantially opposite to the direction of flow which limits the propensity for liquid to enter the gas exhaust crossover flowpath junction 242 in the hollow vane.

Figure 11A:
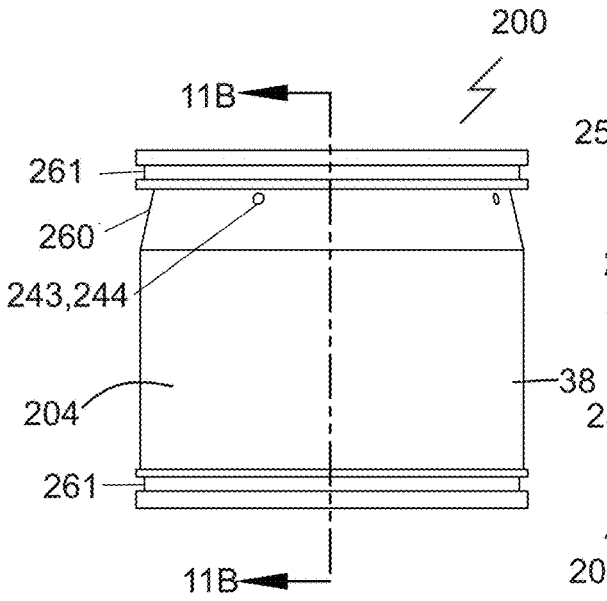
FIG. 11A is a side elevation view of an embodiment of a gas separator diffuser stage with even more restricted gas exhaust holes than in FIG. 10A, wherein gas enters the hollow vanes at the inside of the trailing edge and a recessed top edge of a helical vane of the diffuser.
Figure 11B:
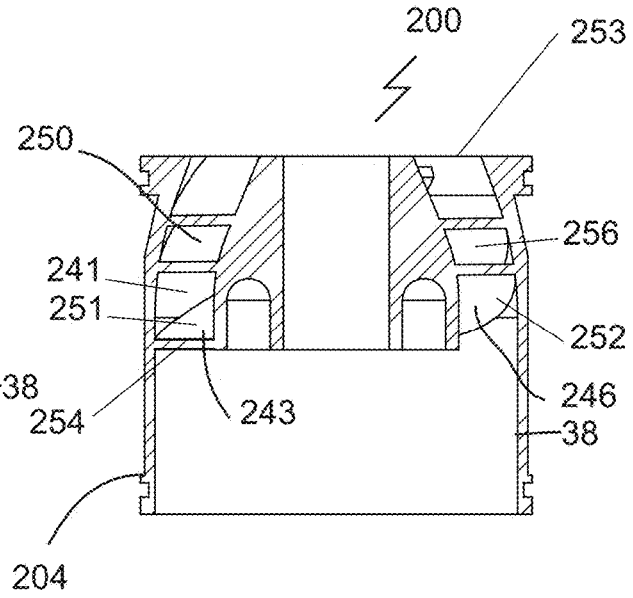
FIG. 11B is a view taken along the 11B-11B section lines in FIG. 11A.
Figure 11C:
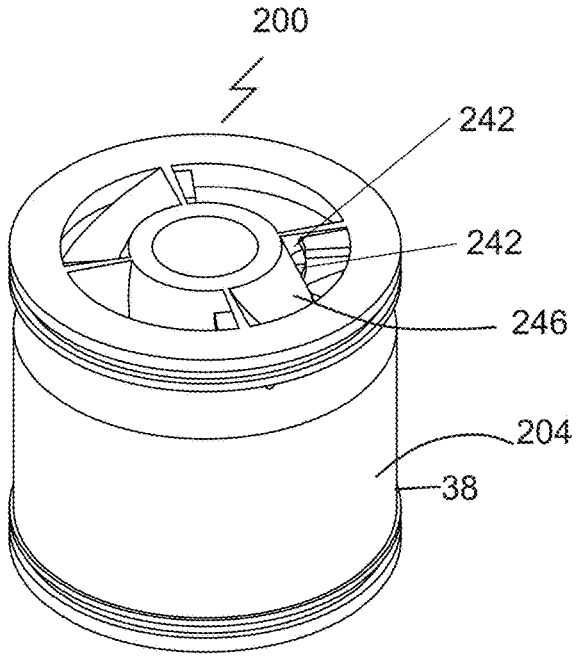
FIG. 11C is a perspective view of the gas separator diffuser stage of FIG. 11A.

Referring to FIGS. 11A, 11B, and 11C, the gas exhaust flowpath smallest cross-sectional area 244 may be at a small hole at the gas exhaust exit point from hollow vane 243. In the example shown the gas entry point has greater cross-sectional area than previous stages, but a smaller cross-sectional area as compared to the previous stages at the restriction which is formed by the small holes at the gas exhaust exit point from hollow vane 243. The gas exhaust crossover flowpath junction 242 may be located toward the inside of the top edge of the vanes 253 and may be recessed below the leading edge 251 (which may also be referred to as a leading face). The gas exhaust crossover flowpath junction 242 may continue along the inside toward the top of the trailing edge 252 of the diffuser vanes 250, which are locations gas tends to accumulate in a diffuser. Recessing the trailing edge and gas exhaust crossover flowpath junction (the entry point into the gas exhaust crossover flowpath) below the top of the leading edge of the vanes may be helpful providing a steady flow of gas into the gas exhaust flowpath, considering that the top edge of the diffuser vanes 253 is swept by the impeller vanes, typically with a tight clearance. Gas backflow across the top of vanes 253 may be a common occurrence, and locating a gas exhaust pathway in this location may be beneficial because a portion of the gas that backflows over the top of the vanes may be exhausted rather than entering the adjacent flowpath between vanes.

Figure 12A:
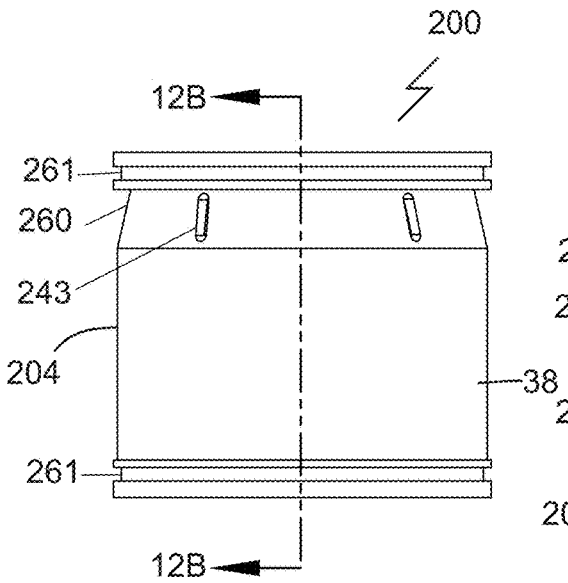
FIG. 12A is a side elevation view of an embodiment of a gas separator diffuser stage, wherein gas enters the hollow vanes at the inside of the trailing edge of a helical vane of the diffuser through a thin slot.
Figure 12B:
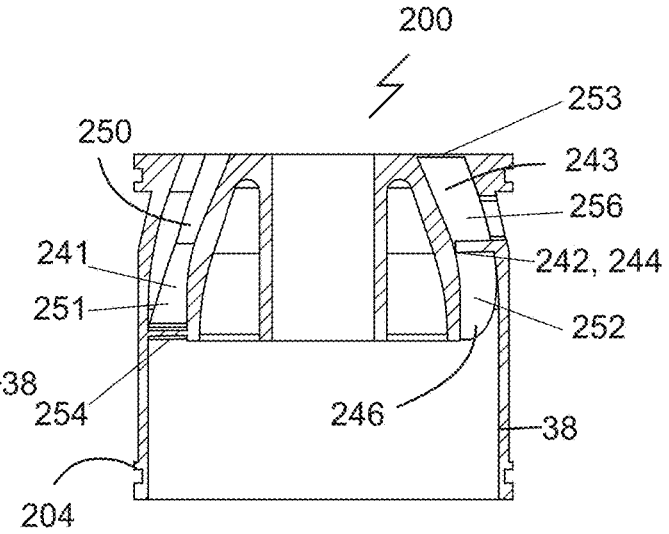
FIG. 12B is a view taken along the 12B-12B section lines in FIG. 12A.
Figure 12C:
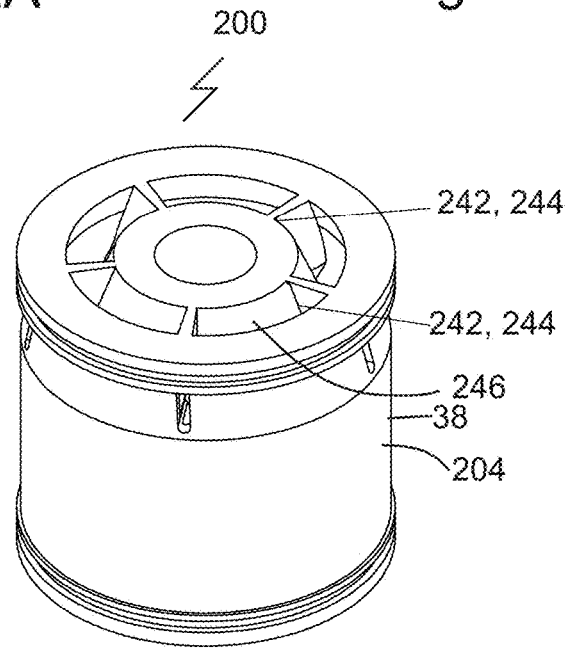
FIG. 12C is a perspective view of the gas separator diffuser stage of FIG. 12A.

Referring to FIGS. 12A, 12B, and 12C, as before the gas exhaust flowpath smallest cross-sectional area 244 may be at the gas exhaust crossover flowpath junction 242 between the gas and liquid flowpaths. The smallest cross-sectional area 244 may be very small through a very thin gap located toward the top edge 253 of the trailing edge 252 of the diffuser vanes 250. The clearance formed between the hollow vanes may be quite thin in this embodiment, and gas exhaust exit point from hollow vanes may be suitably shaped, for example slot shaped. Highly restricted gas exhaust pathways may be beneficial to allow significant positive pressure generation within the flow through the stage and minimizing the amount of liquid that is exhausted when gas is not present, to be exhausted, at the gas exhaust crossover flowpath junction 242.

Figure 13A:
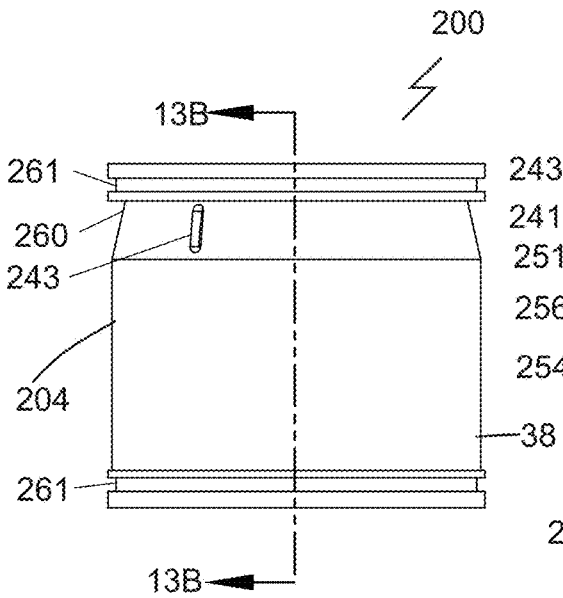
FIG. 13A is a side elevation view of an embodiment of a gas separator stage wherein the entry point of gas into the gas crossover flowpath is located between the impeller and diffuser in a radially inward direction and only two of the eight vanes are hollow.
Figure 13B:
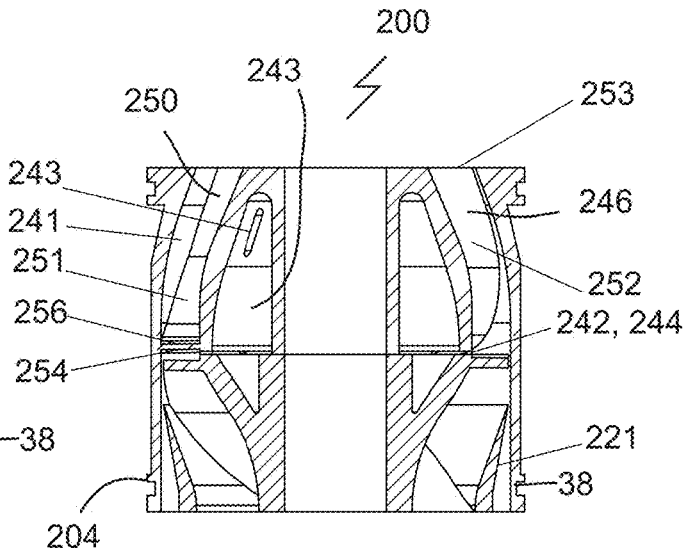
FIG. 13B is a view taken along the 13B-13B section lines in FIG. 13A.
Figure 13C:
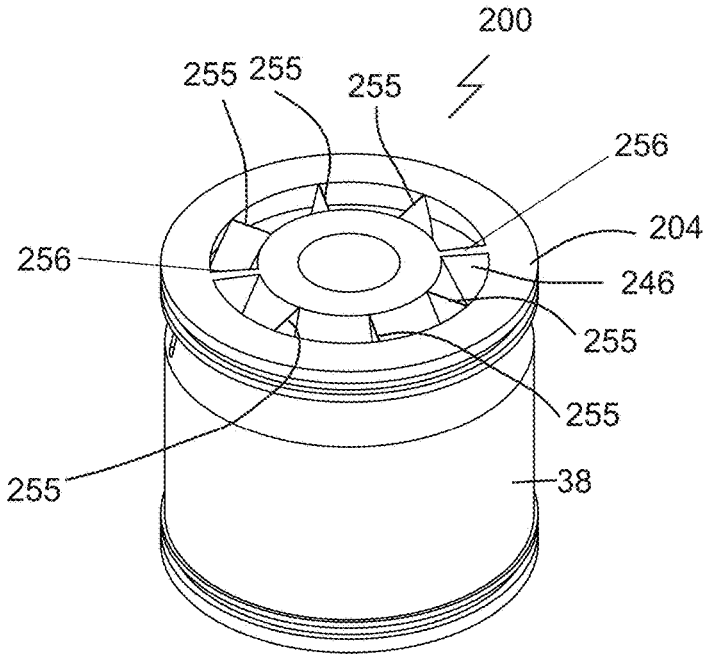
FIG. 13C is a perspective view of the gas separator stage of FIG. 13A.

Referring to FIGS. 13A, 13B, and 13C, a separator stage 204 is shown with an impeller 221. The gas entry point (gas exhaust crossover flowpath junction 242) may be located between the impeller and diffuser, for example in a radially inward direction. The junction 242 may be at a bottom edge 254 and radially inside wall of the diffuser. The impeller and diffuser may be located adjacent one another for example as shown. In the example shown only two of the eight vanes are hollow. The gas exhaust flowpath smallest cross-sectional area 244 may be at the junction between the gas and liquid flowpaths which is by definition the gas exhaust crossover flowpath junction 242. The impeller 221 flowpath can be seen in greater detail than in previous figures, shown with a helicoaxial flowpath, although this is not a necessary feature. The impellers of any gas separator stage 204 may also be purely axial. It may be beneficial to locate the gas exhaust crossover flowpath junction 242 in contact with the impeller 221 because the impeller is spinning and the surface of the impeller may have a velocity vector that is directed tangentially outward which will impart a similar "outward" throw of any liquid that may be travelling along the inner surface approaching the gas exhaust crossover flowpath junction 242 and serve to further reduce liquid carryover into the gas exhaust flowpath. As a reminder, the other benefits of orienting the entry for gas into the exhaust flowpath at the junction in a radially inward direction is expounded in the description of FIGS. 7A, 7B, 7C. The benefits of only making a portion of the vanes hollow include the following: more flow area may be preserved for fluid flow which may allow for more vanes to be used and provide greater efficiency creating positive pressure generation through the stage, and that manufacturing may be more practical and economical. Note that the void space that exists toward the inside of both the impeller and diffuser which is used in this embodiment for a gas exhaust pathway typically exists in conventional ESP stage designs (both helicoaxial and centrifugal stages) anyway due to the typical manufacturing technique of casting which typically uses approximately constant wall thicknesses throughout a cast part. These embodiments may employ that void space as part of the gas exhaust flowpath. In some cases, the impeller vanes that are configured to sweep across the gas crossover flowpath may be configured to ingest liquid from the gas crossover flowpath during operating conditions when there happens to be liquid in the gas crossover flowpath and the pressure within the compact axial length gas separator stage is relatively lower than during normal operating conditions, for example during transient operating conditions when liquid is present in the crossover flowpath, but gas is present in lower stages. As below, the impeller vanes may be integral (same part), or a separate impeller part with smaller vane passageways and a smaller outside diameter than the main impeller.

Figure 14A:
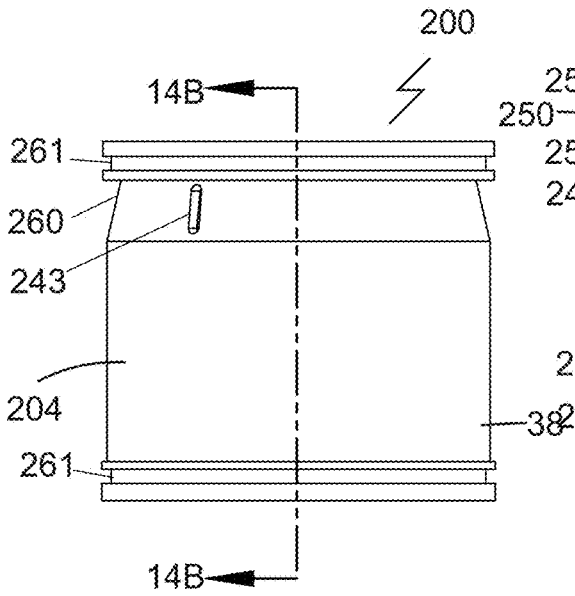
FIG. 14A is a side elevation view of an embodiment of a gas separator stage wherein the entry point of gas into the gas crossover flowpath is located between the impeller and diffuser and impeller vanes sweep a portion of the gas flowpath.
Figure 14B:
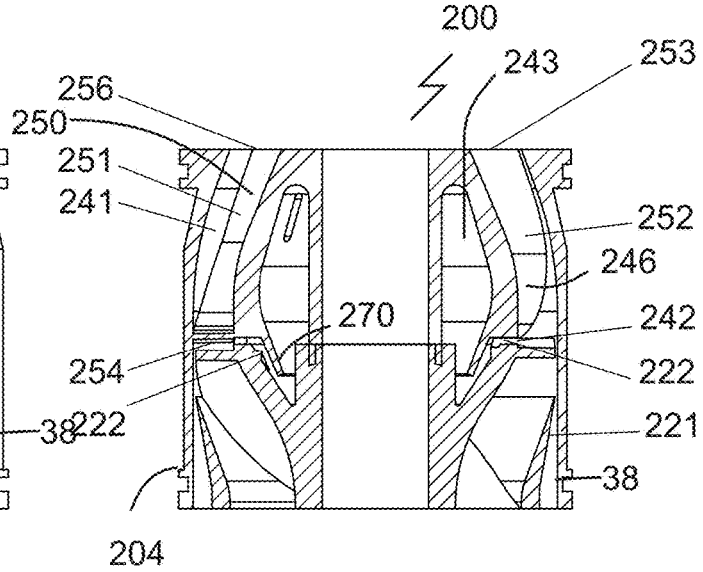
FIG. 14B is a view taken along the 14B-14B section lines in FIG. 14A.
Figure 14C:
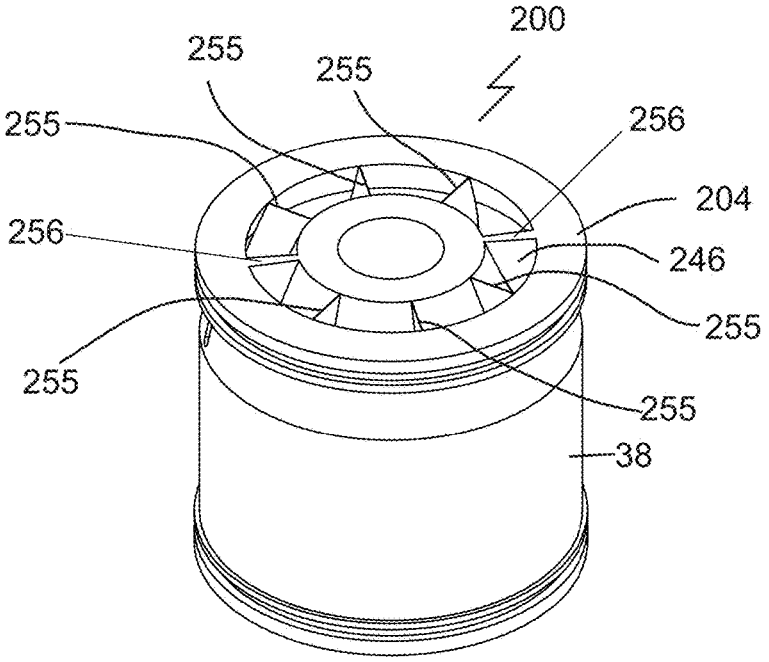
FIG. 14C is a perspective view of the gas separator stage of FIG. 14A.

Referring to FIGS. 14A, 14B, and 14C, the gas exhaust flowpath may be between the impeller and diffuser and impeller vanes 222 sweep a portion of the gas flowpath, for example at junction 242. The length of the flowpath between the impeller and diffuser may be extended inward and downhole, for example by providing a nose inlet 270 axially into the impeller 221, in order to elongate the radially-inward oriented portion of the gas exhaust flowpath. The benefit of elongating the radially-inward oriented portion of the gas exhaust flowpath is that this radially-inward oriented portion may be restrictive to undesired exhaust of liquid through it, so elongating it increases the effectiveness of blocking liquid flow into the gas exhaust flowpath. Similarly, the benefit of the vanes 222 sweeping within the gas exhaust flowpath may be to increase the effectiveness of blocking liquid flow into the gas exhaust flowpath.

Figure 15A:
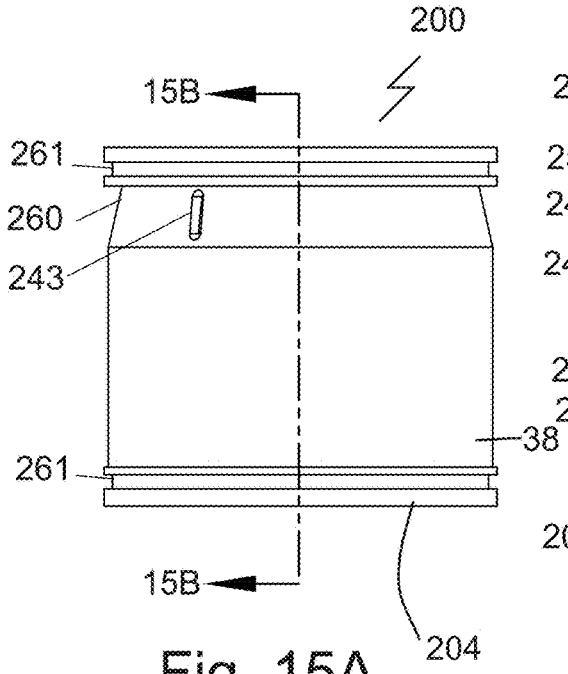
FIG. 15A is a side elevation view of an embodiment of a gas separator stage wherein the entry point of gas into the gas crossover flowpath is located within the impeller.
Figure 15B:
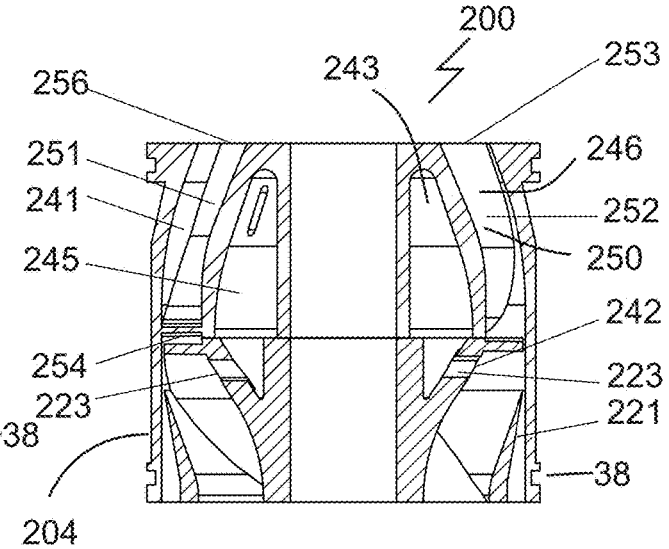
FIG. 15B is a view taken along the 15B-15B section lines in FIG. 15A.
Figure 15C:
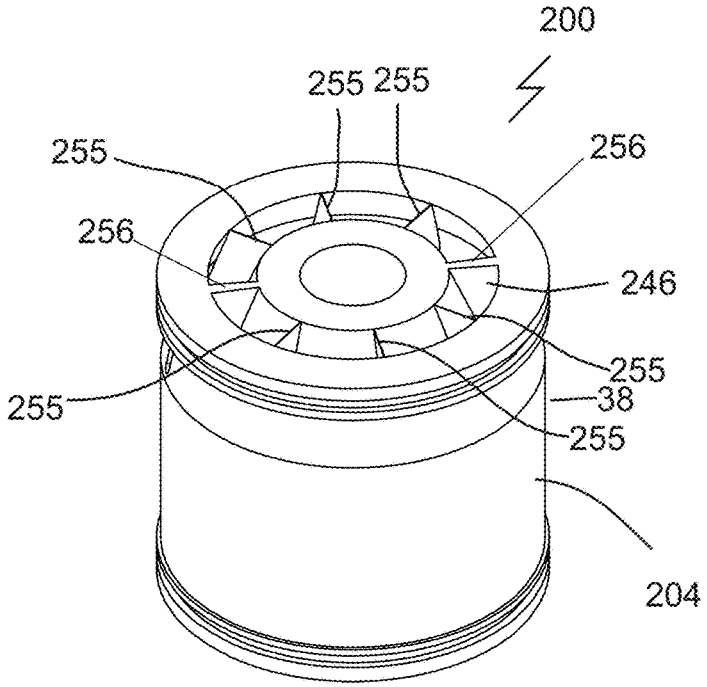
FIG. 15C is a perspective view the gas separator stage of FIG. 15A.

Referring to FIGS. 15A, 15B, and 15C, the gas entry point may be defined within the impeller. The gas exhaust crossover flowpath junction 242 may be located in the impeller, for example as holes or slots 223 (gas entry point) in the inner surface (radially inward surface) of the impeller fluid flowpath. A flowpath within a hole or slot in the impeller 223 may be by definition "swept" by the rotation of the impeller, the surface of which may have an outward velocity vector, which impedes the unwanted entry of liquid into the gas exhaust flowpath, while preferentially and autonomously allowing higher flow rates of gas as compared to liquid through the hole or slot, by virtue of the physical properties of the gas, primarily its lower density which allows a gas to both turn the corner and flow radially inward and against the direction of rotation. The gas entry point may be positioned at locations where gas tends to accumulate in the impeller. The holes or slots may be disposed toward the top of the impeller, and may be disposed closely behind a vane of the impeller as shown in this embodiment. As an alternative embodiment which is shown later in FIGS. 15D and 15E, the holes in the impeller may intersect the top surface of the impeller (effectively notches or grooves). The holes or slots 223 may be oriented perpendicular to the axis as shown in this embodiment, or they may be forward swept or backward swept, and/or they may be angled to align with the direction of the flowpath or angled against the direction of flow. It may be preferable to use thin slots which are angled in a backswept manner in order to maximize the resistance they provide to liquid entry.

Figure 15D:
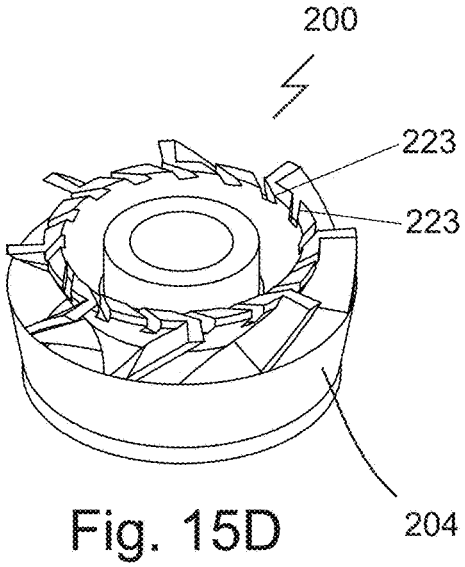
FIG. 15D is a perspective view of an impeller for the gas separator stage of FIG. 15A with an alternate entry point of gas into the gas crossover flowpath.

Referring to FIG. 15D, an embodiment of an impeller of a gas separator stage 204 is shown where the radially inward impeller holes or slots 223 (gas entry points) intersect the top surface and have a backswept angle. It may be practical to manufacture and technically advantageous to arrange the impeller holes or slots for gas exhaust at this location. It may not be necessary to design a restricted cross-sectional area within the gas exhaust flowpath while also building positive net pressure throughout the gas separator stages 204 because the rotating holes or slots in the impeller 223 may create a matching pressure gain when the holes or slots are full of a higher density fluid (liquid) so as to prevent the exhaust of liquid. In some scenarios of design and operation, the pressure generation when liquid is present in the slots may be sufficient to reverse the direction of flow and push liquid in through the crossover flowpath instead of exhausting gas out through the same flowpath. In this regard, the function embodiments such as those in FIGS. 14A, 14B, 14C, 15A, 15B, 15C, 15D, 15E, 15F, and 15G should be interpreted in the broadest extent: in the first instance they may function to exhaust gas when gas is present at the crossover flowpath junction 242 of main flowpath of the stage and sufficient pressure has been generated by the impeller plus any stages below to exhaust gas out through the crossover flowpath: in the second instance they may function as a multi-stage intake with intake stages 104 arranged in parallel—when liquid is present within the holes or slots or passageways between vanes of the impeller to create sufficient pressure to match that in the main flowpath of the stage then this stage design may pull liquid in through crossover flowpath. These embodiments may be considered multi-purpose because they may autonomously and alternatingly exhaust gas or intake liquid through the crossover flowpath depending on the density of the fluid within the holes or slots 223, and whether there is more pressure generated within the main fluid flowpath by stages below, or by the rotating vanes 223 which are part of the crossover flowpath. Note that any of these arrangements with rotating holes, slots, or vanes within the crossover pathway may behave in multiple ways at any given point in time: for example, one slot may be exhausting gas, while a different slot may be pushing liquid into the device. One skilled in the art will readily understand that certain flow regimes of multiphase fluids in the wellbore will result in transient flow conditions where the gas concentrations at various locations may vary significantly, and that there is a benefit of being able to push fluid from the crossover flowpath back into the main flowpath during transient events such as when there is liquid in the crossover flowpath but excessive gas within the lower stages of the gas separator or intake: these benefits may include being better able to avoid gas locking the pump despite slug flow regimes within the wellbore. If the ESP is installed in a substantially vertical position, this embodiment may create gathering space 245 inside the crossover flowpath that may function as a buoyancy driven gas separation chamber. In this gathering space the liquid may fall to contact the vanes or slots and be captured into the main flow while gas may accumulate near the top and bubble out through the hollow vane exit points 243.

Figure 15E:
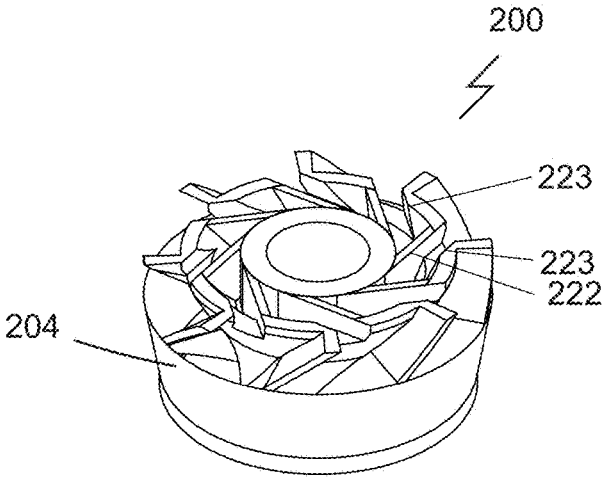
FIG. 15E is a perspective view of the impeller of FIG. 15D for the gas separator stage with slots in the impeller body and vanes in the crossover flowpath.

Referring to FIG. 15E, an embodiment of an impeller of a gas separator stage 204 is shown where the impeller holes or slots 223 intersect the top surface and have a backswept angle. The impeller may have vanes within the crossover pathway to more effectively help intake and push liquids into the device when liquid is present within the crossover pathway.

Figure 15F:
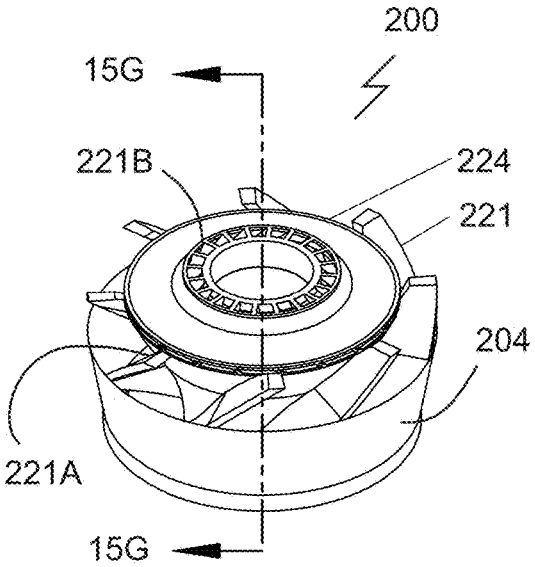
FIG. 15F is a perspective view of the impeller of FIG. 15D with a second smaller and inverted impeller component forming the vanes within the crossover flowpath.

Referring to FIG. 15F, the impeller 221 may comprise a first impeller part 221A structured to drive fluids received from upstream, for example from an intake or upstream separator stage, through the gas separator into the diffuser, and a second impeller part 221B. Part 221B may be coaxial with and nested within the first impeller part 221A and structured to sweep a gas entry point of the gas crossover fluid pathway. An embodiment of a gas separator stage 204 impeller 221 is shown with a second smaller and inverted impeller 224 (impeller part 221B) within the crossover flowpath. The crossover pathway junction may be formed by the outside of the flowpath through the smaller inverted impeller 224. The function of this configuration may be similar to FIGS. 14A, 14B, 14C, 15A, 15B, 15C, 15D, and 15E but may be more efficient at autonomously intaking liquid and avoiding the exhaust of liquid.

Figure 15G:
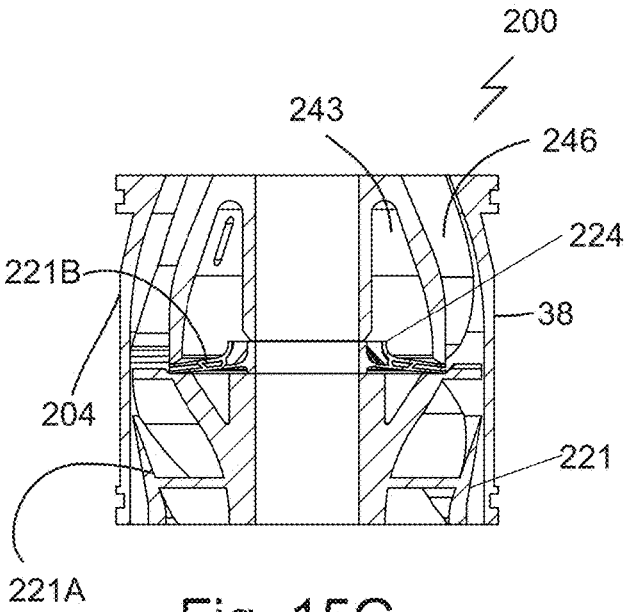
FIG. 15G is a view taken along the 15G-15G section lines in 15F.

Referring to FIG. 15G, the cross section through the centerline is shown for the gas separator stage 204 impeller 221 and smaller inverted impeller 224 of FIG. 15F, with the diffuser of the same stage to clearly illustrate the various internal flowpaths. It may be possible to stack two or more smaller impellers in series within the main diffuser of each stage, wherein each small inverted diffuser would be connected to the subsequent small inverted impellers by means of a small inverted diffuser in order to further increase the capability of the small impellers to generate pressure and intake liquid. With two or more stages of this embodiment stacked within the same downhole rotary pump, the primary function of stages with this configuration may be as a multi-stage intake (with the example, intake stages 104 arranged in parallel), while also providing the ability to exhaust gas from the main flowpath.

Figure 16A:
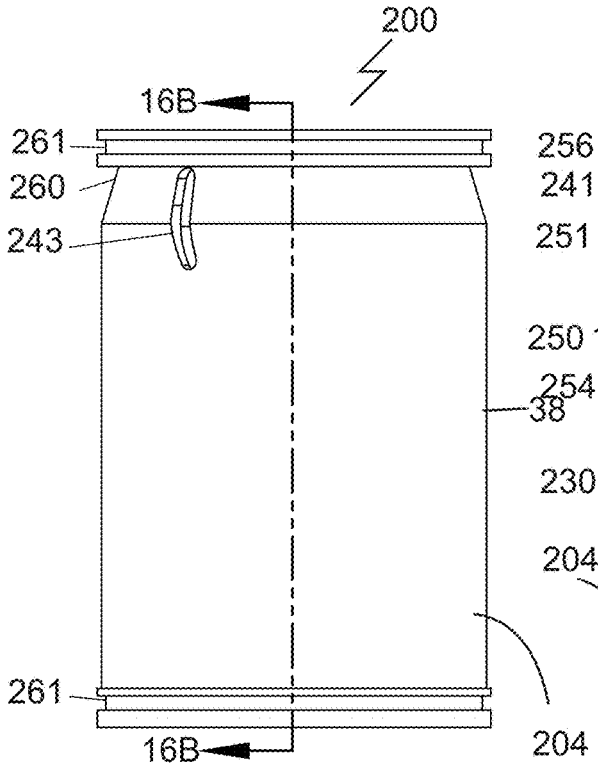
FIG. 16A is a side elevation view of an embodiment of a gas separator stage, wherein the diffuser includes a vortex chamber, which is void of vanes, and is disposed between the impeller and the entry point of gas into the gas crossover flowpath, configured in a fashion similar to a conventional gas separator in that the separating structure is substantially cylindrical and gas enters the gas crossover flowpath in an uphole direction, with only one vane being hollow.
Figure 16B:
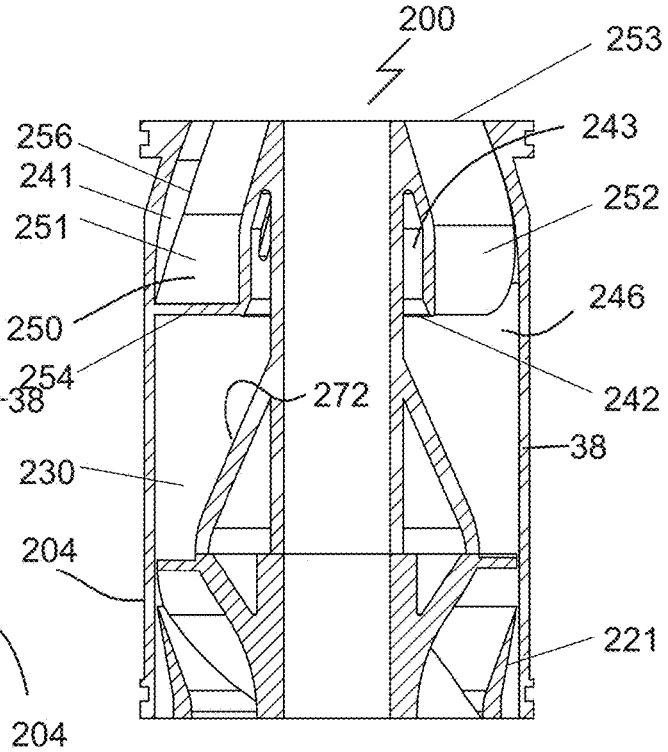
FIG. 16B is a view taken along the 16B-16B section lines in FIG. 16A.
Figure 16C:
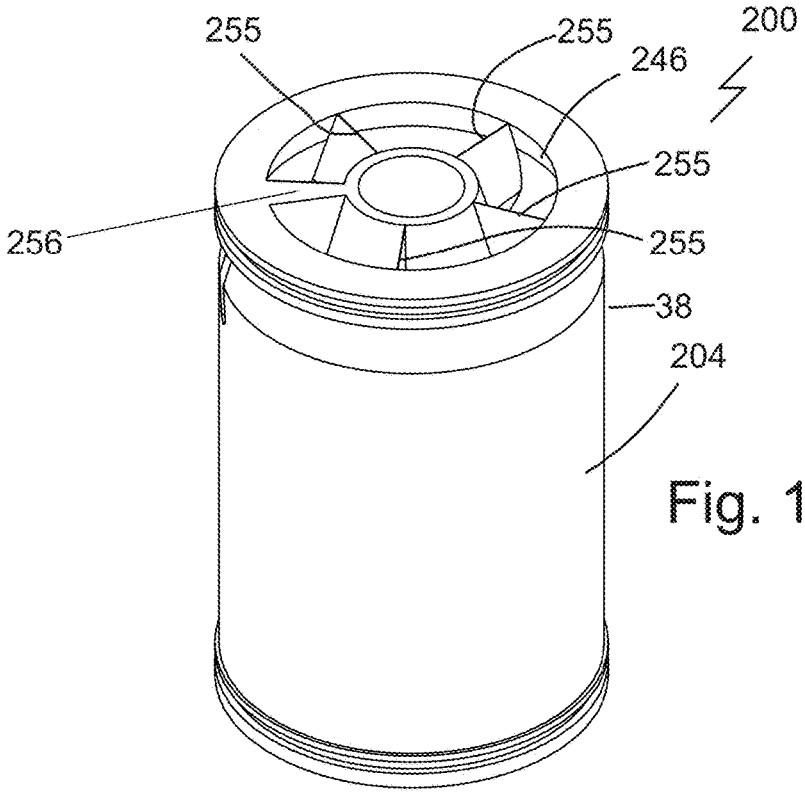
FIG. 16C is a perspective view of the gas separator stage of FIG. 16A.

Referring to FIG. 16A, 16B, 16C an embodiment of a gas separator stage 204 is shown with a vortex chamber 230. The stage 204 may have a L:D ratio of 1.27. Similar to most conventional vortex gas separators, the diffuser may include a vortex chamber 230, for example that is void of vanes and gas that is to be exhausted enters the crossover flowpath junction 242, which may have a generally cylindrical structure, in an uphole direction. The entrance to the crossover flowpath may be unrestricted similar to typical vortex separators. In this embodiment the spin required for vortex separation may be imparted by the impeller 221. The short nature of this gas separator configuration is that it practically and economically allows multiple stages of gas separation to be used on a downhole rotary pump. This embodiment is an example of a vortex chamber 230 that widens in an axial direction when it is used in combination with a helicoaxial impeller stage, the inner surface 272 is frusto-conical, for example with increasing cross-sectional flow area in an axial direction. The diffuser may have one or more solid vanes. The one or more hollow vanes may comprise one hollow vane. In this embodiment, only one vane may be hollow while the other four vanes may be solid vanes 255 like a conventional diffuser. The benefits of only making one vane hollow are that: more flow area is preserved for fluid flow which allows for more vanes to be used and greater efficiency at creating positive pressure generation through the stage, and that manufacturing may be more practical and economical.

Figure 17A:
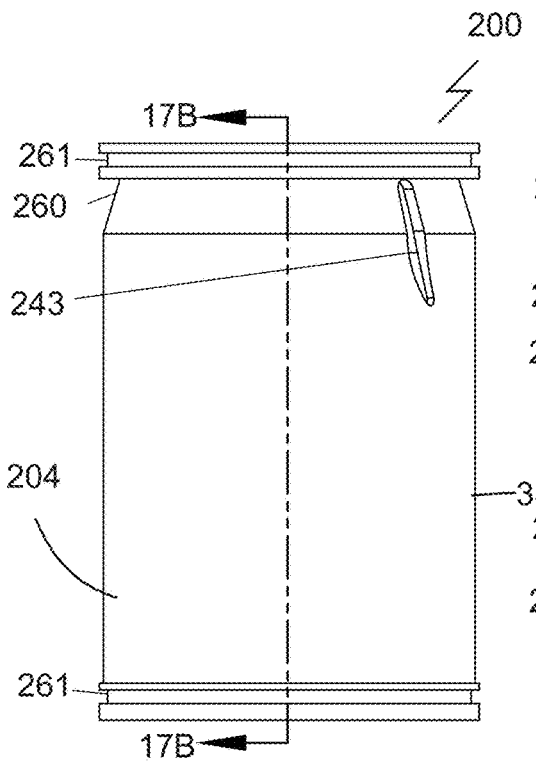
FIG. 17A is a side elevation view of an embodiment of a gas separator stage, wherein the diffuser includes a vortex chamber with helical vanes traversing it, with the minimum cross section in the gas crossover flowpath being at the point of entry to the gas crossover flowpath.
Figure 17B:
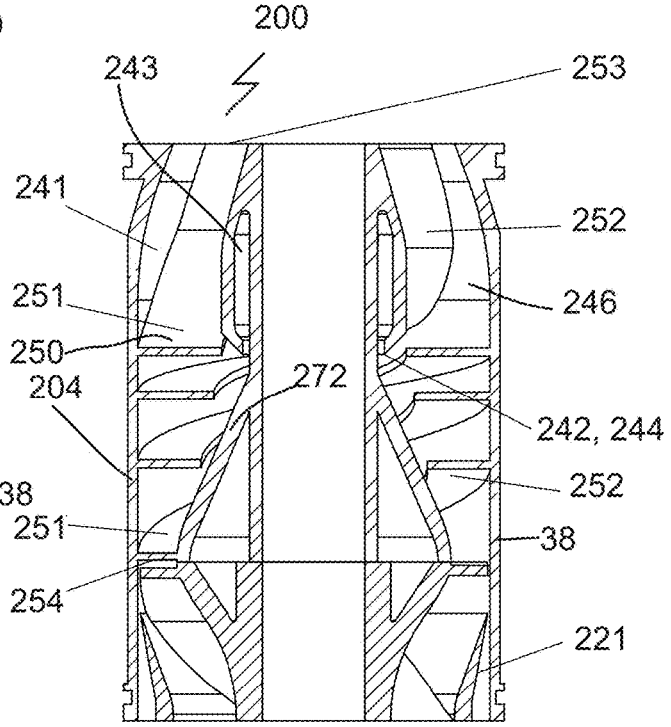
FIG. 17B is a view taken along the 17B-17B section lines in FIG. 17A.
Figure 17C:
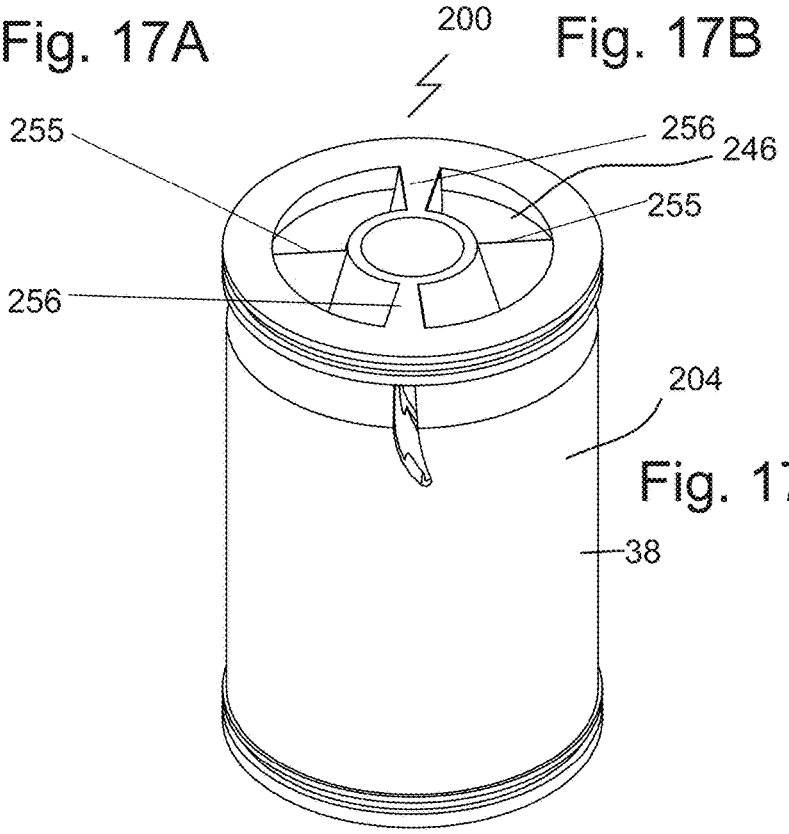
FIG. 17C is a perspective view of the gas separator stage of FIG. 17A.

Referring to FIG. 17A, 17B, 17C an embodiment of a gas separator stage 204 is shown with a vortex chamber that is traversed by helical vanes. The embodiment may have a L:D ratio of 1.27. Similar to some conventional vortex gas separators, the vortex chamber 230 in the diffuser may have spiraled vanes traversing the length. In addition to the unique compact axial-length, the other unique features relative to prior art include: first, that the that the vanes traversing the vortex chamber are continuous with the vanes traversing the crossover flowpath portion at the top these vanes curving within the crossover flowpath portion to straighten the flow (benefits of straightening the flow discussed elsewhere), and two of the four vanes thicken and become hollow to create the crossover flowpath; third, the gas exhaust flowpath smallest cross sectional area 244 is located at the crossover flowpath junction 242 (benefits discussed elsewhere). The inner surface 272 may be frusto-conical and the lead angle of the spiraled vanes may decrease in this vortex chamber section where the radial thickness of the flowpath is expanding in order to keep an approximately constant velocity of the fluids within the flowpath (which is shown in an exaggerated manner in the figures for illustrative purposes); the radial thickness of the flowpath decreases above the crossover flowpath junction 242 and the lead angle of the vanes increases in this portion to straighten the flow and may also decelerate the flow to increase static pressure prior to arrival at the impeller of the subsequent stage.

Figure 18A:
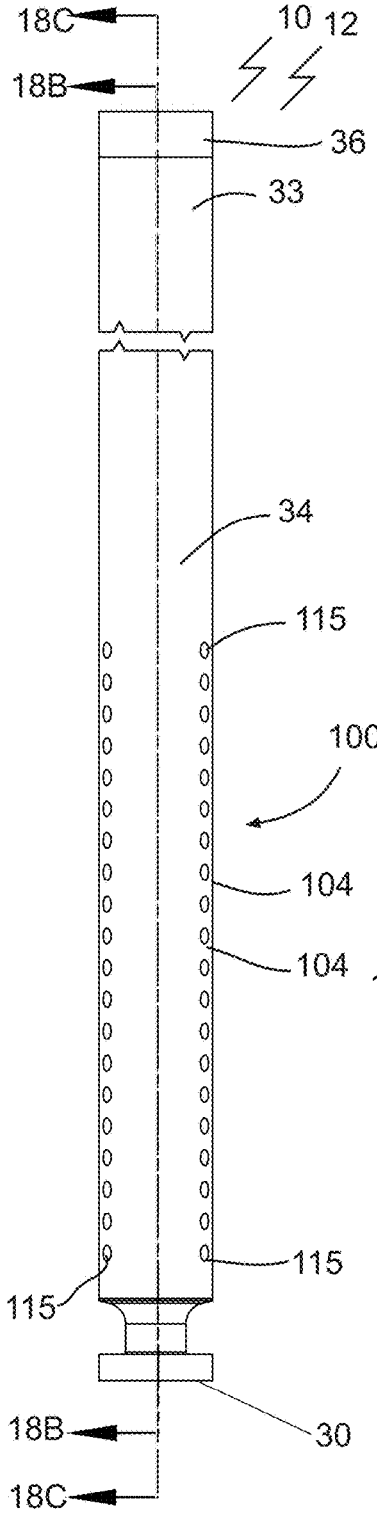
FIG. 18A is a side elevation view of an embodiment of a multistage intake device, with each stage arranged in parallel and having intake crossover flowpaths and impellers.
Figure 18B:
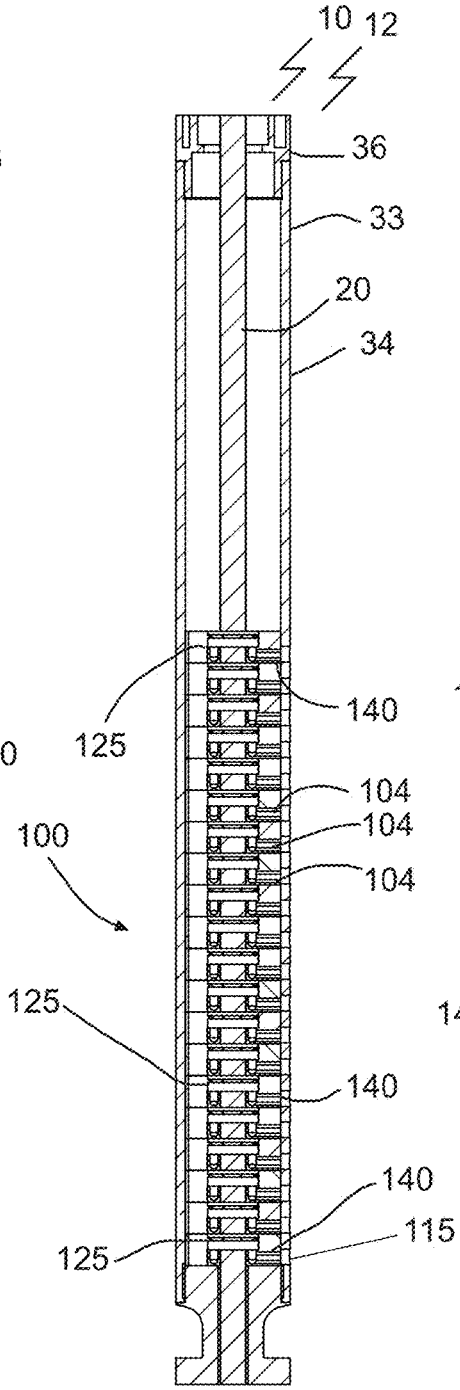
FIG. 18B is a view taken along the 18B-18B section lines in FIG. 18A wherein impellers are not cut by the cross section.
Figure 18C:
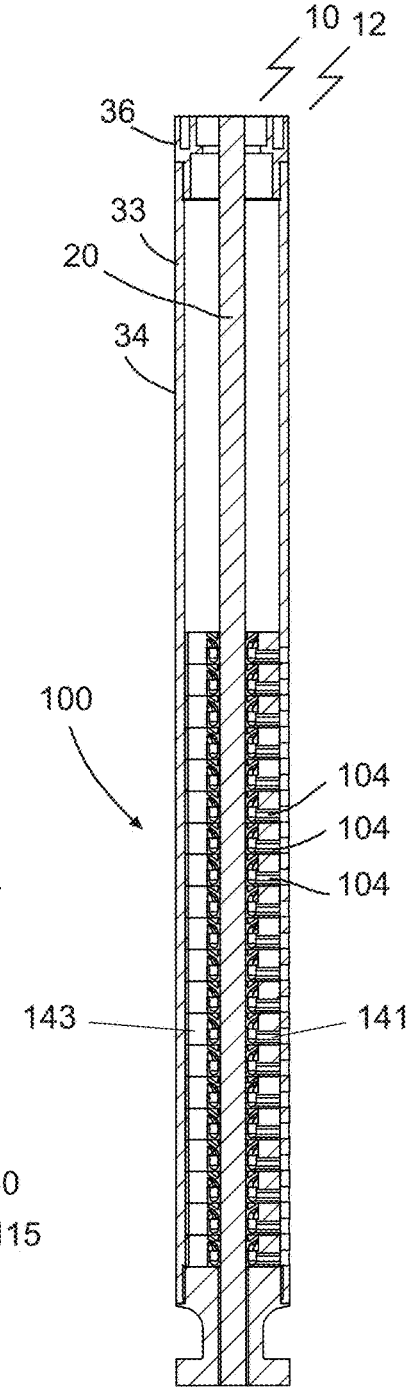
FIG. 18C is a view taken along the 18C-18C section lines in FIG. 18A wherein all components are cut by the cross section.

Referring to FIG. 18A, 18B, 18C a multistage intake device is shown. A multi-stage intake of a downhole rotary pump may define a fluid flowpath 143. A multi-stage intake may comprise two or more intake stages 104 arranged in parallel and in some cases, each having one or more impellers. Each intake stage 104 may comprise an intake housing 34 defining the fluid flowpath 143 and an inlet hole 110 to the fluid flowpath 143. Each intake stage 104 may define an intake impeller 125 configured to draw fluid through the inlet hole 110 and supply the fluid into the fluid flowpath. Each intake stage 104 may define an axial flowpath 143 for axial flow of fluid from an upstream end 180 to a downstream end 182 (FIG. 18D) of the intake stage 104. Each stage 104 may define a crossover flowpath 141 to ingest fluid from an inlet hole 110 and provide the fluid to the impeller 125, which is radially inward of the crossover flowpath 141. In the example shown, each stage has a L:D ratio of 0.28 (L being the length of the stage, D being the outer diameter of the outer housing, in this case outer housing 33), each stage is arranged in parallel, and each stage has an intake crossover flowpath and an intake impeller. The configuration and layout of this intake device may be similar to that of the multi-function stages in FIGS. 14A, 14B, 14C, 15A, 15B, 15C, 15D, 15E, 15F, and 15G, with the exception that the main flowpath 143 through the device for axial flow of the fluid from other intake stages 104 to bypass the impeller and flow in an uphole direction and into the pump or gas separator is not swept by the vanes of a larger impeller or a radially outward portion of the same impeller-instead, the main flowpath 143 (which travels between upstream and downstream ends of each intake stage) through the device is formed between hollow vanes of diffuser-like multistage-parallel configuration intake crossover 140. Each intake crossover 140 may have hollow vanes forming a flowpath 141 to intake fluid from the inlet holes 115 and provide it to an inwardly located intake impeller 125. The crossover flowpath 141 may be aligned with the inlet holes in the housing 34, and during assembly a mechanism to maintain the rotational alignment of the holes may be required (although not shown, rotational alignment mechanism may include set screws or other techniques as are known in the art). Each intake stage 104 may act in parallel allowing a high total intake fluid rate through use of many stages despite the relatively small size and flow rate through each individual stage: for example, this embodiment shows 20 stages, so if each stage has an intake capacity of 200 bbL:D the total capacity of the device might be 4.000 bbL:D. The intake device may be coupled at 30 to a downhole motor. The intake device may be disposed in the same housing 33 with gas separator stages 204 and pressure generating pump stages above, or a coupler may be used between this intake and downstream stages. The impeller of each stage may function autonomously to preferentially intake liquid, while stages that are exposed to gas may limit the amount of gas that is taken in, or even in certain situations (when sufficient pressure is generated within the main flowpath of the device 143) gas may instead be exhausted out of the intake impellers which are filled with gas. An intake, fluid moving stages, or gas separator stages 204 may be placed below this multistage intake device (or the similar devices of FIGS. 19-22); in such a configuration it may function to increase the intake flow rate capacity of the intake device and extend the effective length of the intake to avoid entraining gas and better handle intermittent flow from the wellbore.

Figure 18D:
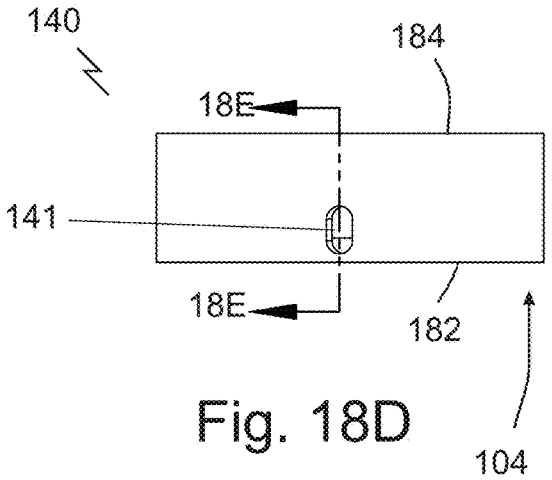
FIG. 18D is a side elevation view of a single intake crossover of FIG. 18A.
Figure 18E:
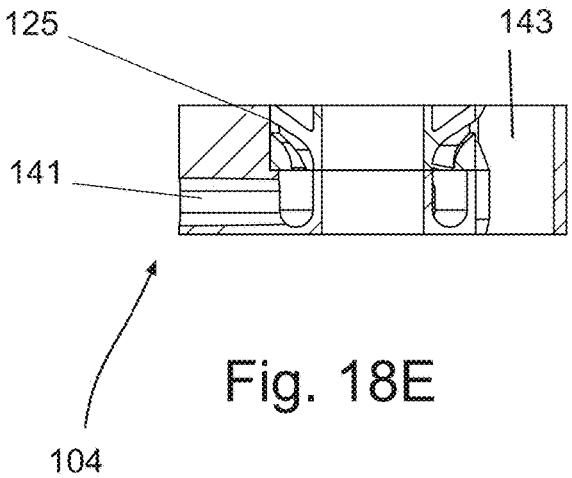
FIG. 18E is a view taken along the 18E-18E section lines in FIG. 18D.
Figure 18F:
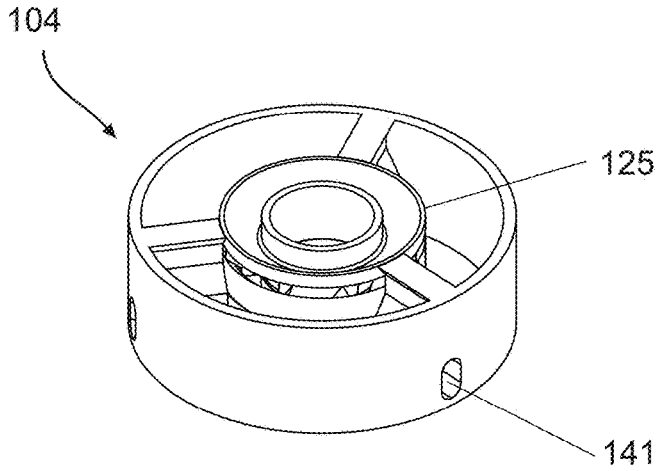
FIG. 18F is a perspective view of the intake crossover of FIG. 18D.

Referring to FIG. 18D, 18E, 18F the intake crossover 140 and intake impeller 125 of a multistage intake device is shown in detail. The crossover flowpath 141 internal passageway through a hollow straight vane can be seen in detail. The vanes may become solid (not hollow) and narrow in thickness adjacent to the exhaust pathway of the intake impeller 125. It may not be necessary for the vanes to extend the entire axial length of the intake crossover; instead, the exhaust pathway of the intake impeller 125 may be into a portion of the main flowpath of the device 143 that is void of vanes (as shown in FIG. 19).

Figure 19A:
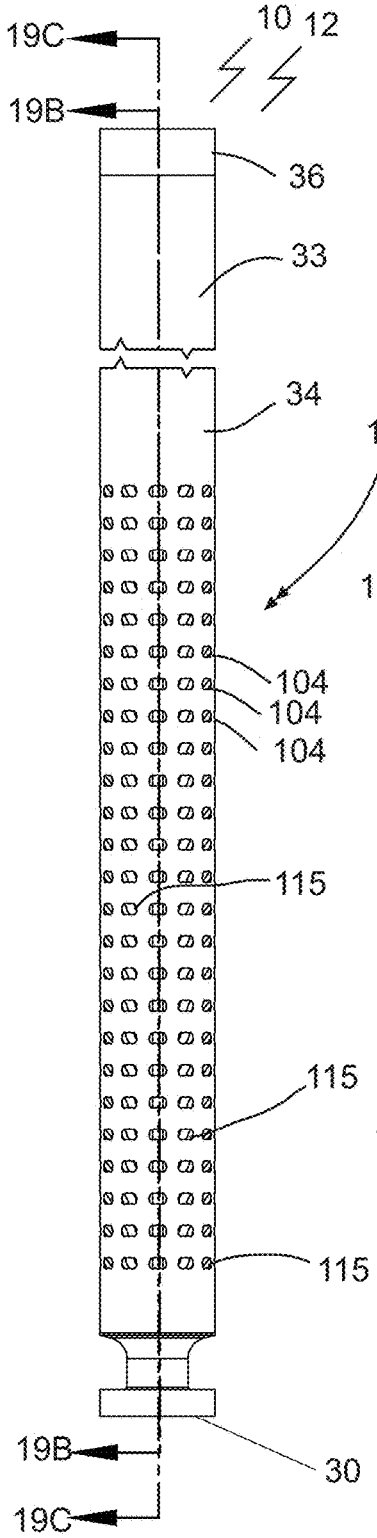
FIG. 19A is a side elevation view of an embodiment of a multistage intake device, with an annular space defined between the housing and crossover structure to enable gravity-based buoyancy separation of gas before entering the intake crossover flowpath of each stage, and using two impeller flowpaths to draw fluid through each intake crossover, one impeller above and one impeller below.
Figure 19B:
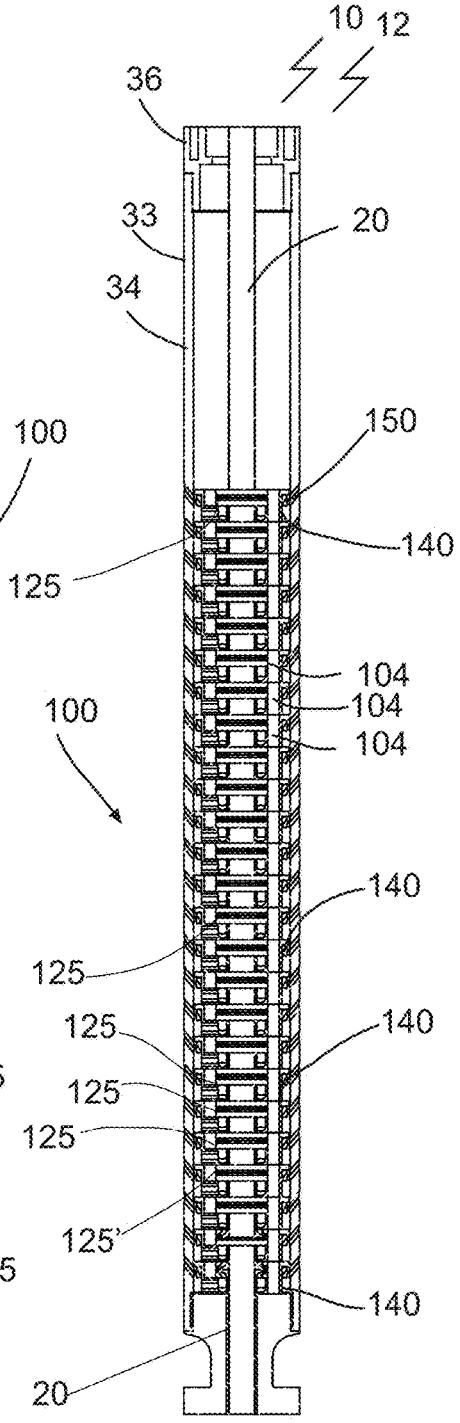
FIG. 19B is a view taken along the 19B-19B section lines in FIG. 19A, wherein most impellers are not cut by the cross section, and the impellers in the first (lowest) two stages are cut by the cross section.
Figure 19C:
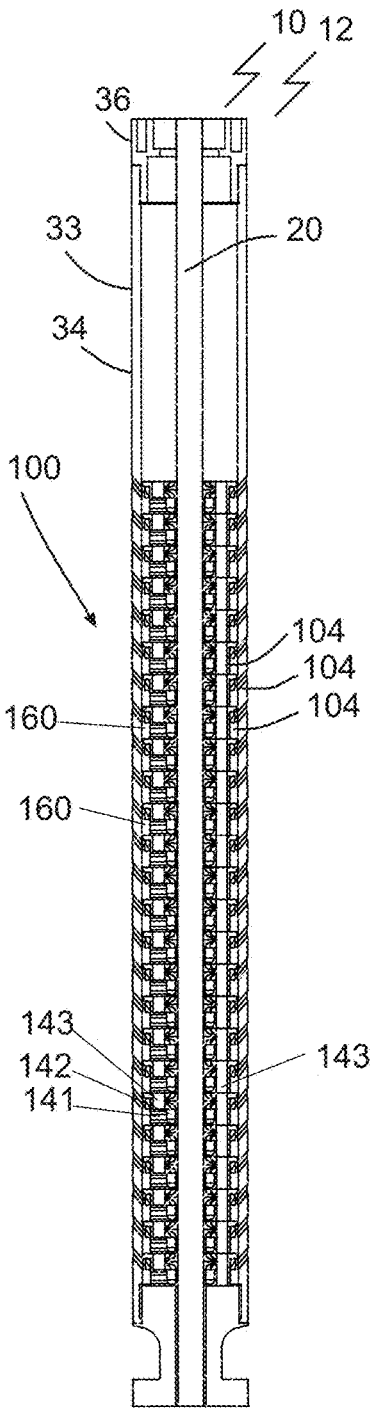
FIG. 19C is a view taken along the 19C-19C section lines in FIG. 19A wherein all components are cut by the cross section.

Referring to FIG. 19A, 19B, 19C another embodiment of a multistage intake device is shown. Each stage may have a L:D ratio of 0.28 and 25 individual stages. Each stage of the intake device may have plural inlet holes 110, for example angularly spaced from one another about a circumference of the intake housing. Each intake stage 104 may be arranged in parallel with two intake impellers 125 for each intake crossover 140, the first upright intake impeller being located above the intake crossover 140, and the second inverted intake impeller 125' being located below the intake crossover 140 (this arrangement will be illustrated in more detail in other FIGS. with a larger scale). For one or more intake stages 104 the crossover flowpath 141 may comprise a gathering space 142 chamber configured to receive fluid from the inlet hole 110 and provide the fluid to one or more, for example two, impellers 125 arranged in parallel within the intake stage 104. A gathering space inside the intake crossover provides flow to impellers disposed both above and below. The inverted intake impeller 125' of a stage may be combined into a single cast part with the upright small impeller 125 of the adjacent lower stage (not shown).

Figure 19D:
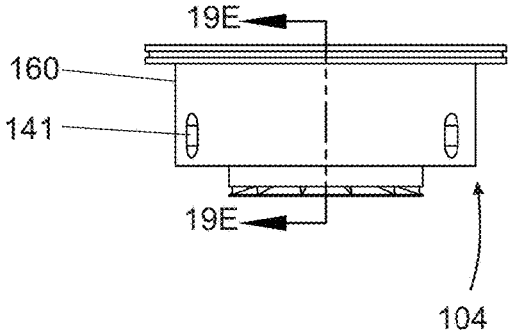
FIG. 19D is a side elevation view of a single intake stage from FIG. 19A.
Figure 19E:
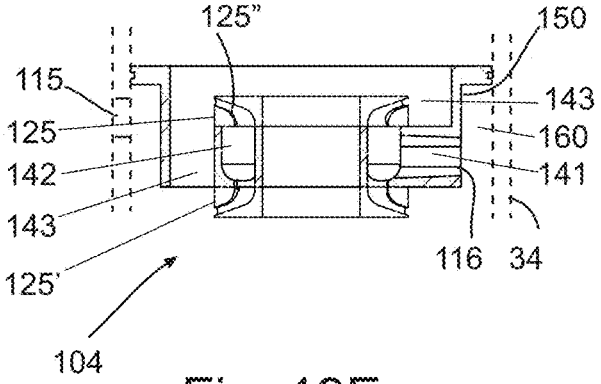
FIG. 19E is a view taken along the 19E-19E section lines in FIG. 19D, and with an intake outer housing shown in dashed lines for context.
Figure 19F:
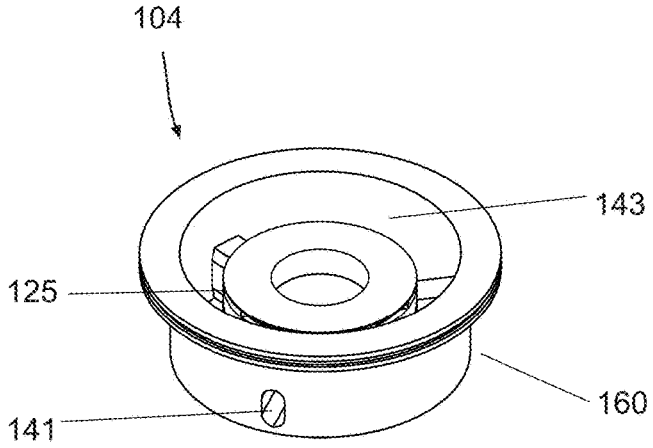
FIG. 19F is a perspective view of the single intake stage of FIG. 19D.

Referring to FIGS. 19D-19F, a recessed OD on multistage-parallel configuration intake crossover may create an enlarged annular space 160 between it and the housing 33. For one or more intake stages the intake stage 104 may comprise an outer housing such as housing 34, and an inner housing such as housing 150. A plenum such as an annular plenum 160 may be defined between the inner housing and outer housing. The inlet hole may comprise an inner inlet hole 116 or holes and/or an outer inlet hole 115. The inner housing 150 may define the inner inlet hole 116. The outer housing 34 may define the outer inlet hole 115 to permit entry of fluid into the annular plenum or space 161. The impeller 125 may be within the inner housing and configured with an impeller 125" and an inverted impeller 125'. Such an annular space 161 may allow misalignment between the inlet holes 115 and the crossover flowpaths 141—this annular space may enable gravity-based buoyancy separation of gas before within this annular space before the fluid enters the intake crossover flowpath. Gas which rises may exit by buoyancy force through the inlet holes 115 which may be angled in this embodiment to promote exit of gas bubbles. This buoyancy separation effect may be effective in a substantially vertical or horizontal pump landing position, or any inclination in between when a sufficient number of stages are used corresponding to the total flow rate such that the fluid velocities through the inlet holes of each stage are lower than the bubble rise velocity. The outer annular space may be structured to have sufficient cross-sectional area with a sufficient number of stages to reduce the linear velocity of the downhole liquid flow through each stage below the liquid rise velocity of medium or small sized bubbles. Amongst other variables, the liquid rise velocity depends primarily on the size of the bubbles, the viscosity and the liquid, the inclination that the pump is installed at, and is often expected to range between 3 to 6 inches per second; for various applications, effective gravity-based gas separation may occur in a broader range of liquid flow velocities such as between 1 to 20 inches per second. At higher flow velocities the majority of the gas segregation effects may occur in the outer inlet holes and may be enhanced by elongated slot-shaped holes or holes located in a spiral pattern. At lower flow velocities, gas bubbles may coalesce in the outer annular space before rising and being exhausted out of the gas outlet. In order for gas bubbles to be efficiently exhausted out of the inlet holes the cumulative cross-sectional area of the outer inlet holes of a stage may be greater than the cross-sectional area of the outer annular space. The volume between the bottom of the outer inlet holes and the inner inlet holes additionally provides a "reserve volume" of liquid that may be drawn into the pump to avoid a gas lock event despite the occasional passage of "100% gas slugs" through the wellbore and past the pump intake device. While each intake stage 104 is shown in this embodiment with a short length in order to maximize the number of stages that can be installed within a given length, the buoyancy driven gas separation effects may be greater if in said annular space is of a greater length. Additionally, a greater length annular space may provide a reserve volume of fluid to improve tolerance to transient gas slug flow in the wellbore. In this embodiment, the vanes may not extend the entire axial length of the intake crossover—the exhaust pathway of the intake impellers 125 and 125' are into a portion of the main flowpath of the device 143 that is void of vanes. In the embodiment shown the total flow area through the 60 inlet holes is approximately 26.5 sqin, and the flow area between the shaft 20 OD and the housing 34 ID is approximately 15 sqin giving a ratio of the flow area through the inlet holes to the flow area inside the housing 34 of approximately 1.8.

Referring to FIG. 19D, 19E, 19F the intake crossover and intake impeller 125 with a second inverted intake impeller 125' of a multistage intake device is shown in detail. Both impellers draw fluid from a common gathering space 142 that is inside the intake crossover. It may be beneficial to design a multistage intake device with two impellers for each crossover assembly to maximize the flow rate capacity and pressure generation capability of each intake stage 104 while minimizing the length and the cost of the device. In the embodiment shown the total flow area through the inlet holes may be approximately 131 sqin, and the flow area between the shaft 20 OD and the housing 34 ID may be approximately 15 sqin giving a ratio of the flow area through the inlet holes to the flow area inside the housing 34 of approximately 9. In the embodiment shown the total flow area through the crossover flowpaths may be approximately 11 sqin, and the flow area between the shaft 20 OD and the housing 34 ID may be approximately 15 sqin giving a ratio of the flow area through the inlet holes to the flow area inside the housing 34 of approximately 0.74 (in some cases, the ratio is 1.0 or higher).

Referring to FIG. 20A, 20B, 20C, 20D a multistage intake device is illustrated with each impeller 125 comprising dual cooperating impellers—a radially inward portion and a radially outward portion. Each intake stage 104 may comprise a plurality of outer inlet holes 115 angularly spaced from one another about a circumference of a housing 34. For one or more intake stages, the outer inlet hole 115 may be elongate in an axial direction. The outer inlet hole 115 may form an inlet conduit that is angled to direct fluid to align with a downhole direction of fluid flow within the annular plenum and promote upward motion of gas bubbles out of the annular plenum. For one or more intake stages 104, the intake stage may define an axial flowpath for axial flow of fluid from an upstream intake stage to flow uphole through a radially inward portion, such as impeller 125', or otherwise configured to pass fluid axially past the impeller 125. An outer intake portion, such as impeller 125", may be configured to draw fluid through the inner inlet hole 116 and provide the fluid to the axial flowpath. The stage may be without a crossover, each stage having a L:D ratio of 2.23, and 4 stages arranged in parallel. The inner inlet hole 116 may be configured to direct fluid in a radially inward direction into the intake impeller 125. An annular space 161 may be provided between the outer housing 34 and the inner housing 150. Gravity-based gas separation may occur in annular space 161 and this space may allow for misalignment between the outer inlet holes 115 and the inner inlet holes 116. Such a space may allow an accumulation of a reserve volume of liquid. The outer inlet holes 115 in the outer housing 34 are disposed in an uphole direction relative to the inner inlet holes 116 which provides fluid from the annular space 161 to an intake impeller 125. The inner housing 150 may separate the annular space/plenum 260 from the main flowpath 143 through the device for axial flow of the fluid from other intake stages 104 to bypass the radially outward portion (impeller 125") of intake impeller 125 (by passing through the radially inward portion of the intake impeller) and flow in an uphole direction and into the downstream pump or gas separator stages. In this embodiment the inner housing 150 is actually shown comprised of two parts which are assembled together within the housing 34, the longer part being a cylindrical tube, and the second part being a more complicated 3D casting which includes diffuser vanes, a shaft support bearing and with a tapered cone toward the top which meets an intake impeller 125. A diffuser with vanes may thus be disclosed, for example disposed in proximity to the impeller providing radial support to the shaft, and axial support to the impeller. This tapered cone 184 may separate the fluid flowpath 143 within the device from annular space 161. The radially outward portion (impeller 125") of the intake impeller 125 may be in communication with the annular space 161 through inner inlet holes 116 located toward the bottom of each stage of the inner housing 150. Because a crossover is not used in this embodiment, and the fluid passageway within the device is located more centrally than the radially outward portion of the intake impeller 125, therefore the intake impeller must also sweep the fluid passageway within the device 143, via the radially inward portion of the intake impeller. This embodiment shows fewer vanes and with a lower pitch within the radially inward portion of the intake impeller sweeping the main fluid passageway 143, which may be beneficial to helping draw fluid flow up from lower stages within the multistage intake device and to promote equal contribution from all stages or greater contribution from lower stages which may be exposed to more liquids-rich fluids in the wellbore relative to upper stages. The main purpose of the impeller may be the radially outward portion—the section with more vanes and each vane having a higher pitch that draw fluid in through the inner inlet holes 116. The functionality and benefits of this embodiment may otherwise be similar to those as described of FIG. 19, without need of the crossover passageway which may make this embodiment capable of handling higher total volumetric flow rates, while making this embodiment simpler and cheaper to manufacture, and improve reliability. Additionally in this configuration the inlet passageways may have a larger flowing cross-sectional area which enables a lesser number of stages to be used while achieving high flow rates.

Relative to FIG. 19, the length of each stage (and the L:D ratio) is significantly greater, and the flow capacity of each individual stage may be greater. The elongation of each stage may provide a larger annular space 161 which may provide more efficient gas separation per stage and may provide a larger "reserve volume" of liquid for intermittent events when gas slugs are encountered and no liquid may be present in the wellbore for a period of time resulting in the flow of only gas into the outer inlet holes 115. The optimal length of each stage may vary. A large cumulative length of separation chamber(s) of all stages combined may be advantageous in that it provides a "reserve volume" of liquid that may be drawn into the pump to avoid a gas lock event despite the occasional passage of "100% gas slugs" through the wellbore and past the pump intake device. Relatively large and long openings in the housing 36 may be provided to maximize the efficiency of gas separation and said slots may be angled as shown partially aligned with the downhole direction of fluid flow within the annular space 161 to improve the efficiency of gas separation. Most gas separation may occur within the slotted region and therefore large and elongated slots may be beneficial. The flow rate through the radially inward portion of the impeller in the main fluid passageway through the device 143 will vary between stages. The flow rate from below may be zero for the first stage, and increasing in subsequent stages equal to the cumulative flow provided by all stages below, therefore, it may be desirable to vary the design of intake impellers to accommodate this increasing flow rate in subsequent stages through the use of a higher vane pitch angles or increased cross sectional flow area. The intake may be coupled to other gas separation or pump stages above, or all may be stacked and assembled within the same outer housing 33. It may not be necessary for the impeller of every stage to be accompanied by a diffuser with vanes or shaft support, since axial support of the impeller may be provided by other means, however it may be beneficial for reliability for the shaft 20 to be supported at a location nearby to the impeller, and straightening the flow within the main flowpath within the device 143 may be improve the effect of the impeller vanes that sweep the main flowpath within the device 143 to draw fluid up from lower intake stages 104. In the embodiment shown the total flow area through the 64 outer inlet holes may be approximately 184 sqin, and the flow area between the shaft 20 OD and the housing 34 ID may be approximately 15 sqin giving a ratio of the flow area through the inlet holes to the flow area inside the housing 34 of approximately 12. In the embodiment shown the total flow area through the 32 inner inlet holes may be approximately 25 sqin, and the flow area between the shaft 20 OD and the housing 34 ID may be approximately 15 sqin giving a ratio of the flow area through the inlet holes to the flow area inside the housing 34 of approximately 1.7.

In some cases, the stages may be designed intentionally for non-uniform contribution from each stage. For example, it may be desirable to design the lower stages to provide a relatively larger contribution of intake flow rate corresponding with the average properties of the fluid within the wellbore passing each stage; where higher stages are exposed to higher gas volume fractions in the wellbore because of the liquid that was taken into the device by lower stages. Even with a single impeller design a larger contribution from the lower stages may be achieved due to the function of the inner portion of the impellers which draw fluid from lower stages. For example, the radially outwards portion of the impeller could be sized larger or with a higher vane lead angle at the lower stages in order to achieve a larger contribution from the lower stages.

Figure 20A:
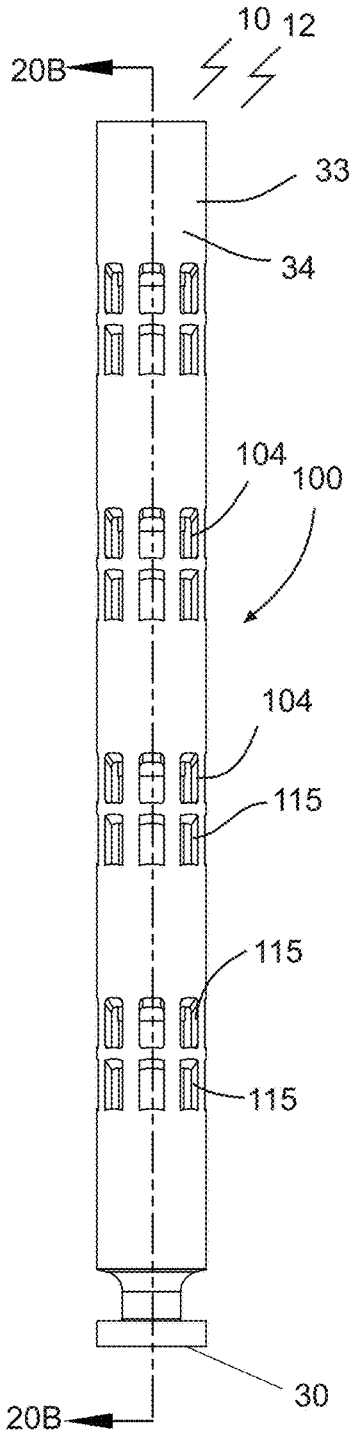
FIG. 20A is a side elevation view of an embodiment of a multistage intake device, with an annular space defined between the housing and main flowpath to enable gravity-based buoyancy separation of gas before entering the intake impeller, with each stage arranged in parallel, and each stage having an impeller.
Figure 20B:
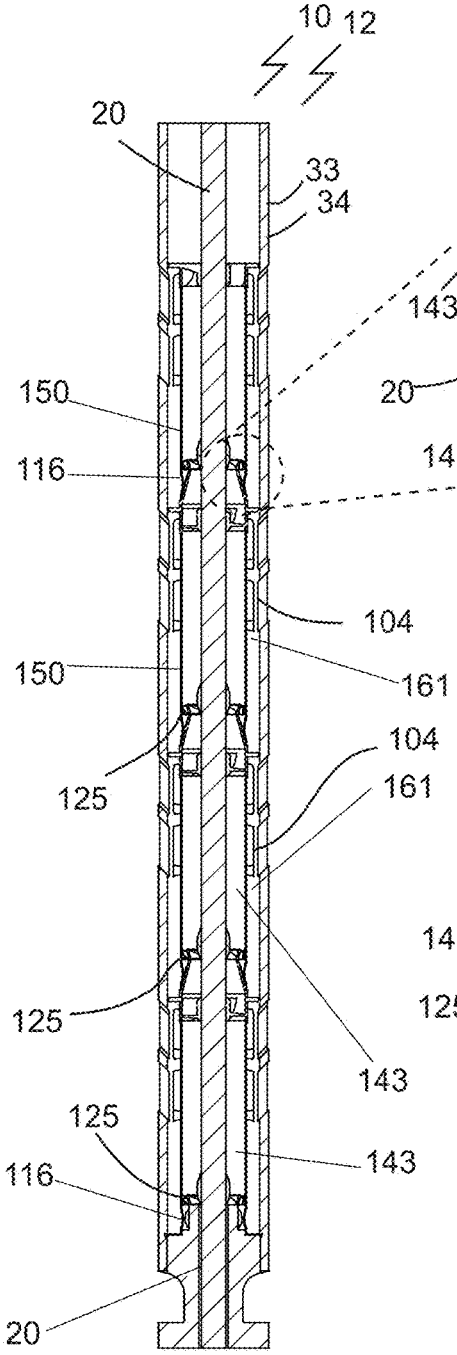
FIG. 20B is a view taken along the 20B-20B section lines in FIG. 20A.
Figure 20D:
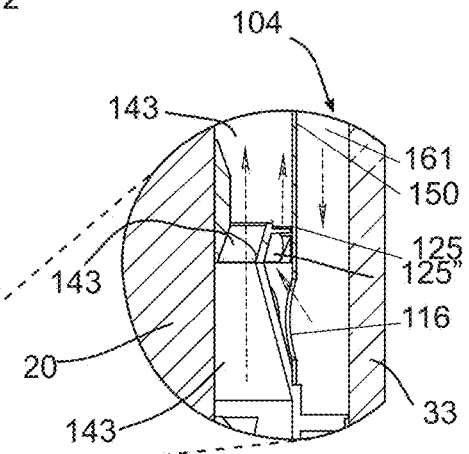
FIG. 20D is a close-up view circular area denoted in dashed lines in FIG. 20B.
Figure 20C:
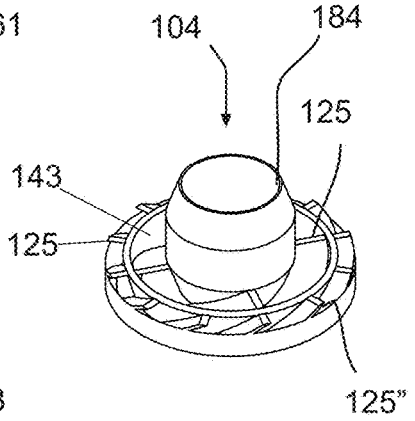
FIG. 20C is a perspective view of the intake impeller of FIG. 20A.
Figure 20E:
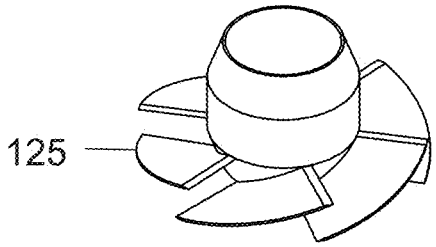
FIG. 20E is a perspective view of an alternate configuration of the intake impeller of FIG. 20C.
Figure 20F:
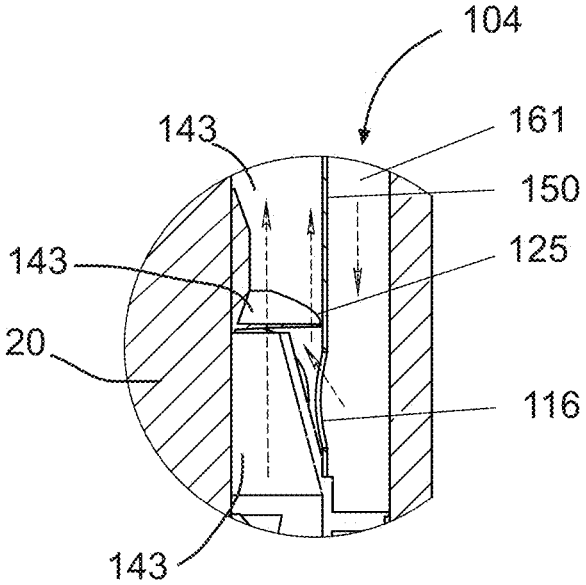
FIG. 20F is close-up view of the circular area denoted in dashed lines in FIG. 20B, showing an alternate configuration of the intake impeller of FIG. 20D.
Figure 21A:
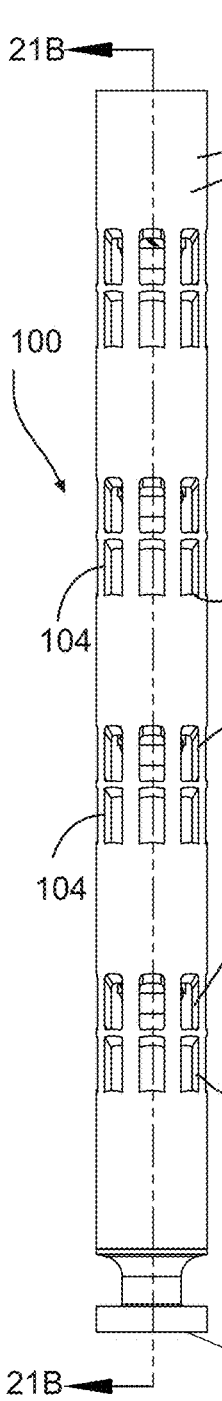
FIG. 21A is a side elevation view of an embodiment of a multistage intake device, with each stage arranged in parallel, each stage having an impeller and a gas exhaust crossover located toward the top of each stage such that each stage functions as both a passive gravity-based gas separator and an active vortex gas separator.
Figure 21B:
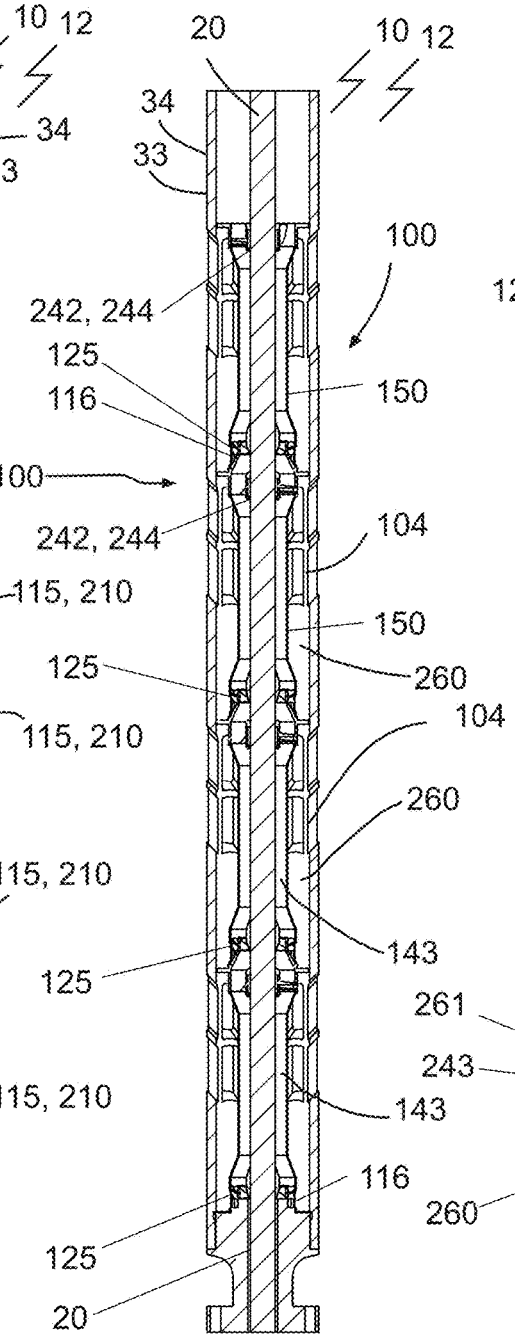
FIG. 21B is a view taken along the 21B-21B section lines in FIG. 21A.
Figure 21C:
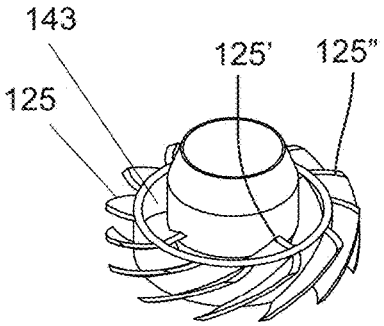
FIG. 21C is a perspective view of the intake impeller of FIG. 21A.
Figure 21D:
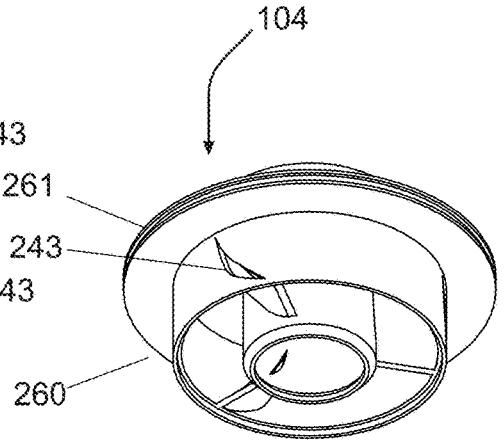
FIG. 21D is a lower perspective view of 1 diffuser with hollow vanes from FIG. 21B.

Referring to FIGS. 20E and 20F an alternate intake impeller design for a multistage intake device with configuration similar to FIG. 20D is shown. The vanes comprising the radially outward portion of the intake impeller may be continuous with the vanes comprising the radially inward portion of the intake impeller. There may be no surface (structure) separating the two portions. In this embodiment, the number of vanes cannot be greater in the radially outward portion (although it may be less), and the pitch of the vanes must be approximately the same between the two portions. This embodiment may be more practical and cost effective to manufacture. Each intake may be structured to direct incoming fluid in a downhole direction in the plenum or space 161, radially inward through the inner inlet hole 116, and in an uphole direction through the outer intake portion (impeller 125") of the impeller. In another embodiment a cylindrical or frusto-conical surface may separate the radially inward portion of the impeller from the outer intake portion of the impeller. As above, vane design may be different on the radially inward portion of the impeller from the vane design on the outer intake portion of the impeller. More stages with greater total cross section area of the inlet holes may be desirable to increase the overall capacity and efficiency of the device.

Referring to FIG. 21A, 21B, 21C, 21D a multistage intake device with a crossover functioning as both a gravity-based gas separator and a vortex gas separator is shown. Each stage may have a L:D ratio of 2.23 and 4 stages arranged in parallel. The inner housing 150 may be formed on both ends in order to create a larger cross-sectional area in the annular space/plenum 260 between it and the housing 34 where gravity-based gas separation occurs and reserve liquid volume is held. Such may improve the efficiency of gravity-based gas separation and increase the volume of reserve liquid that may be held within a stage of the same length while accommodating larger diameter impellers which provide greater capacity than smaller impellers. The diffuser may provide support to the shaft 20 (similar to FIG. 20) but also may have hollow vanes with a gas exhaust exit point 243 from hollow vane that exhausts gas toward the top of the annular space/plenum 260 where it may be exhausted out the housing 34 via intake holes 115 which also function as gas exhaust holes 210. Gas that is to be exhausted may enter the crossover flowpath junction 242, which has a generally cylindrical structure, in an uphole direction located toward the central axis. The gas exhaust flowpath smallest cross-sectional area 244 may be located at the crossover flowpath junction 242 (benefits discussed elsewhere). While this configuration is shown, it should be apparent that any of the gas entry locations within a diffuser or impeller may be practically applied.

Referring to FIG. 22A, 22B, 22C, 22D a multistage intake device without a crossover is shown. Each stage may have a L:D ratio of 2.97 and 3 stages arranged in parallel. An annular space 161 may be provided between the outer housing 34 and the inner housing 150. The inner inlet hole 116 may be oriented in a generally axial direction. The outer intake portion of the intake impeller may be arranged generally in a downhole direction and with a similar diameter as the annular plenum. Gravity-based gas separation may occur in annular space 161 and this space may allow misalignment between the inlet holes 115 and the inner inlet holes 116, and this space allows accumulation of a reserve volume of liquid. The outer inlet holes 115 in the outer housing 34 may be disposed higher than the inner inlet holes 116 which provides fluid from the gravity-based gas separation chamber to a radially outward portion of an intake impeller 125. In this embodiment the inner inlet holes 116 may be oriented axially (while it was radial in FIG. 21). The inner housing 150 may separate the annular space 161 from the main flowpath through the device 143 for axial flow of the fluid from other intake stages 104. The flow from lower intake stages 104 may bypass the radially outward portion of intake impeller (by passing through the radially inward portion of the intake impeller) and flow in an uphole direction and into the pump or gas separator or subsequent intake stages 104. In this embodiment the inner housing 150 is actually shown comprised of three parts which are assembled together within the outer housing 34, the longer part being a cylindrical tube 150', which is supported between a ring 150" with the inner inlet holes 116, and the diffuser 150'" which may include vanes and a shaft support bearing. The intake impeller 125 may be sandwiched between, and may be supported by, the diffuser 150'" and the ring 150". A vane helix direction of the outer intake portion of the impeller may be opposite to a vane helix direction of the radially inward portion of the impeller. Thus, the blades on the radially inward portion of the intake impeller 125 may spiral in one direction (the same direction as typical pump stage impellers) to promote flow in an uphole direction in the main flowpath through the device 143 while the blades on the radially outward portion of the intake impeller 125 spiral in the opposite direction to promote flow in a downhole direction from the bottom of the annular space 161. Fluid may pass through the outer inlet holes 115 and the separation and exclusion of gas may primarily occur within the outer inlet holes 115 and annular space 161 providing a liquid rich fluid at the bottom of the annular space; the fluid may then pass the inner inlet holes 116 and the radially outward portion of the intake impeller acting in the downhole direction; the fluid may then reverse direction in the flow direction transition space 144; the fluid may then mix with the fluid from lower stages within the main flowpath through the device 143 and may pass through the radially inward portion of same intake impeller in the uphole direction. There may be radially oriented ribs 191 (FIG. 22C) within the flow direction transition space 144 integral with the diffuser 150'", which may prevent excessive spinning motion of fluid within the transition space to mitigate erosion problems which may result if the fluid was allowed to spin in this space. The ribs may also function to minimize the spin of the flow as the fluid passes from the outer portion and into the inner portion of the intake impeller to improve efficiency of the impellers. This embodiment shows less vanes but with the same pitch sweeping the main fluid passageway; the vanes sweeping the radially inward portion of the intake impeller may be beneficial to draw fluid up from lower stages and promote equal or greater contribution of flow from lower stages within the multistage intake device; however the main purpose of the impeller may be the radially outward portion of the intake impeller with more vanes that draws fluid in through the outer inlet holes 115, the annular space 161, and the inner inlet holes 116. The functionality and benefits of this configuration may be otherwise similar to those as described of FIG. 22 with a configuration that may make more effective to manufacture and make more efficient use of the space available. Despite the radially outward portion of the intake impeller acting in an "unconventional" downhole direction, it may still exhibit the same desirable autonomous behavior which prefers the intake of liquid from liquid-rich stages while reducing or blocking the intake of gas from stages which are liquid-poor. This embodiment shows the longest length of each stage (and the highest L:D ratio) of all embodiments, however one skilled in the art may understand that the length may be further increased, especially for surface-driven applications such as are typical of progressive cavity pumps (PCPs) wherein the intake may be made relatively long with relatively cost and few technical trade-offs. Higher efficiency and effectiveness may be achieved by maximizing both the length of each stage and the total number of stages; however, there is a practical limit to the total length (especially for electric submersible pumps) and the cost increases with both the length and the number of stages, therefore the optimal design in any particular size and application must balance these factors.

Figure 22A:
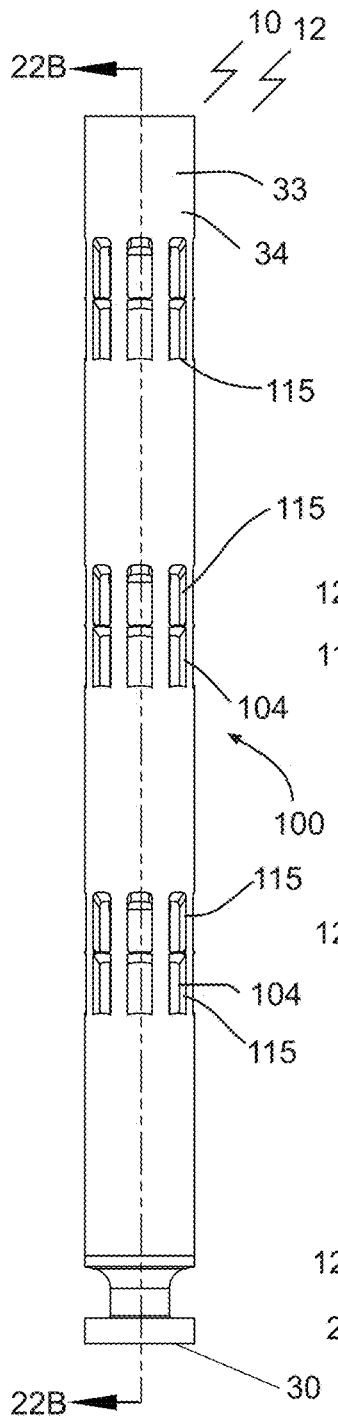
FIG. 22A is a side elevation view of an embodiment of a multistage intake device, with each stage arranged in parallel, and each stage having an impeller, wherein the radially outward portion of the intake impeller directs fluid in a downhole direction.
Figure 22B:
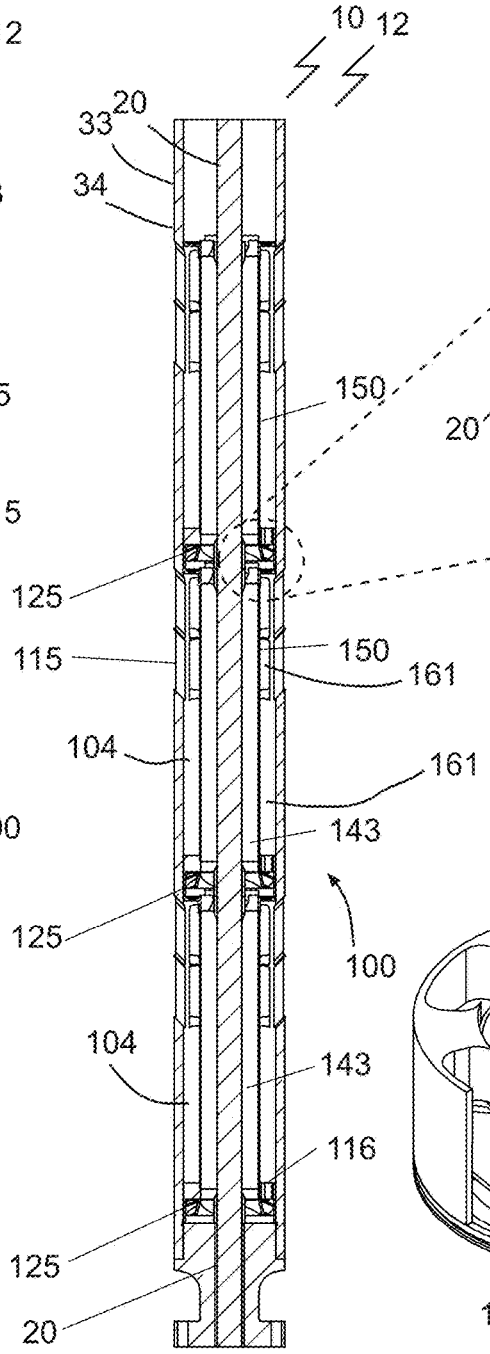
FIG. 22B is a view taken along the 22B-22B section lines in FIG. 22A.
Figure 22D:
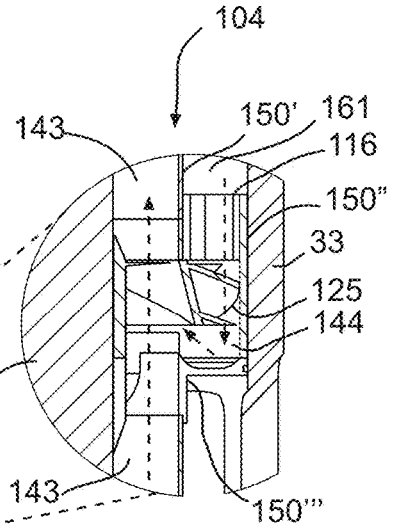
FIG. 22D is a close-up view of the circular area denoted in dashed lines in FIG. 22B.
Figure 22C:
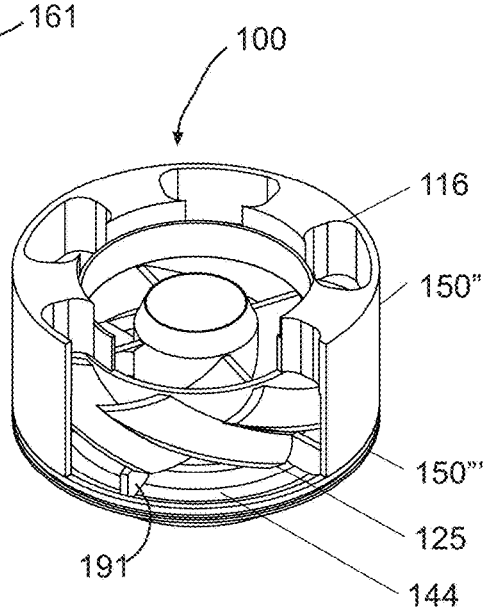
FIG. 22C is a partial cutout perspective view of the intake impeller and adjacent inner housing of FIG. 22A.
Figure 22E:
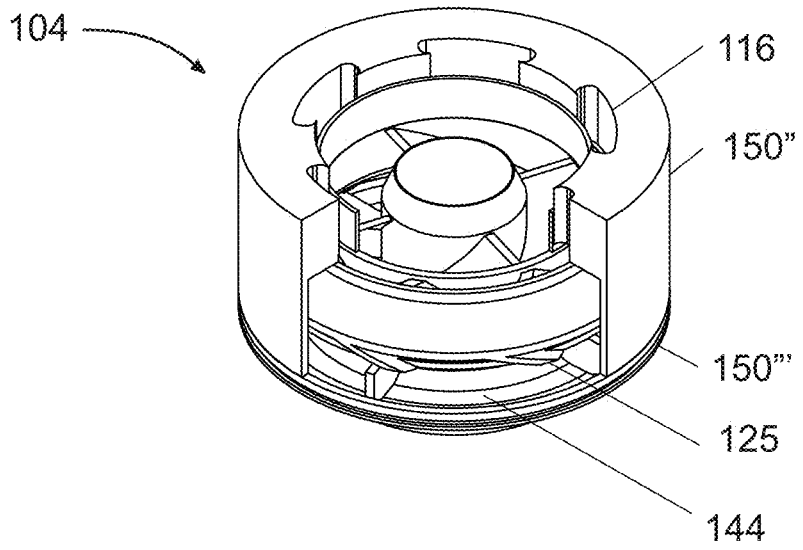
FIG. 22E is a partial cutout perspective view of an alternate configuration of the radially outward portion of the intake impeller of FIG. 22C.
Figure 22F:
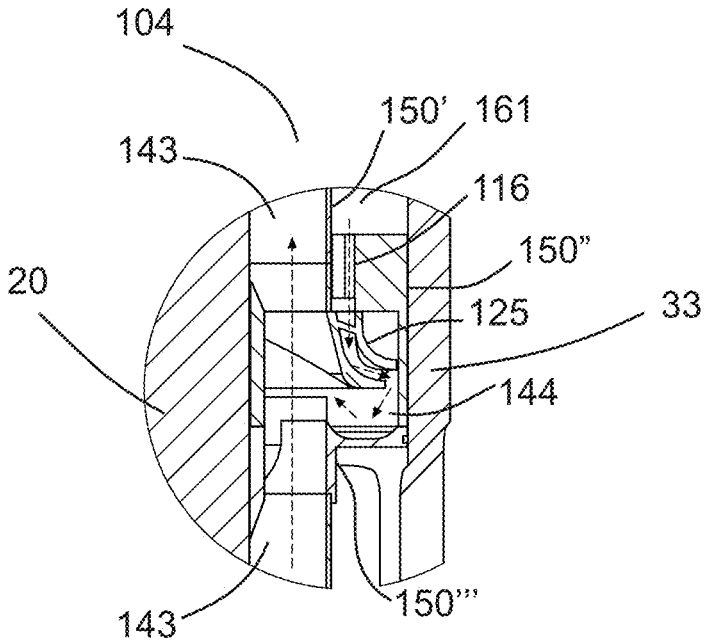
FIG. 22F is a close-up view of the circular area denoted in dashed lines in FIG. 22B, illustrating an alternate configuration of the radially outward portion of the intake impeller of FIG. 22D.

Referring to FIGS. 22E and 22F an alternate intake impeller design for a multistage intake device with configuration similar to FIG. 22D is shown. The radially outward portion of the intake impeller may have a primarily radial impeller design. The outer intake portion of the intake impeller may be primarily radial and configured to move the fluid in a downhole direction and a radially outward direction. While moving the fluid in a downhole direction, the fluid may be moved in a radially outward direction through the radially outward portion of the intake impeller. This radial design may provide lower flow rate capacity through each stage, and will provide stronger autonomous behavior where stages that expose the radially outward portion of the intake impeller to higher density fluid (liquid-rich) will contribute more inflow volume relative to stages that expose the radially outward portion of the intake impeller to lower density fluid (liquid-poor). This radial design may also provide a higher differential pressure, increasing the pressure more inside the main flowpath 143 relative to a design with a less radially oriented flowpath within the radially outward portion of the intake impeller.

Parts: 1 Wellbore. 2 Production Tubing. 3 Openings between wellbore and reservoir. 4 Fluid flowing in wellbore towards pump. 4' Primarily liquid phase of fluid in stratified or slugging flow in wellbore towards pump. 4" Primarily gas phase of fluid flow in wellbore towards pump. 5 The Annulus (between the wellbore wall and the pump or production tubing) which extends to surface as a distinct flowpath for gas. 6 Downhole rotary motor. 10 Rotary pump, including intake apparatus and any gas separation stages. 12 intake and separator device. 20 Rotary shaft. 30 Coupler to motor. 31 Coupler to main ESP stages. 32 Coupler between intake and gas separator. 33 pump housing. 34 intake outer housing. 36 separator outer housing. 38 separator stage housing. 12 100 Rotary pump intake section/intake device. 104 intake stages. 106 inlet section. 110 Inlet holes. 111 First stage inlet holes. 112 Second stage inlet holes. 113 Third stage inlet holes. 114 Fourth stage inlet holes. 115 outer inlet holes in the outer housing for a multistage-parallel configuration intake. 116 inner inlet holes in the inner housing for a multistage-parallel configuration intake. 120 intake impeller. 121 First stage intake impeller for a multistage-series configuration intake. 122 Second stage intake impeller for a multistage-series configuration intake. 123 Third stage intake impeller for a multistage-series configuration intake. 124 Fourth stage intake impeller for a multistage-series configuration intake. 125 intake impeller for a multistage-parallel configuration intake. 125' intake impeller for a multistage-parallel configuration intake inverted. 126 Impeller vane. 131 First stage intake diffuser for a multistage-series configuration intake. 132 Second stage intake diffuser for a multistage-series configuration intake. 133 Third stage intake diffuser for a multistage-series configuration intake.

140 multistage-parallel configuration intake crossover. 141 intake flowpath through multistage-parallel configuration intake crossover. 142 gathering space inside multistage-parallel configuration intake crossover that permits flow to impellers disposed both above and below. 143 the main flowpath through the device for axial flow of the fluid from other intake stages to bypass the intake impeller and flow in an uphole direction and into the pump or gas separator. 144 flow direction transition space. 150 multistage-parallel configuration intake inner housing. 160 recessed OD on multi-stage-parallel configuration intake crossover to allow an enlarged annular space between it and the housing. 161 annular space—used for gravity-based gas separation between the outer housing and the inner housing. 180 upstream end of intake stage. 182 downstream end of intake stage. 184 tapered cone. 200 Rotary pump gas separation section/gas separator device. 204 gas separator stages. 210 gas exhaust holes. 220 gas separator impellers in a multi-stage gas separator that are downstream of the first gas exhaust port. 221 gas separator impeller. 222 gas separator impeller vanes within the crossover pathway, the motion of which impede passage of fluid, especially dense fluids like liquid and may help intake and push liquids into the pump. 223 impeller holes or slots as part of the crossover flowpath which may be used to exhaust gas while resisting liquid exit, or alternatively to push liquid into the pump when present. 224 small inverted impeller within the crossover flowpath of a multi-function stage. 230 gas separator vortex chamber with no vanes. 240 gas separator diffuser stages. 241 fluid flowpath between diffuser vanes. 242 crossover flowpath junction (also the gas exhaust entry point into the crossover flowpath). 243 gas exhaust exit point from hollow vane. 244 gas exhaust flowpath smallest cross sectional area. 245 gathering space inside the crossover flowpath of a multi-function gas separator and intake stage that may function as a buoyancy driven gas separation chamber. 246—fluid flowpath. 250 diffuser vane. 251 diffuser vane leading edge. 252 diffuser vane trailing edge. 253 diffuser vane top edge. 254 diffuser vane bottom edge. 255 solid diffuser vane. 256 hollow diffuser vane (not necessarily hollow the entire length). 257 recessed ID on diffuser which provides an annular space between diffuser and shaft large enough to permit gas exhaust flow. 260 plenum-recessed OD on diffuser to allow an enlarged annular space between diffuser and fero. 261 O-rings groove on diffuser. 264 shaft collar. 266 radially inside edge. 270 nose inlet. 272 vortex

What is claimed is:

1. A multi-stage intake of a downhole rotary pump comprising:

a housing, which defines a fluid flowpath;

two or more intake stages arranged axially relative to one another within the housing, and structured to intake fluid from a wellbore in parallel, with each of the two or more of intake stages having:

one or more impellers; and an inlet hole that is oriented to permit fluid from the wellbore to enter into the fluid flowpath.

2. The multi-stage intake of claim 1 comprising three or more intake stages.

3. The multi-stage intake of claim 1 in which the inlet holes of adjacent intake stages, of the two or more intake stages are separated by at least one impeller.

4. The multi-stage intake of claim 1 in which the housing comprises a plurality of housings, one for each intake stage, of the two or more intake stages.

5. The multi-stage intake of claim 1 in which, one or more intake stages, of the two or more intake stages, have a ratio, of an axial length to outer diameter of an outer housing of the intake stage, of 4.0:1 or less.

6. The multi-stage intake of claim 5 in which one or more intake stages, of the two or more intake stages, have an axial length to outer diameter ratio of 2.0:1 or less.

7. The multi-stage intake of claim 1 in which, for one or more intake stages, of the two or more intake stages:

the intake stage comprises an outer housing and an inner housing;

an annular plenum is defined between the inner housing and outer housing;

the inlet hole comprises an inner inlet hole and an outer inlet hole;

the inner housing defines the inner inlet hole; and the outer housing defines the outer inlet hole to permit entry of fluid into the annular plenum.

8. The multi-stage intake of claim 7 in which the annular plenum has sufficient volume to allow residence time for gas bubbles to coalesce and rise out of the fluid by buoyancy.

9. The multi-stage intake of claim 7 in which the outer inlet holes is axially above the inner inlet hole to allow gas bubbles to coalesce and rise out of the fluid by buoyancy.

10. The multi-stage intake of claim 7 in which the outer inlet hole has a ratio, of a cumulative open flow area through the outer inlet hole to a flow area within the annular plenum, of greater than 1.

11. The multi-stage intake of claim 1 in which an intake stage, of the two or more intake stages, comprises:

an intake housing defining the fluid flowpath and the inlet hole to the fluid flowpath; and the one or more impellers being an intake impeller configured to draw fluid through the inlet hole and supply the fluid into the fluid flowpath.

12. The multi-stage intake of claim 11 in which one or more intake stages, of the two or more intake stages, defines:

an axial flowpath for axial flow of fluid from an upstream end to a downstream end of the intake stage; and a crossover flowpath to ingest fluid from the inlet hole and provide the fluid to the one or more impellers, which are radially inward of the crossover flowpath.

13. The multi-stage intake of claim 12 in which one or more intake stages, of the two or more intake stages, comprise two or more impellers.

14. The multi-stage intake of claim 13 in which, for one or more intake stages, of the two or more intake stages, the crossover flowpath comprises a gathering space chamber configured to receive fluid from the inlet hole and provide the fluid to two impellers arranged in parallel within the intake stage.

15. The multi-stage intake of claim 14 in which, for one or more intake stages, of the two or more intake stages, a radial thickness of the one or more impellers, between an inner impeller diameter and an outer impeller diameter, is between 15 and 75% of a radial distance between an outer wall of a central rotating shaft and an inner diameter of an outer housing.

16. The multi-stage intake of claim 1 in which one or more intake stages, of the two or more intake stages, comprise:

an outer housing with an outer inlet hole;

an inner housing radially inward of the outer housing defining the fluid flowpath;

the inner housing defining an inner inlet hole;

the space between the inner housing and outer housing defining an annular plenum; and an impeller within the inner housing and configured with a radially outward intake impeller portion.

17. The multi-stage intake of claim 16 in which a cross-sectional area of the outer inlet hole is sufficient to allow for gas bubbles to coalesce and rise out of the fluid by buoyancy and a volume of the annular plenum below the outer inlet hole provides a sufficient reserve volume of liquid rich fluid to avoid gas locking during slug flow events in a wellbore.

18. The multi-stage intake of claim 16 in which the outer inlet hole is axially above the inner inlet hole, to allow gas bubbles to coalesce and rise out of the fluid by buoyancy.

19. The multi-stage intake of claim 16 in which one or more intake stages comprise a plurality of outer inlet holes angularly spaced from one another about a circumference of the housing.

20. The multi-stage intake stage of claim 16 in which the inner inlet hole forms an inlet conduit that is angled to direct fluid to align with a downhole direction of fluid flow within the annular plenum and promote uphole motion of gas bubbles uphole and out of the annular plenum.

21. The multi-stage intake of claim 16 comprising three or more intake stages.

22. The multi-stage intake of claim 16 in which one or more intake stages, of the two or more intake stages, each have a length to outer diameter ratio of 4.0:1 or less.

23. The multi-stage intake of claim 16 in which a diffuser with vanes is disposed in proximity to the impeller providing radial support to a shaft.

24. The multi-stage intake of claim 23 in which the diffuser:

defines a gas crossover flowpath between a gas entry point and a gas outlet;

has one or more hollow vanes within which the gas crossover flowpath is at least partially defined; and is structured to exhaust gas from an entry point, through the gas crossover flowpath, and into the annular plenum defined between the inner housing and outer housing.

25. The multi-stage intake of claim 16 in which, for one or more intake stages, the outer inlet hole is elongate in an axial direction.

26. The multi-stage intake of claim 25 in which, for one or more intake stages, of the two or more intake stages, an inlet section defined by the outer inlet hole has a cumulative length between 20% and 70% of a cumulative stage axial length.

27. The multi-stage intake of claim 25 in which, for two or more intake stages, of the two or more intake stages, an inlet section defined by the outer inlet hole has a cumulative axial length with a ratio, of the axial length of the inlet section to an outer diameter of the housing at the outer inlet hole, of greater than 4.

28. The multi-stage intake of claim 16 in which, for one or more intake stages, of the two or more intake stages, the radially outward intake impeller portion is configured to draw fluid axially downhole, such that thereafter the fluid turns radially inward and axially uphole, mixing with the fluid from upstream stages, of the two or more intake stages, and together the mixed fluids pass though a radially inward intake impeller portion in an uphole direction.

29. The multi-stage intake of claim 28 in which a vane helix direction of the outer intake portion of the impeller is opposite to a vane helix direction of the radially inward portion of the impeller.

30. The multi-stage intake of claim 28 in which the inner inlet hole is oriented in a generally axial direction and the outer intake portion of the intake impeller is arranged for flow in generally in a downhole direction.

31. The multi-stage intake of claim 30 in which the outer intake portion of the intake impeller is primarily radial and is configured to move the fluid in a downhole direction and a radially outward direction.

32. The multi-stage intake of claim 30 in which the outer intake portion of the intake impeller is configured to direct fluid in a downhole and radial outward direction.

33. The multi-stage intake of claim 16 in which for one or more intake stages, of the two or more intake stages:

the one or more intake stages define an axial flowpath for axial flow of fluid from an upstream intake stage to flow uphole through a radially inward portion, of the impeller, configured to pass fluid axially past the impeller; and the radially outward intake impeller portion is configured to draw fluid through the inner inlet hole and provide the fluid to the axial flowpath.

34. The multi-stage intake of claim 33 in which vanes of the impeller are continuous between the radially inward portion of the impeller and the outer intake portion of the impeller and there is no surface dividing the two.

35. The multi-stage intake of claim 33 in which the inner inlet hole is configured to direct fluid in a radially inward direction into an intake impeller.

36. The multi-stage intake of claim 35 structured to direct incoming fluid:

in a downhole direction in the annular plenum;

radially inward through the inner inlet hole; and in an uphole direction through the radially outward intake impeller portion.

37. The multi-stage intake of claim 36 in which a cylindrical or frusto-conical surface separates the radially inward portion of the impeller from the outer intake portion of the impeller.

38. The multi-stage intake of claim 37 in which vane design is different on the radially inward portion of the impeller from the vane design on the outer intake portion of the impeller, such that the vane design on the outer intake portion is structured to create more pressure with a lower flow rate.

39. A downhole pump comprising a plurality of the multi-stage intakes of claim 1.

40. The downhole pump of claim 39 wherein:

an assembly of the intake stages, of the two or more intake stages, has a ratio, of a cumulative open flow area through an outer inlet hole of all intake stages in the assembly, to a flow area inside an inner housing, of greater than 4;

a reserve-fluid volume that is created in use by a length of annular plenum defined between a bottom of the outer inlet hole and a top of an inner inlet hole;

three or more intake stages, of the two or more intake stages, are arranged in parallel; and such that efficient gravity-based separation of gas is allowed in use while also providing a reserve volume of fluid to improve tolerance to transient gas slug flow in a wellbore, and a high total intake flow rate to a downstream gas separator or pump stages.

41. A downhole rotary pump comprising the multi-stage intake of claim 1.

42. A method comprising operating the downhole rotary pump of claim 41 by driving each intake stage, of the two or more intake stages, to intake fluid in parallel into the fluid flowpath.

43. A method comprising operating the downhole rotary pump of claim 41 with:

the impeller of one or more intake stages, of the two or more intake stages, autonomously regulates the inflow rate from each intake stage; and intake stages with higher density fluid at the impeller provide a higher volumetric flow rate and contribution to the total inflow than intake stages with a lower density fluid.

44. A method comprising operating the downhole rotary pump of claim 41 wherein the impeller of each intake stage, of the two or more intake stages, creates sufficient pressure to overcome friction pressure losses within the fluid flow-path allowing approximately equal contribution from all intake stages regardless of their position toward the bottom or the top of the downhole rotary pump.

* * * * *